US006093526A

United States Patent [19]

Buitano et al.

[11] Patent Number: 6,093,526

[45] Date of Patent: Jul. 25, 2000

[54] PHOTOGRAPHIC FILM ELEMENT CONTAINING AN EMULSION WITH BROADENED GREEN RESPONSIVITY

[75] Inventors: Lois A. Buitano; Steven G. Link; Allan F. Sowinski, all of Rochester, N.Y.

[73] Assignee: Eastman Kodak Company, Rochester, N.Y.

[21] Appl. No.: 09/259,988

[22] Filed: Mar. 1, 1999

[51] Int. Cl.[7] ..... G03C 1/18

[52] U.S. Cl. ..... 430/574; 430/503; 430/583; 430/584; 430/585

[58] Field of Search ..... 430/583, 584, 430/585, 574, 503

[56] References Cited

U.S. PATENT DOCUMENTS

| | | |
|---|---|---|
| 3,672,898 | 6/1972 | Schwan et al. . |
| 4,599,301 | 7/1986 | Ohashi et al. . |
| 5,037,728 | 8/1991 | Shiba et al. . |
| 5,053,324 | 10/1991 | Sasaki . |
| 5,077,182 | 12/1991 | Sasaki et al. . |
| 5,166,042 | 11/1992 | Nozawa . |
| 5,169,746 | 12/1992 | Sasaki . |
| 5,206,124 | 4/1993 | Shimazaki et al. . |
| 5,206,126 | 4/1993 | Shimazaki et al. . |
| 5,258,273 | 11/1993 | Ezaki et al. . |
| 5,308,748 | 5/1994 | Ikegawa et al. . |
| 5,376,508 | 12/1994 | Yamada et al. . |
| 5,460,928 | 10/1995 | Kam-Ng et al. . |
| 5,582,961 | 12/1996 | Giogianni et al. . |

FOREIGN PATENT DOCUMENTS

| | | |
|---|---|---|
| 0 866 368 A2 | 9/1998 | European Pat. Off. . |
| 3740340 A1 | 8/1988 | Germany . |

OTHER PUBLICATIONS

Abstract, EP 866368 A.

*Primary Examiner*—Thorl Chea
*Attorney, Agent, or Firm*—Edith A. Rice

[57] ABSTRACT

This invention comprises a photographic element for accurately recording a scene as an image comprising a support and coated on the support a plurality of hydrophilic colloid layers comprising radiation-sensitive silver halide emulsion layers forming recording layer units for separately recording blue, green and red exposures wherein, the green recording layer unit comprises at least one green sensitive emulsion having:

(i) a peak dyed absorptance of between 520 and 560 nm, (ii) an absorption bandwidth at 50% of the peak dyed absorptance greater than or equal to 50 nm, (iii) an absorption bandwidth at 80% of the peak dyed absorptance greater than or equal to 27 nm, (iv) a ratio of the absorptance at 560 nm to the peak dyed absorptance greater than or equal to 0.40, (v) a ratio of the absorptance at 550 nm to the peak dyed absorptance greater than or equal to 0.60, and (vi) a ratio of the absorptance at 520 nm to the peak dyed absorptance greater than or equal to 0.55.

30 Claims, 23 Drawing Sheets

PHOTOGRAPHIC FILM ELEMENT CONTAINING AN EMULSION WITH BROADENED GREEN RESPONSIVITY

FIELD OF THE INVENTION

The instant invention relates to a silver halide emulsion prepared for use in the green sensitive layer unit of a color photographic element. The element is particularly suitable for scanning, electronic manipulations, and reconversion to a viewable form that accurately records light according to the human visual system.

DEFINITION OF TERMS

The term "E" is used to indicate exposure in lux-seconds.

The term "Status M density" is used to indicate image dye densities measured by a densitometer meeting photocell and filter specifications described in *SPSE Handbook of photographic Science and Engineering*, W. Thomas, editor, John Wiley & Sons, New York, 1973, Section 15.4.2.6 Color Filters. The International Standard for Status M density is set out in "Photography—Density measurements—Part 3: Spectral conditions", Ref. No. ISO 5/3-1984 (E).

The term "gamma" is employed to indicate the incremental increase in image density ($\Delta D$) produced by a corresponding incremental increase in log exposure ($\Delta \log E$) and indicates the maximum gamma measured over an exposure range extending between a first characteristic curve reference point lying at a density of 0.15 above minimum density and a second characteristic curve reference point separated from the first reference point by 0.9 log E.

The term "coupler" indicates a compound that reacts with oxidized color developing agent to create or modify the hue of a dye chromophore.

In referring to blue, green and red recording dye image-forming layer units, the term "layer unit" indicates the hydrophilic colloid layer or layers that contain radiation-sensitive silver halide grains to capture exposing radiation and couplers that react upon development of the grains. The grains and couplers are usually in the same layer, but can be in adjacent layers.

The term "exposure latitude" indicates the exposure range of a characteristic curve segment over which instantaneous gamma ($\Delta D/\Delta \log E$) is at least 25 percent of gamma, as defined above. The exposure latitude of a color element having multiple color recording units is the exposure range over which the characteristic curves of the red, green, and blue color recording units simultaneously fulfill the aforesaid definition.

The term "colored masking coupler" indicates a coupler that is initially colored and that loses its initial color during development upon reaction with oxidized color developing agent.

The term "substantially free of colored masking coupler" indicates a total coating coverage of less than 0.09 millimole/$m^2$ of colored masking coupler.

The term "dye image-forming coupler" indicates a coupler that reacts with oxidized color developing agent to produce a dye image.

The term "development inhibitor releasing compound" or "DIR" indicates a compound that cleaves to release a development inhibitor during color development. As defined DIR's include couplers and other compounds that utilize anchimeric and timed releasing mechanisms.

In referring to grains and emulsions containing two or more halides, the halides are named in order of ascending concentrations.

The terms "high chloride" and "high bromide" in referring to grains and emulsions indicate that chloride or bromide, respectively, is present in a concentration of greater than 50 mole percent, based on silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal faces and an aspect ratio of at least 2.

The term "tabular grain emulsion" refers to an emulsion in which tabular grains account for greater than 50 percent of total grain projected area.

The terms "blue spectral sensitizing dye", "green spectral sensitizing dye", and "red spectral sensitizing dye" refer to a dye or combination of dyes that sensitize silver halide grains and, when adsorbed, have their peak absorption in the blue, green and red regions of the spectrum, respectively.

The term "half-peak bandwidth" in referring to a dye indicates the spectral region over which absorption exhibited by the dye is at least half its absorption at its wavelength of maximum absorption.

The term "overall half-peak bandwidth" indicates the spectral region over which a combination of spectral sensitizing dyes within a layer unit exhibits absorption that is at least half their combined maximum absorption at any single wavelength.

*Research Disclosure* is published by Kenneth Mason Publications, Ltd., Dudley House, 12 North St., Emsworth, Hampshire P010 7DQ, England.

BACKGROUND OF THE INVENTION

Color photographic elements are conventionally formed with superimposed blue, green, and red recording layer units coated on a support. The blue, green, and red recording layer units contain radiation-sensitive silver halide emulsions that form a latent image in response to blue, green, and red light, respectively. Additionally, the blue recording layer unit contains a yellow dye-forming coupler, the green recording layer unit contains a magenta dye-forming coupler, and the red recording layer unit contains a cyan dye-forming coupler.

Following imagewise exposure, a negative working photographic element is processed in a color developer that contains a color developing agent that is oxidized while selectively reducing to silver the latent image bearing silver halide grains. The oxidized color developing agent then reacts with the dye-forming coupler in the vicinity of the developed grains to produce an image dye. Yellow (blue-absorbing), magenta (green-absorbing) and cyan (red-absorbing) image dyes are formed in the blue, green, and red recording layer units, respectively. Subsequently the element is bleached (i.e., developed silver is converted back to silver halide) to eliminate neutral density attributable to developed silver and then fixed (i.e., silver halide is removed) to provide stability during subsequent room light handling.

When processing is conducted as noted above, negative dye images are produced. To produce corresponding positive dye images, and hence, to produce a visual approximation of the hues of the subject photographed, white light is typically passed through the color negative image to expose a second color photographic material having blue, green, and red recording layer units as described above, usually coated on a white reflective support. The second element is commonly referred to as a color print element. Processing of the color print element as described above produces a viewable positive image that approximates that of the subject originally photographed.

A positive working color photographic element is first developed in a black-and-white developer where the exposed crystals are selectively reduced to metallic silver. The unexposed silver is then fogged and reduced by a chromogenic color developer in a subsequent step to generate cyan, magenta, and yellow image dyes. The film is further bleached and fixed as with the negative working film. The positive working film thus forms dyes in the unexposed areas and renders a positive image of the scene, directly.

A problem with the accuracy of color reproduction delayed the commercial introduction of color negative elements. In color negative imaging, two dye image-forming coupler containing elements, a camera speed image capture and storage element and an image display, i.e. print element, are sequentially exposed and processed to arrive at a viewable positive image. Since the color negative element cascades its color errors forward to the color print element, the cumulative error in the final print is unacceptably large, absent some form of color correction. Even in color reversal materials which employ just one set of image dyes, color correction for the unwanted absorption of the imperfect image dyes is required to produce acceptable image color fidelity for direct viewing.

The complicated processing can be eliminated by substituting direct positive emulsions for the negative-working silver halide emulsions conventionally present in color reversal films. Unfortunately, direct positive emulsions are more difficult to manufacture, exhibit lower levels of sensitivity at comparable granularity, and have unique problems of their own, such as re-reversal, that have almost entirely foreclosed their use as replacements for negative-working emulsions.

Commercial acceptance of color negative elements occurred after commercial introduction of the first color reversal films. The commercial solution to the problem has been to place colored masking couplers in the color negative element. The colored masking couplers lose their color in areas in which grain development occurs, producing a dye image that is a reversal of the unwanted absorption of the image dye. This has the effect of neutralizing unwanted spectral absorption by the image dyes by raising the neutral density of the processed color negative element. However, this is not a practical difficulty, since this is easily offset by increasing exposure levels when exposing the print element through the color negative element.

In this regard, it should be noted that colored masking couplers have no applicability to reversal color elements. They actually increase visually objectionable dye absorption in a color negative film, superimposing an overall salmon colored tone, which can be tolerated only because color negative images are not intended to be viewed. On the other hand, color reversal images are made to be viewed, but not printed. Thus colored masking couplers, if incorporated in reversal films, would be visually objectionable and serve no useful purpose.

Radiation-sensitive silver halide grains possess native sensitivity to the near ultraviolet region of the spectrum, and high bromide silver halide grains possess significant levels of blue sensitivity. Blue recording layer units often rely on the native sensitivity of the high bromide silver halide emulsions they contain for light capture. Blue recording layer units sometimes and green and red recording layer units always employ spectral sensitizing dyes adsorbed to silver halide grain surfaces to absorb light and to transfer exposure energy to the radiation-sensitive silver halide grains. In a simple textbook model the light absorbed in each of the blue, green and red recording layer units is limited to just that one region of the spectrum. For blue, green and red recording layer units light absorption in the blue (400 to 500 nm), green (500 to 600 nm) and red (600 to 700 nm) spectral region, respectively, is sought with no significant absorption in any other region of the visible spectrum.

In practice each spectral sensitizing dye exhibits a peak (occasionally a dual peak) absorption wavelength and absorption declines progressively as exposure wavelengths diverge from the peak. Thus, considerable effort has gone into selecting spectral sensitizing dyes and dye combinations that best serve practical imaging needs, recognizing that uniform absorption over a 100 nm blue, green or red segment of the visible spectrum is impossible to realize, even when dye combinations are employed.

The use of spectrally sensitized tabular grain emulsions in the minus blue recording layer units of color photographic elements has been demonstrated by Kofron et al U.S. Pat. No. 4,439,520 to improve image sharpness and to increase speed in relation to granularity. Kofron et al demonstrates that improvements in performance are realized as the average aspect ratios of the tabular grain emulsions are increased.

Kofron et al further discloses a variety of layer arrangements for color photographic elements having blue, green and red recording layer units, including arrangements containing two or more of each of green and red recording layer units differing in speed. Other illustrations of color photographic elements containing two or more green and/or red recording layer units are provided by *Research Disclosure*, Vol. 389, September 1996, Item 38957, XI. Layers and layer arrangements.

Color correction means, for color negative or color reversal elements, have relied on imagewise interlayer development modification effects during wet chemical processing called interlayer interimage effects. In the case of color negative elements, these effects are most commonly achieved with development inhibitor releasing (DIR) couplers that imagewise release development inhibitors to reduce the extent of development of the receiving silver halide grains, and with colored masking couplers. In the case of color reversal elements, these effects are usually achieved through imagewise interlayer silver halide emulsion development inhibition during the first black-and-white development, and possibly with DIR couplers during the second color development step.

Alternatively, instead of optical print-through exposure to create a color print, the color negative or color reversal element can be scanned to record the blue, green, and red densities in each picture element (pixel) of the exposed area. The color correction that is normally achieved by chemical interlayer interimage effects can be achieved by electronically manipulating stored image information as its image-bearing signal. One example of electronic color correction produced by scanning a processed photographic recording material and manipulating the resultant image-bearing electronic signals to achieve improved color rendition can be found in the KODAK Photo CD™ Imaging Workstation system. In addition, optical printing by passing light through the processed photographic recording material to expose a second light-sensitive material is no longer necessary. The light exposures necessary to write the color-corrected output onto a suitable display material such as silver halide color paper exposed by red, green, and blue light emitting lasers can be calculated and those device-dependent writing instructions can be transmitted to such alternate printers as their code values (specific instructions for producing the correct color hue and image dye amount). Other means of electronic printing include thermal dye transfer material, color electrophotographic media, or a three color cathode ray tube monitor.

It has been found unexpectedly that different or larger color corrections can be managed by electronic color correction than can be achieved through chemical interlayer interimage effects in color negative or color reversal films. This enhanced capability allows the possibility of producing better colorimetric matches between the original scene color content and the rendered image reproduction. In order to accomplish improved color reproduction, more accurate photographic recording material spectral sensitivity is required. In particular, the spectral sensitivity of a film optimally designed for scanning and electronic color correction must more closely approach that of the human visual system. To accurately record colors the way the human eye perceives them, a recording element must have spectral sensitivities that are linear transformations of the blue, green, and red cone responses of the human eye. Such linear transformations are known as color matching functions. Color matching functions for any set of real primary stimuli must have negative portions. Within the realm of known photographic mechanisms, it is not possible to produce a photographic element having spectral sensitivities whose response is negative.

Examples of spectral sensitivities that approximate color matching functions are those of MacAdam (Pearson and Yule, *J. Color Appearance*, 2, 30 (1973). Giorgianni et al, U.S. Pat. No. 5,582,961 and U.S. Pat. No. 5,609,978, the disclosures of which are herein incorporated by reference, describe related spectral sensitivities applied to non-tabular emulsions in color reversal film elements capable of forming image representations that correspond more closely to the colorimetric values of the original scene upon scanning and electronic conversion. A characteristic of these color matching functions is a broad response for the green recording layer unit that has significant sensitivity at wavelengths between about 470 nm and 600 nm. This type of response function closely resembles the green response of the human eye and visual system.

The green sensitivity of a multilayer film element is determined by the light absorption profile of the silver halide emulsions in the green sensitive layer unit attenuated by any light absorbing materials that lie above it in the top layers of the film, such as ultraviolet filter dyes, Lippmann emulsions, yellow filter layers, the blue sensitive emulsions, the yellow and magenta colored masking couplers in color negative films, and the optical properties of the red sensitive emulsions underneath the green record. The light absorption of the emulsions used in the green sensitive layer unit is in turn determined by the composite absorption of the specific combination of spectral sensitizing dyes adsorbed to the surface of the silver halide crystals, since silver halide emulsions only have native (intrinsic) sensitivity to blue light. Green sensitive emulsions used in the green recording layer unit that are commonly found in the art are observed to employ two or three green sensitizing dyes, and they typically peak in dyed absorptance from about 530 nm to about 560 nm. Broad light absorptance to produce color reproduction accuracy in accord with human visual sensitivity was not sought.

Yamada et al in U.S. Pat. No. 5,376,508 employs a blend of two spectral sensitizing dyes to achieve a broad 80% absorption bandwidth, but with inadequate absorption in the short green region. Ikegawa et al in DE 3,740,340 A1 provides an example of a short green dye used alone which does not J-aggregate, which provides high absorption bandwidth and good absorption in the short green region, but very little sensitivity in the long green region, around 550nm and 560 nm. Another combination of two green dyes demonstrated in '340 also lacks sufficient absorption in the short green region. U.S. Pat. No. 5,460,928 Kam-Ng et al use a two dye combination for the green record, which again does not provide adequate short green absorption, and also provides inadequate half-peak bandwidth. Shiba et al in U.S. Pat. No. 5,037,728 demonstrate a three spectral sensitizing dyes with silver iodobromide emulsions with inadequate breadth at 80% of peak absorption and insufficient absorption at 520 nm. Sasaki in U.S. Pat. No. 5,053,324 demonstrates a short green spectral sensitizing dye combined with a long green spectral sensitizing dye which provides high absorption in the short green region and sufficient half-peak bandwidth, but a narrow breadth at 80% of peak absorption. Nozawa in U.S. Pat. No. 5,166,042 also presents three spectral sensitizing dye combinations which include a short green dye. Nozawa provides adequate sensitivity in the short green region, but narrow breadth at 80% of peak absorption and indequate sensitivity in the long green region at 550 nm. Sasaki et al in U.S. Pat. No. 5,077,182 again demonstrate two and three spectral sensitizing dye combinations which include a short green dye, providing broad half-peak bandwidth and adequate short green sensitivity, but low sensitivity in the long green 550 nm region. In U.S. Pat. No. 5,169,746 of Sasaki a three dye combination including a short green sensitizing dye is presented which provides good absorption in the long green region, but falls far short of the breadth required at 50% and 80% of peak absorption. Other three dye combinations presented lack the short green dye and these fail for short green absorption at 520 nm, as well as for breadth at 50% and 80% of peak absorption.

Ohashi et al in U.S. Pat. No. 4,599,301 use a two spectral sensitizing dye combination which provides high absorption breadth at 50% and 80% of peak absorption, but the maximum absorption of the emulsion falls at 564 nm, and the combination provides inadequate absorption in the short green region at 520 nm. Ezaki et al in U.S. Pat. No. 5,258,273 reveal the use of four spectral sensitizing dyes in combination; but the maximum absorption falls at 564 nm, with a half-peak bandwidth absorption of only 45 nm, and inadequate absorption in the short green region at 520 nm was achieved. Shimazaki et al in U.S. Pat. No. 5,206,124 and U.S. Pat. No. 5,206,126 use three dye combinations for the green record; and all provide a narrow half-peak bandwidth absorption and inadequate absorption in the short green region. U.S. Pat. No. 5,308,748 of Ikegawa et al provide examples of two, three, and four spectral sensitizing dye combinations. The two dye combinations are quite narrow for half-peak bandwidth. One three dye combination provides no significant absorption at 520 nm; the other three dye combination achieves adequate absorption at 520 nm, but a maximum absorption at 562 nm. The four dye combination is very narrow for half-peak bandwidth, provides inadequate absorption at 520 nm, and has a maximum absorption at 574 nm. Siegel et al in European Patent Application EP 0 866 368 A2 use up to three spectral sensitizing dyes concurrently with a silver iodobromide emulsion to achieve significant breadth in sensitivity at both 80% and 50% of the peak green sensitivity. However, no short green spectral sensitizing dye was used, and high sensitivity in the short green region is not achieved.

Schwan et al in U.S. Pat. No. 3,672,898 seek to produce multicolor photographic elements with acceptable neutrals and good color rendition under a variety of illuminants. However, Schwan et al specifically contemplate the use of a magenta-colored filter material which is used to trim green light from the red record. Giorgianni et al in U.S. Pat. No. 5,582,961 demonstrate a conventional, low aspect ratio silver iodobromide emulsion with three spectral sensitizing dyes; the inventive example provide inadequate breadth at both 50% and 80% of peak absorption and inadequate absorption at 520 nm. The comparative example which uses two dyes provides adequate half-peak bandwidth and absorption at 520 nm, but provides too narrow an absorption profile at 80% of peak absorption. Their goal of significantly broad green sensitivity which mimics the human visual system for improved color capture accuracy and reduced mixed illuminant sensitivity was not satisfied.

PROBLEM TO BE SOLVED BY THE INVENTION

In order to achieve accurate color reproduction, the photographic element green sensitivity must meet certain requirements provided by dyed silver halide emulsions. The emulsions' material properties include the correct wavelength of maximum spectral absorptance and the requisite bandwidth of continuous absorption to confer the correct spectral responsivity to high-latitude photographic recording materials. The need for broad, and efficient, green spectral sensitizations of silver halide emulsions remains unsatisfied.

SUMMARY OF THE INVENTION

In one aspect, this invention is directed to a photographic element for accurately recording a scene as an image comprising a support and coated on the support a plurality of hydrophilic colloid layers comprising radiation-sensitive silver halide emulsion layers forming recording layer units for separately recording blue, green and red exposures wherein, the green recording layer unit comprises at least one green sensitive emulsion having a peak dyed absorptance of between 520 and 560 nm, an absorption bandwidth at 50% of the peak dyed absorptance greater than or equal to 50 nm, an absorption bandwidth at 80% of the peak dyed absorptance greater than or equal to 27 nm, a ratio of the absorptance at 560 nm to the peak dyed absorptance greater than or equal to 0.40, a ratio of the absorptance at 550 nm to the peak dyed absorptance greater than or equal to 0.60, and a ratio of the absorptance at 520 nm to the peak dyed absorptance greater than or equal to 0.55.

In another embodiment, the invention is directed to a photographic element for accurately recording a scene as an image comprising a support and coated on the support a plurality of hydrophilic colloid layers comprising radiation-sensitive silver halide emulsion layers forming recording layer units for separately recording blue, green and red exposures wherein, the green recording layer unit comprises at least one green sensitive emulsion having a peak dyed absorptance of between 520 and 560 nm, an absorption bandwidth at 50% of the peak dyed absorptance greater than or equal to 50 nm, an absorption bandwidth at 80% of the peak dyed absorptance greater than or equal to 27 nm, a ratio of the absorptance at 560 nm to the peak dyed absorptance greater than or equal to 0.40, a ratio of the absorptance at 550 nm to the peak dyed absorptance greater than or equal to 0.60, and a ratio of the absorptance at 520 nm to the peak dyed absorptance greater than or equal to 0.55, and the green sensitive emulsion has been dyed with at least one dye that forms a J-aggregate between 500 and 540 nm.

In certain embodiments of the invention, the photographic element is suited for use in accurately recording a scene as an image that is suitable for conversion to an electronic form by scanning.

In other embodiments of the invention, the photographic element is a color negative or color reversal photographic recording material. Preferably color negative photographic elements in accordance with this invention are substantially free of masking couplers.

In a preferred embodiment of the invention, the photographic element is capable of producing images suitable for electronic scanning wherein: said layer units for separately recording blue, green and red exposures comprise:

- a blue recording emulsion layer unit containing at least one dye-forming coupler capable of forming a first image dye;
- a green recording emulsion layer unit containing at least one dye-forming coupler capable of forming a second image dye; and,
- a red recording emulsion layer unit containing at least one dye-forming coupler capable of forming a third image dye;

wherein said first, second, and third dye image-forming couplers are chosen such that the absorption half peak bandwidths of said image dyes are substantially non-coextensive.

Yet another aspect of the invention comprises a photographic element for accurately recording a scene as an image comprising a support and coated on the support a plurality of hydrophilic colloid layers comprising radiation-sensitive silver halide emulsion layers forming recording layer units for separately recording blue, green and red exposures wherein, the green recording layer unit has:

(i) a wavelength of maximum sensitivity of between 520 and 560 nm, (ii) a relative sensitivity at 50% of the maximum sensitivity exhibits an over all breadth of at least about 50 nm, (iii) a relative sensitivity at 80% of the maximum sensitivity exhibits an over all breadth of at least about 27 nm, (iv) a relative sensitivity at 560 nm is at least about 0.40, (v) a relative sensitivity at 550 nm of at least about 0.60, and (vi) a relative sensitivity at 520 nm of at least about 0.55.

ADVANTAGEOUS EFFECT OF THE INVENTION

When photographic recording materials according to the invention are prepared, a broad green spectral sensitivity results with significant sensitivity at 520, 550, and 560 nm. A broad green spectral sensitivity enables a more accurate capture of colors in a scene, such that the photographic element incorporating the broad green sensitization can better distinguish the various shades of green, such as blue-green, turquoise, jade, emerald green, and yellow green. These colors are difficult to reproduce and differentiate with current films employing a narrower green sensitivity and chemical interimage correction. Preferred embodiments of the invention combined with a hybrid photographic-electronic imaging system can achieve very low color recording errors that would be very difficult to achieve with conventional film designs.

DETAILED DESCRIPTION OF THE INVENTION

Figure 1A:
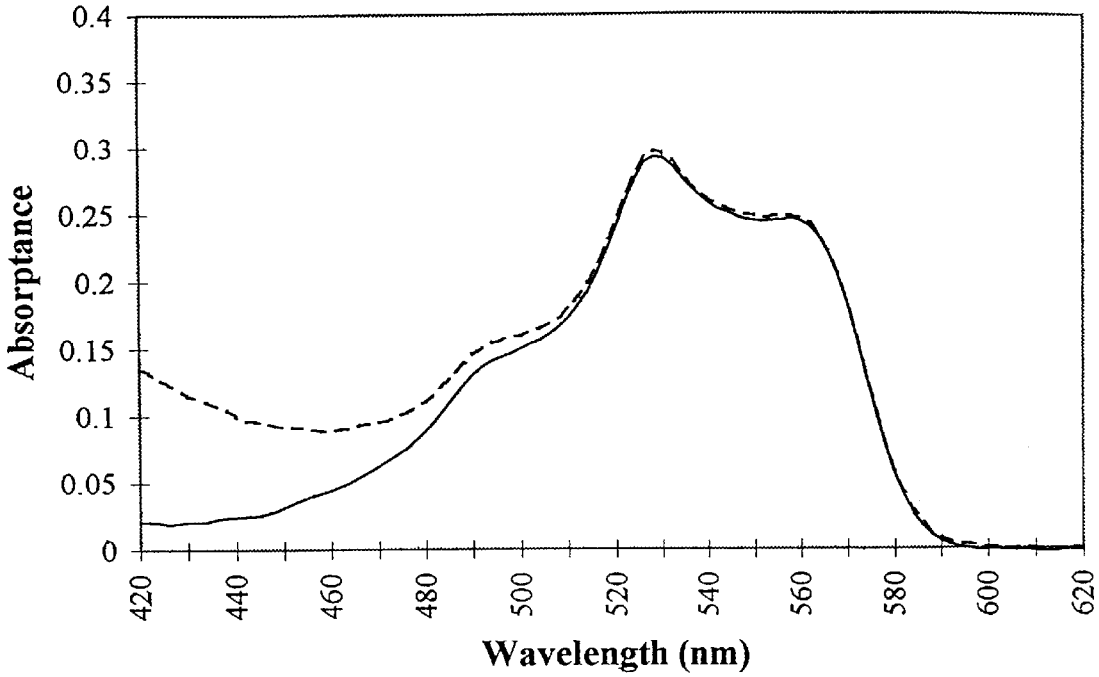
FIGS. 1A through 2R are absorption spectra of sample materials as described in Example I below.
Figure 1B:
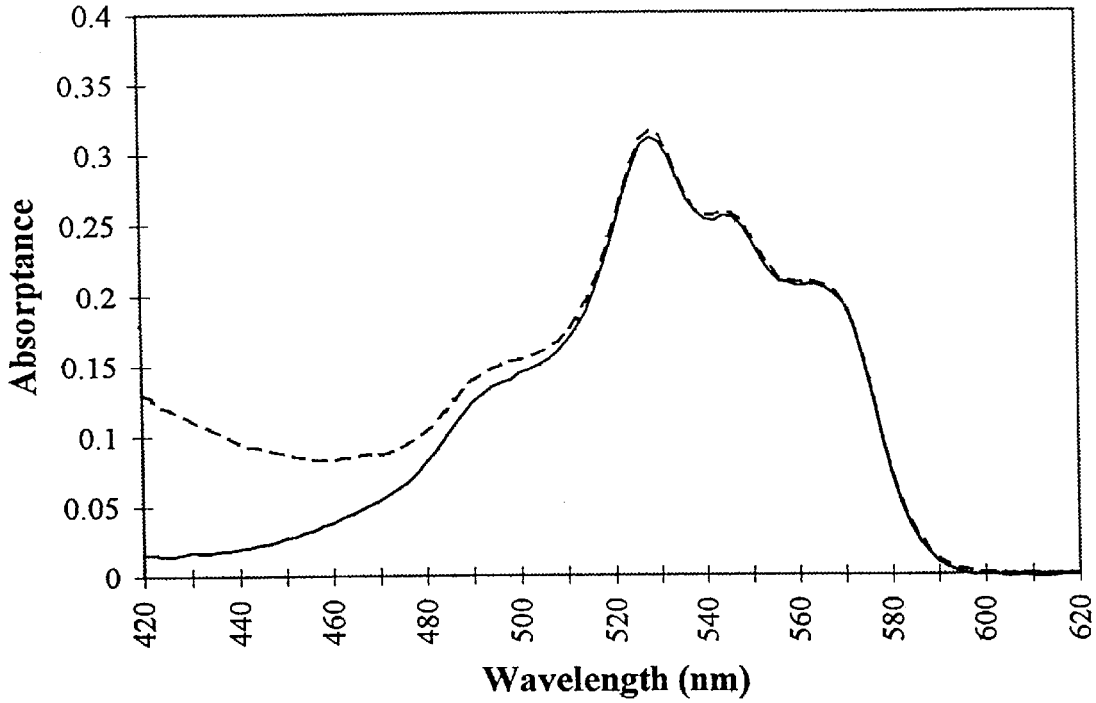
Figure 1C:
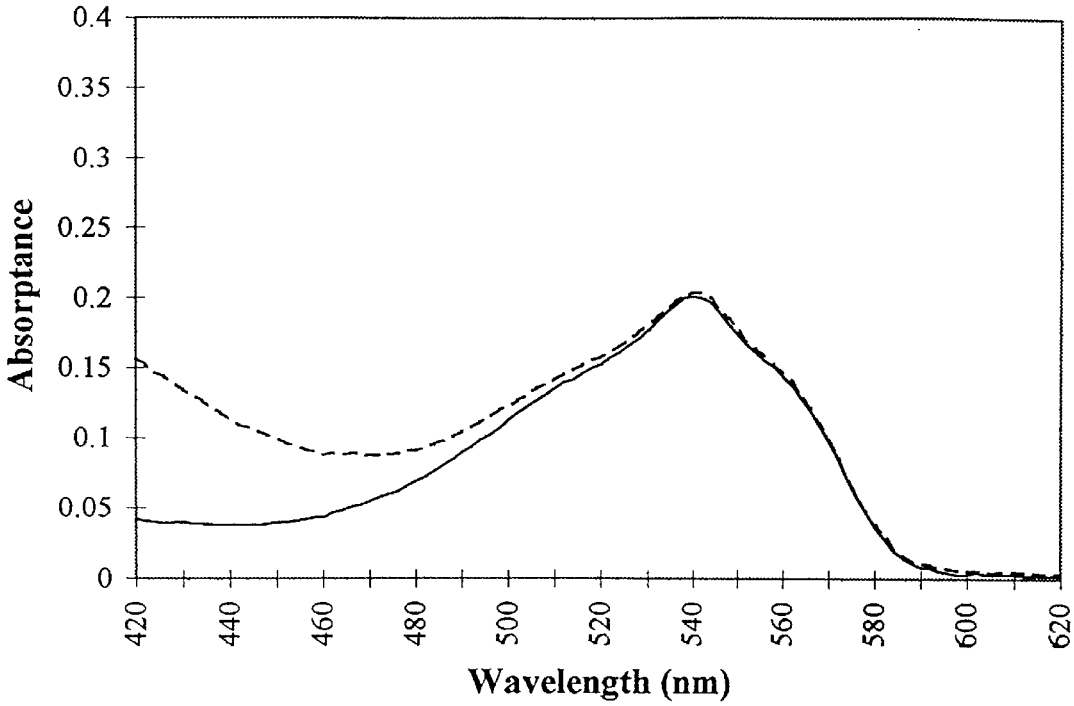
Figure 1D:
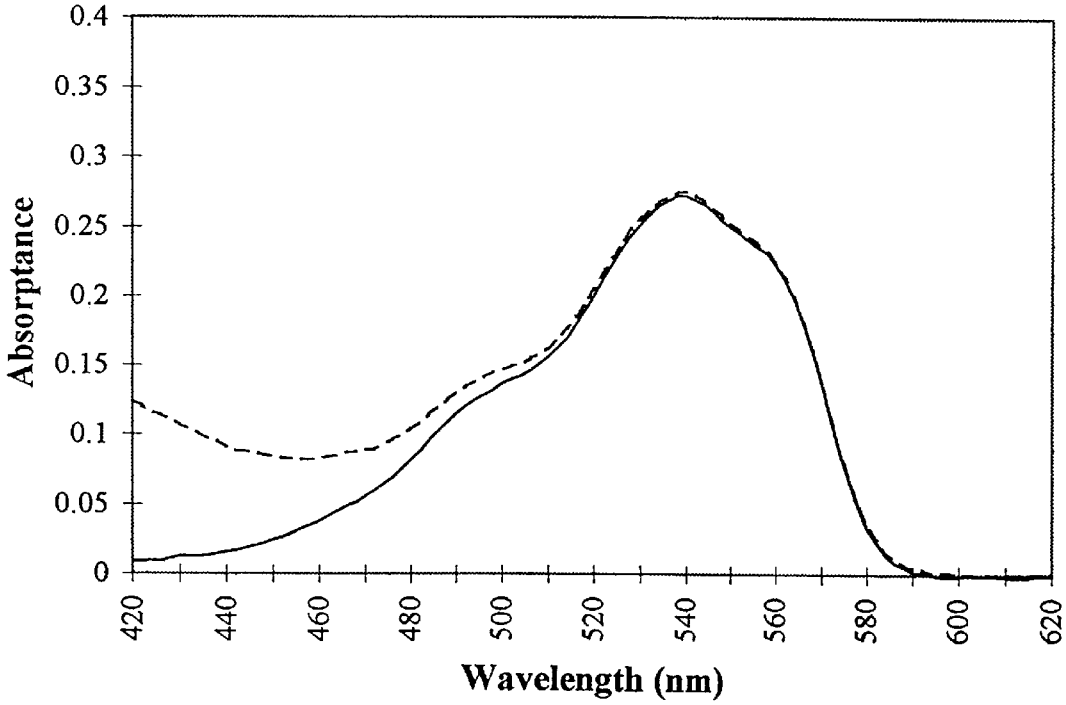
Figure 1E:
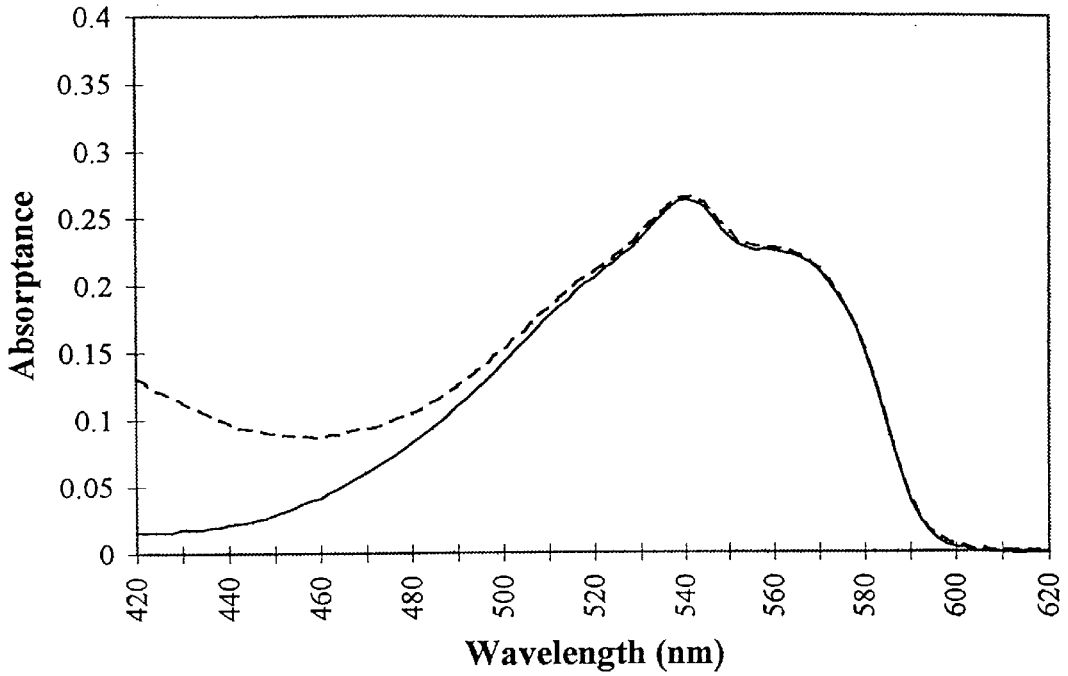
Figure 1F:
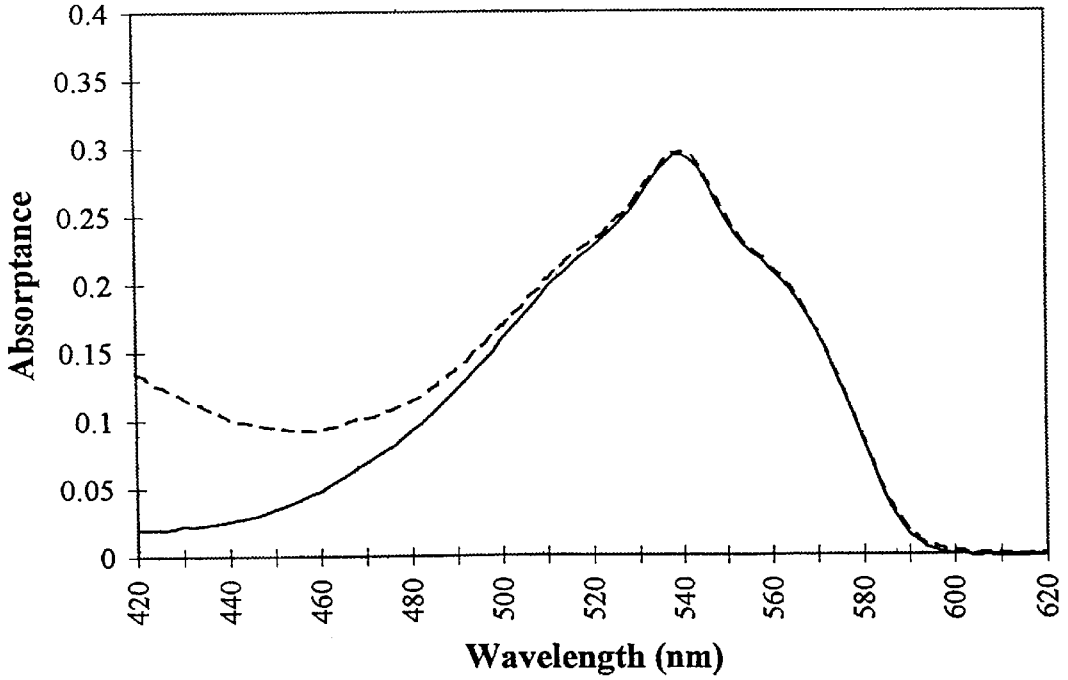
Figure 1G:
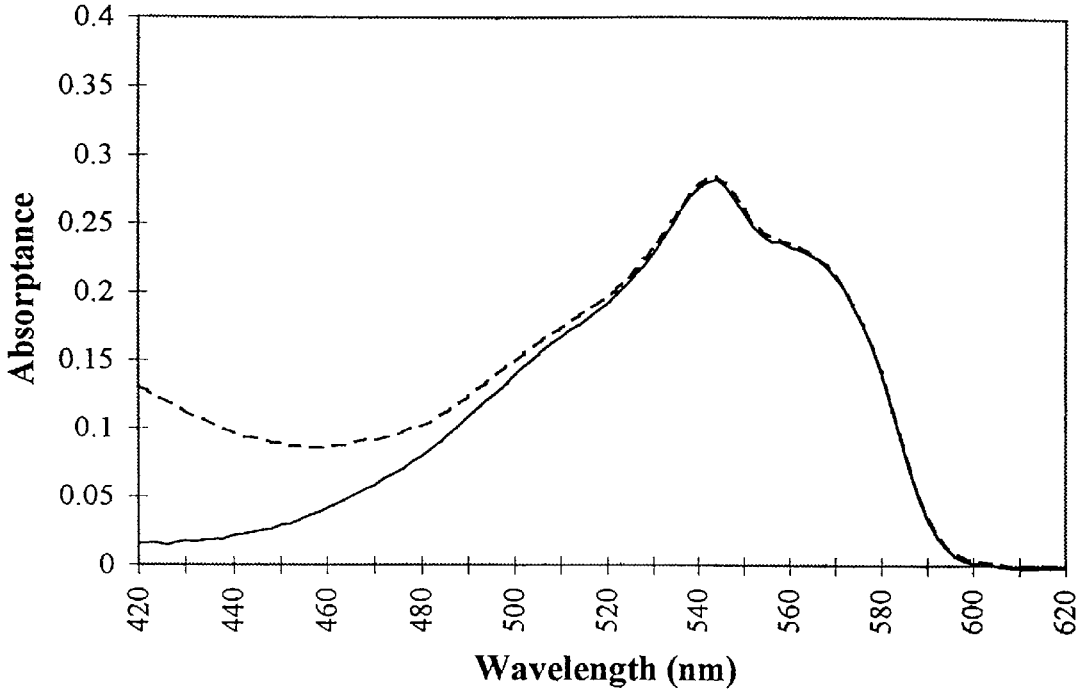
Figure 1H:
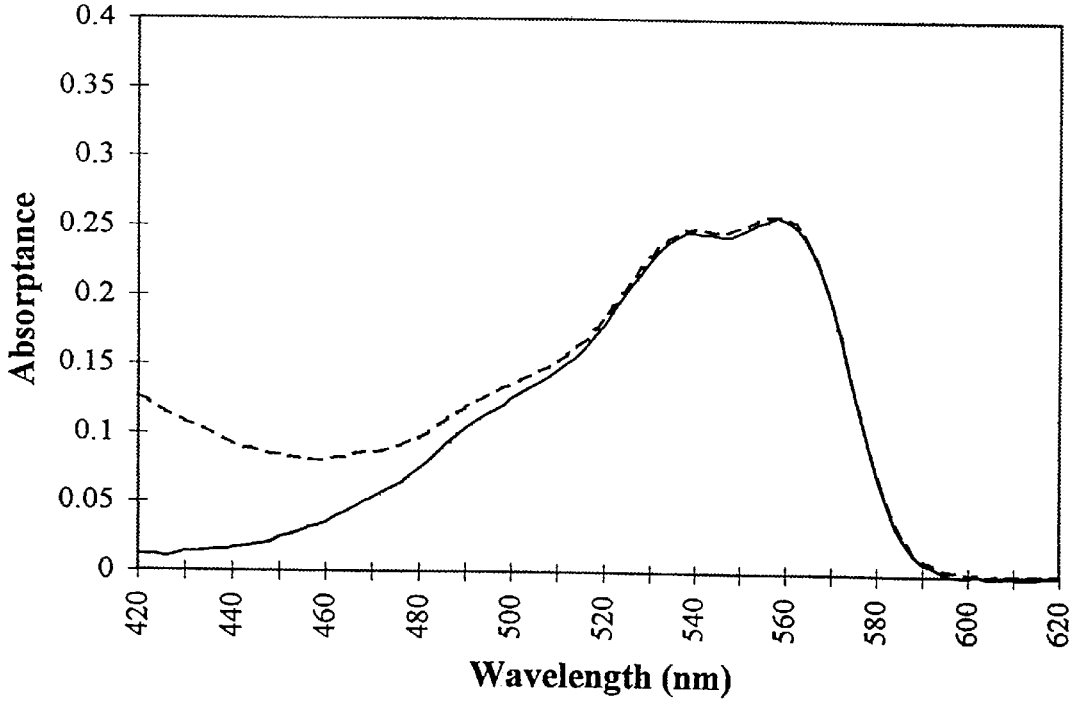
Figure 1I:
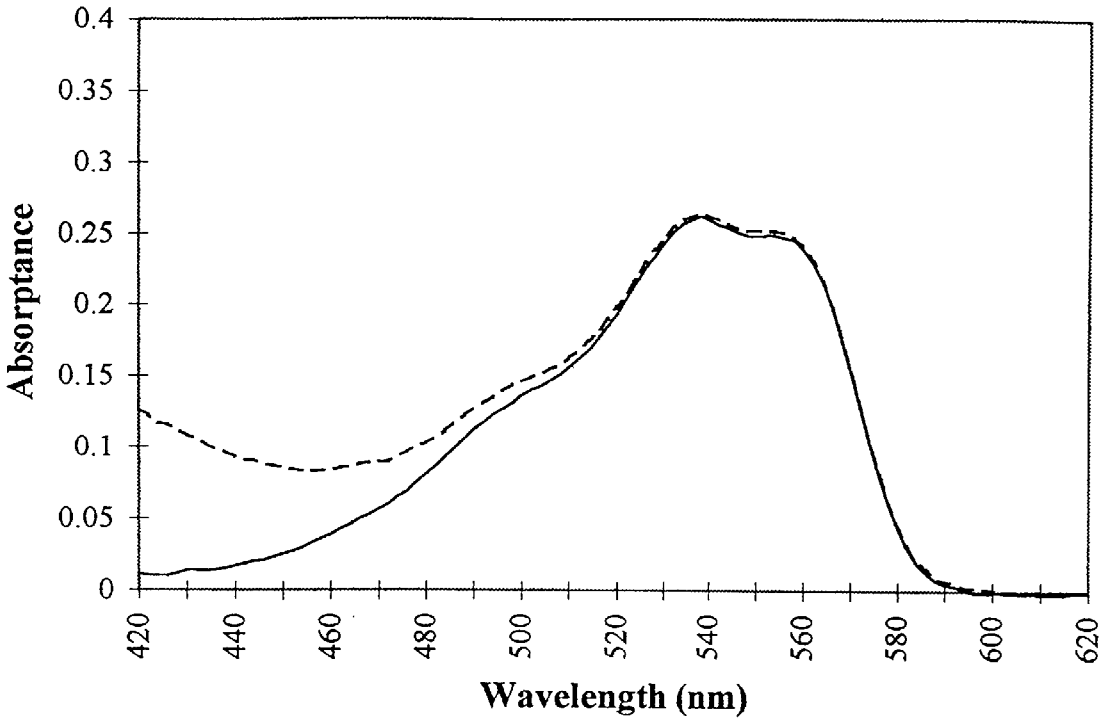
Figure 1J:
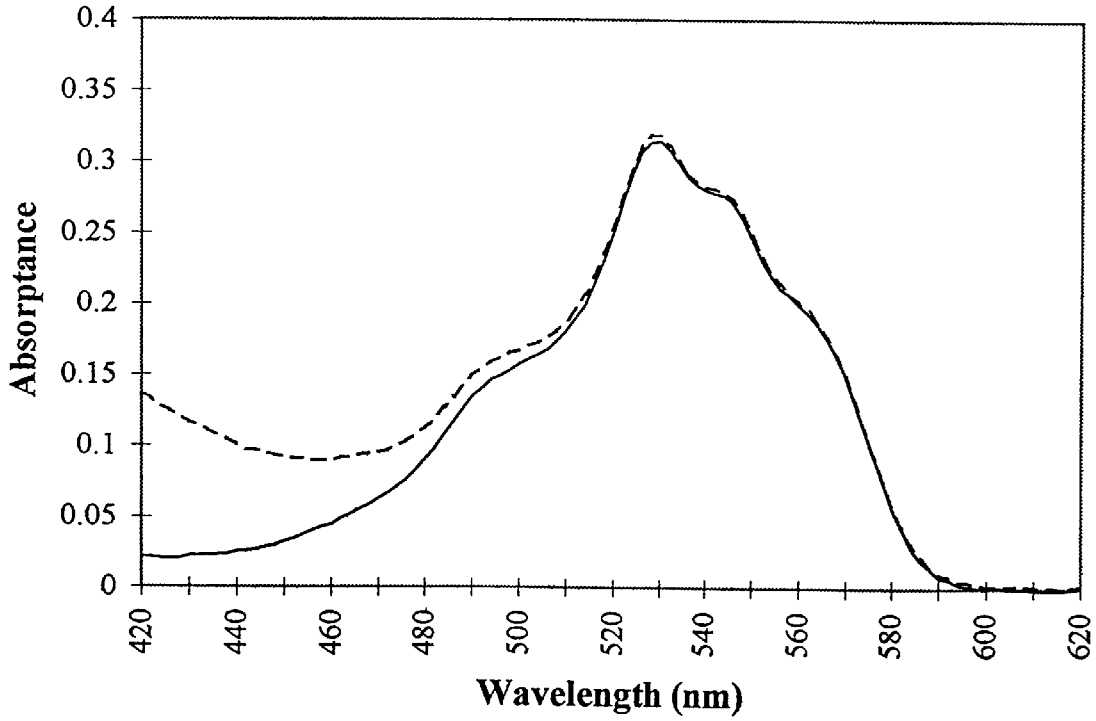
Figure 1K:
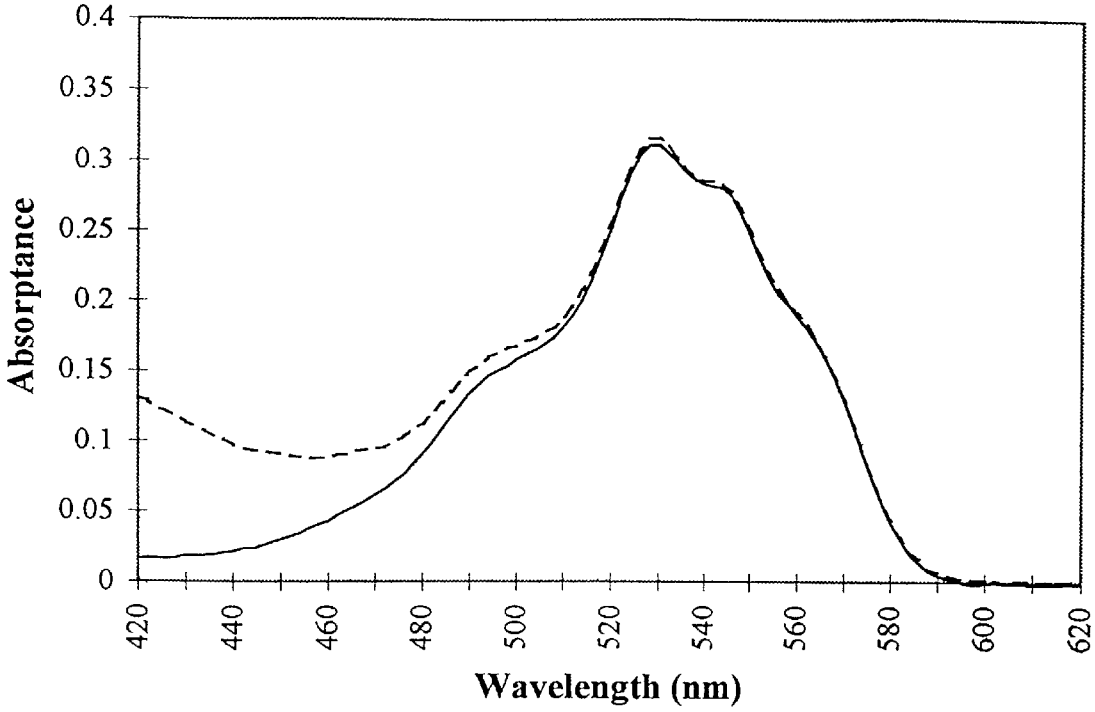
Figure 1L:
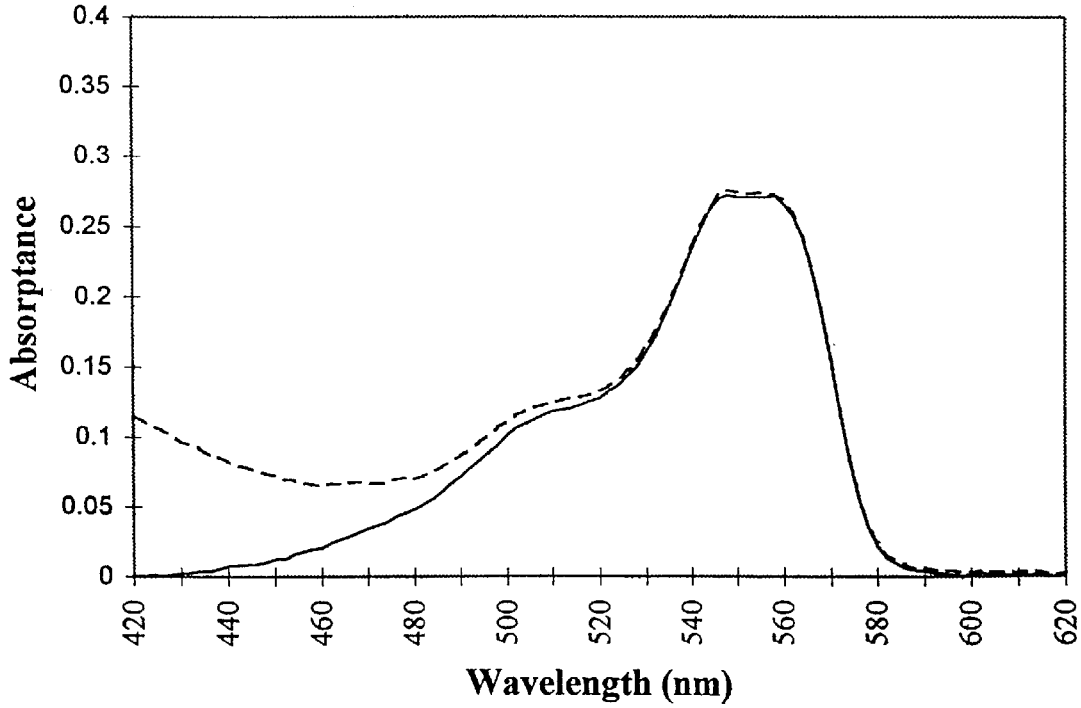
Figure 1M:
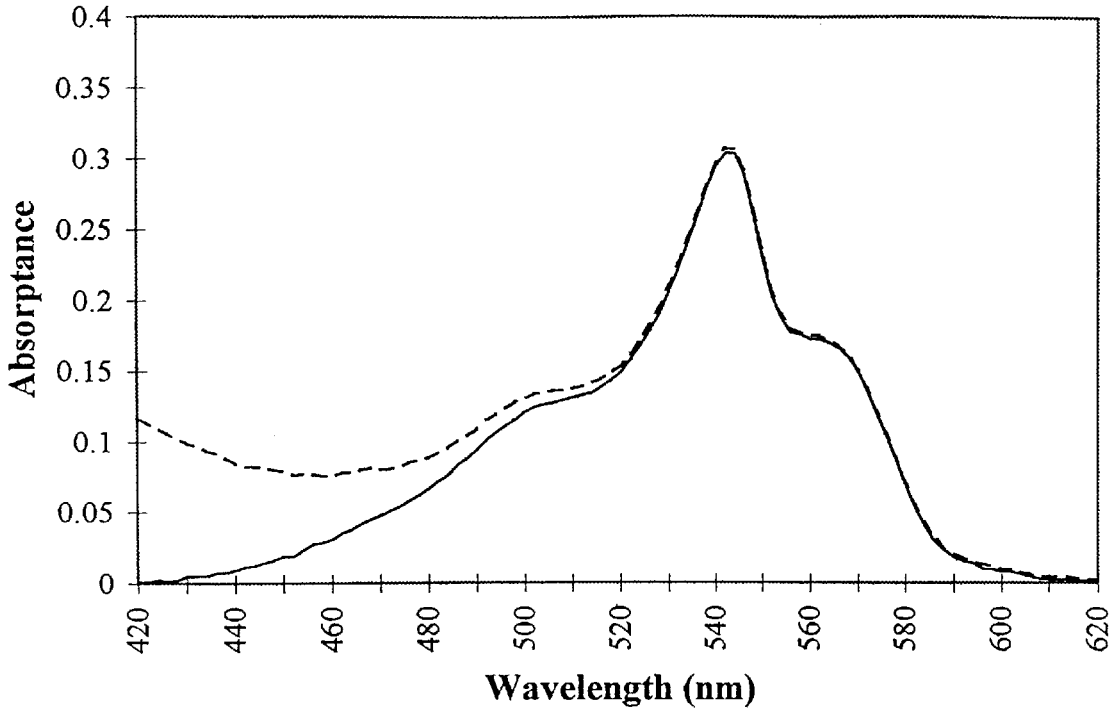
Figure 1N:
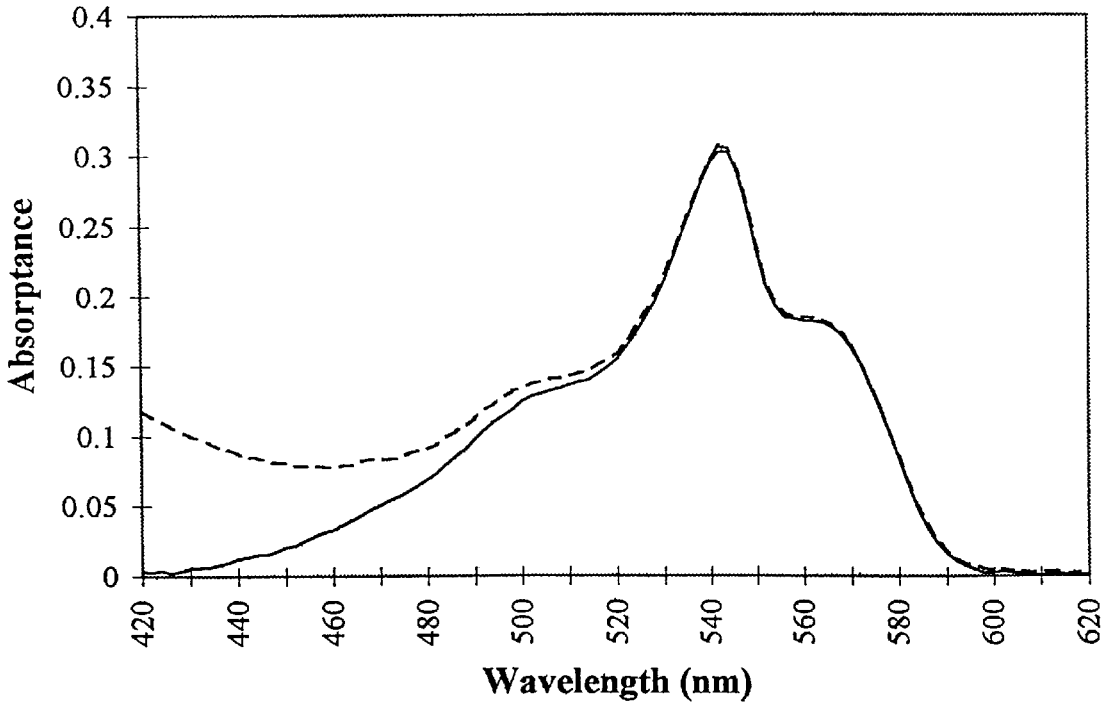
Figure 1O:
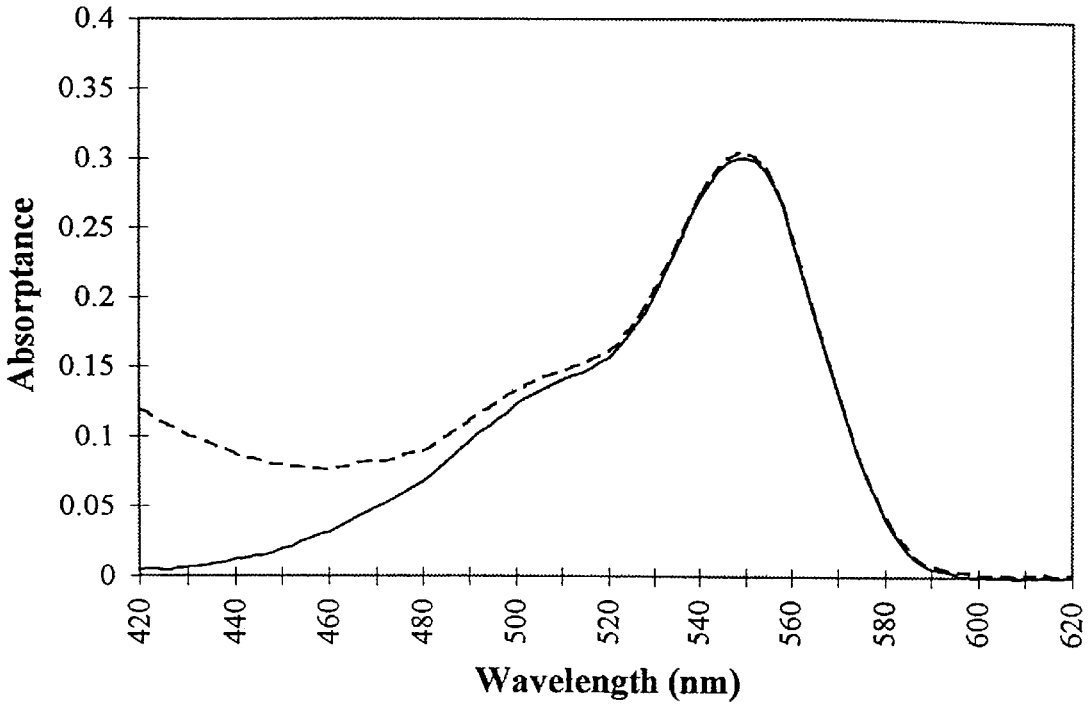
Figure 1P:
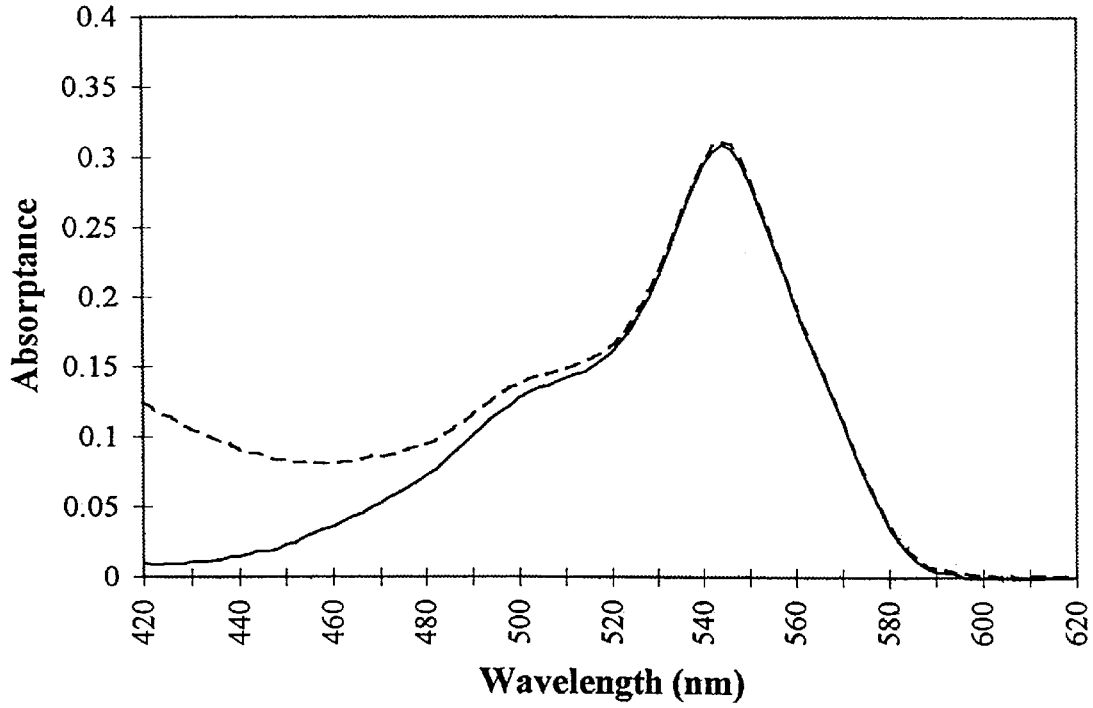
Figure 1Q:
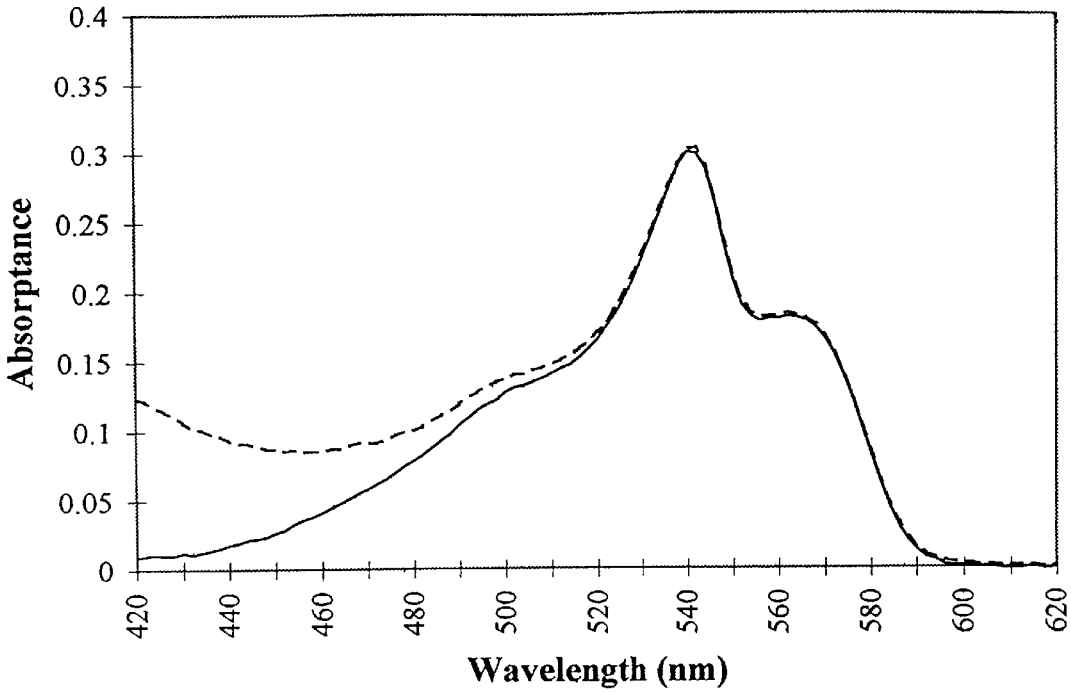
Figure 1R:
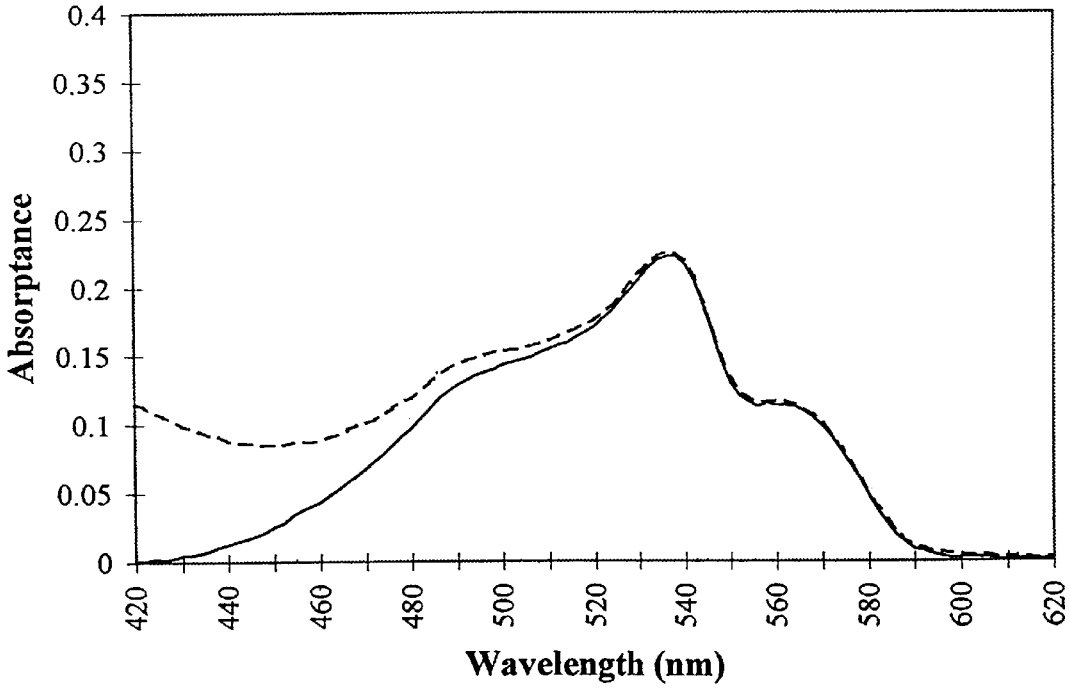
Figure 1S:
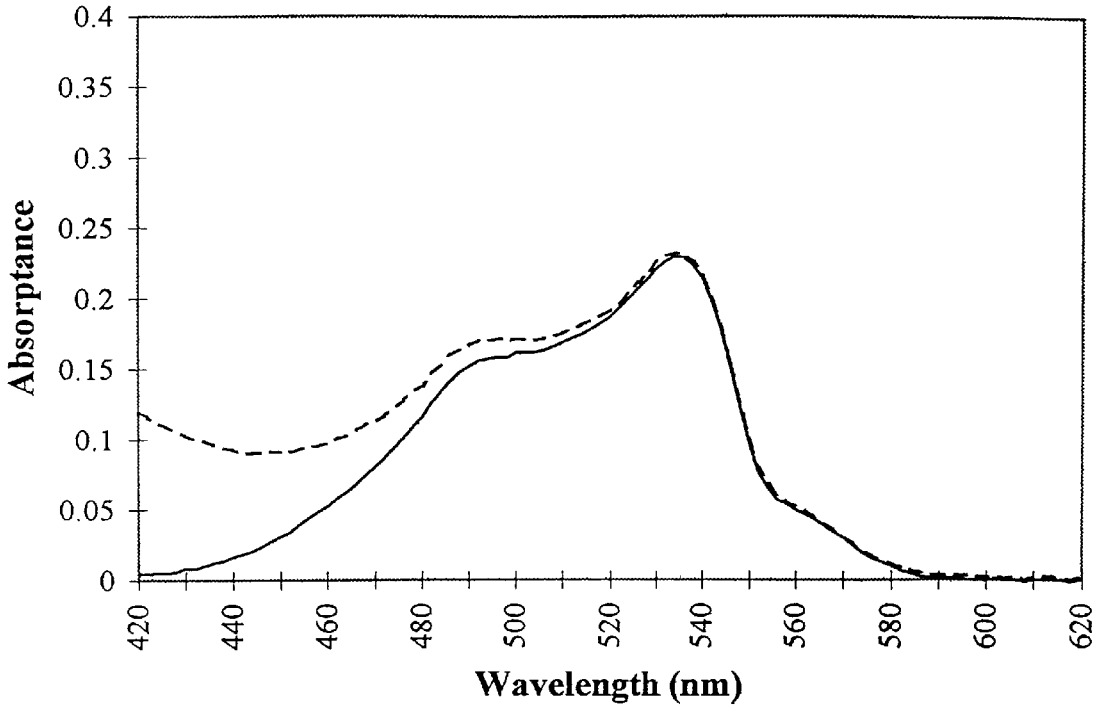
Figure 1T:
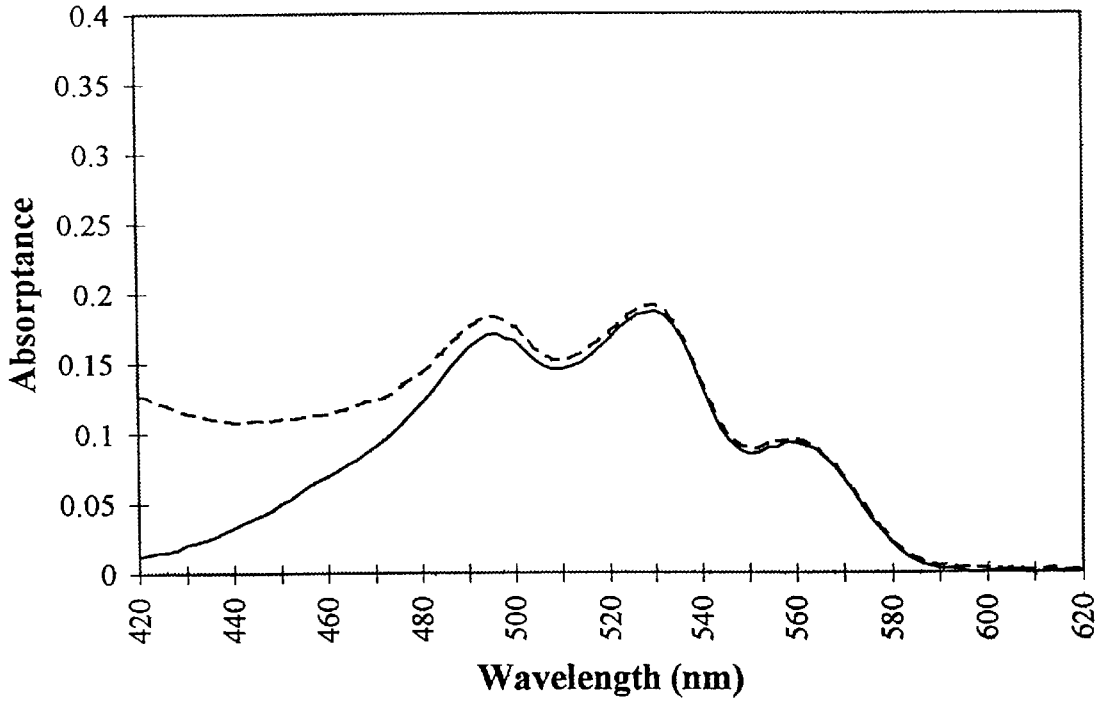
Figure 1U:
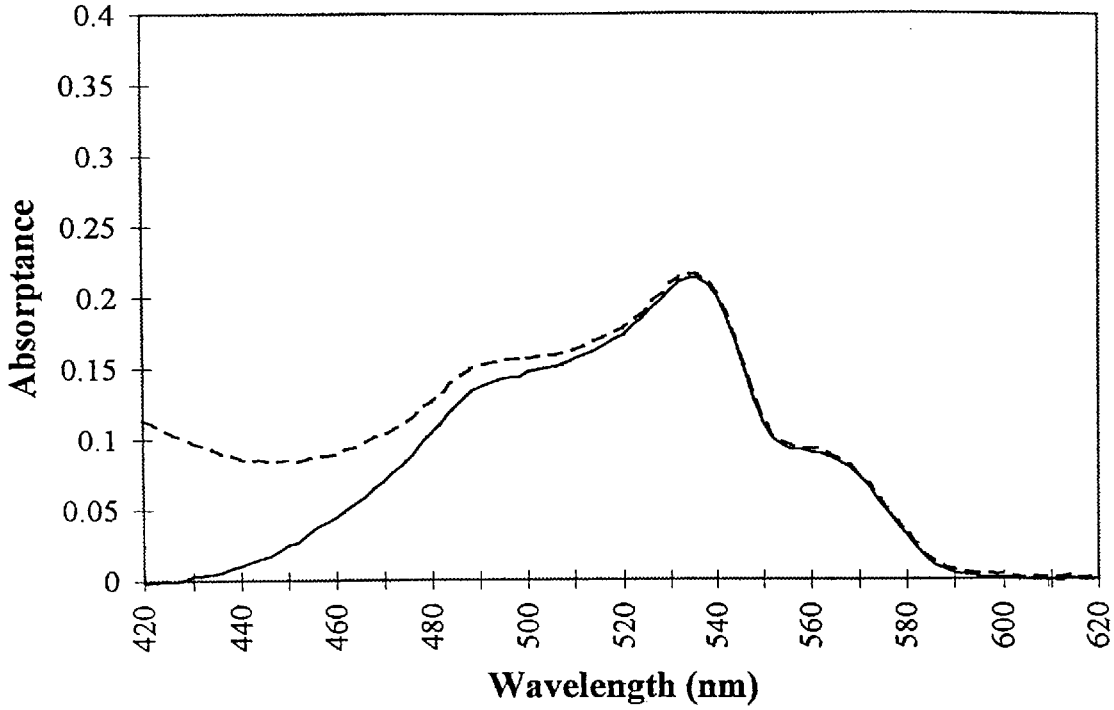
Figure 1V:
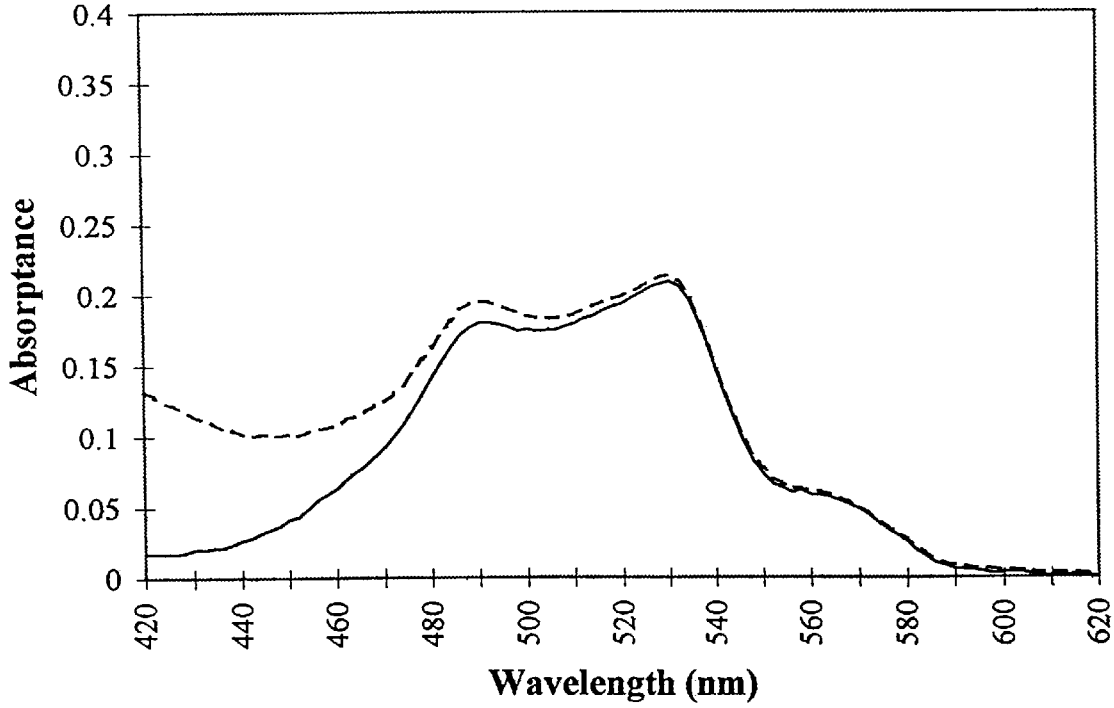
Figure 1W:
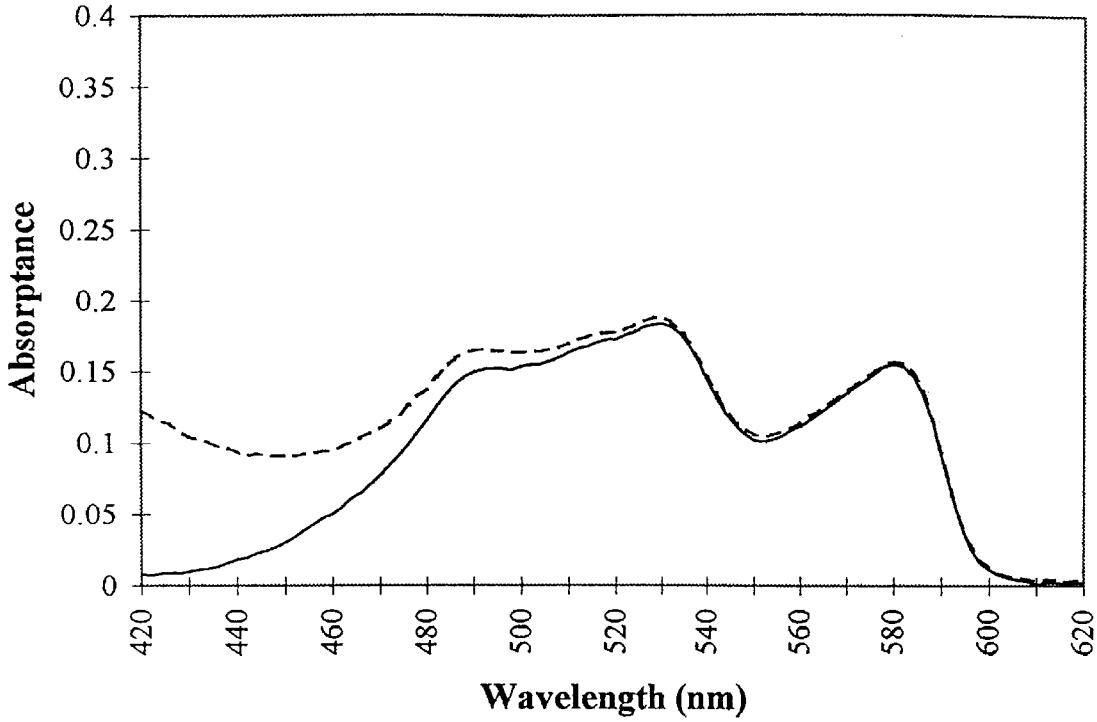
Figure 1X:
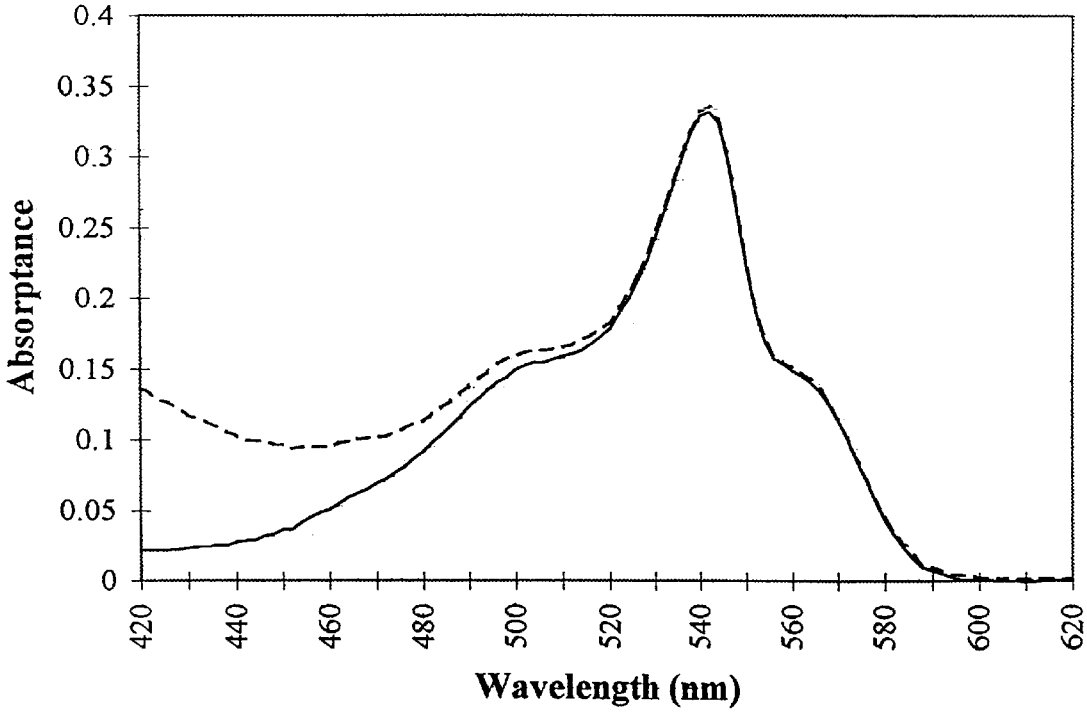
Figure 1Y:
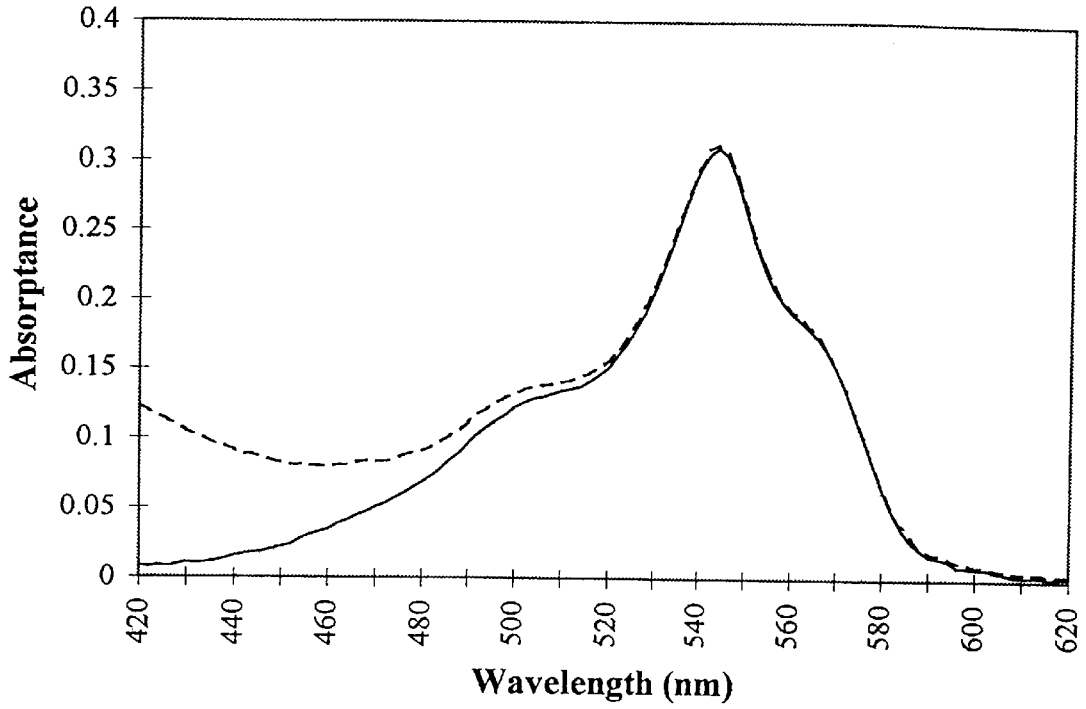
Figure 1Z:
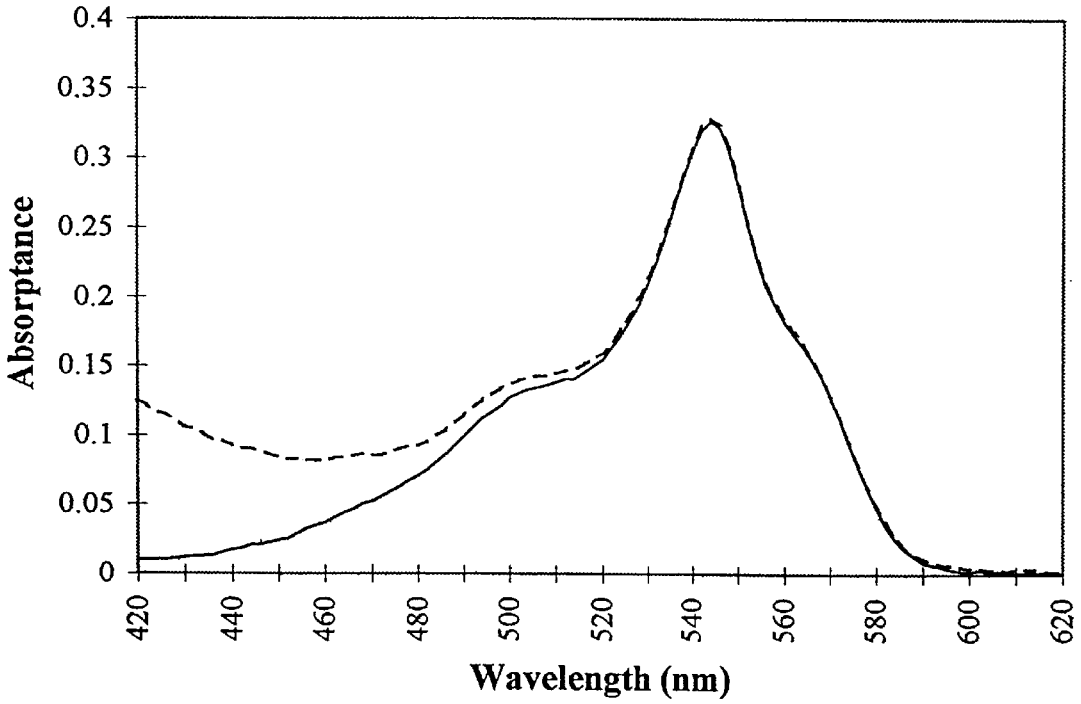
Figure 2A:
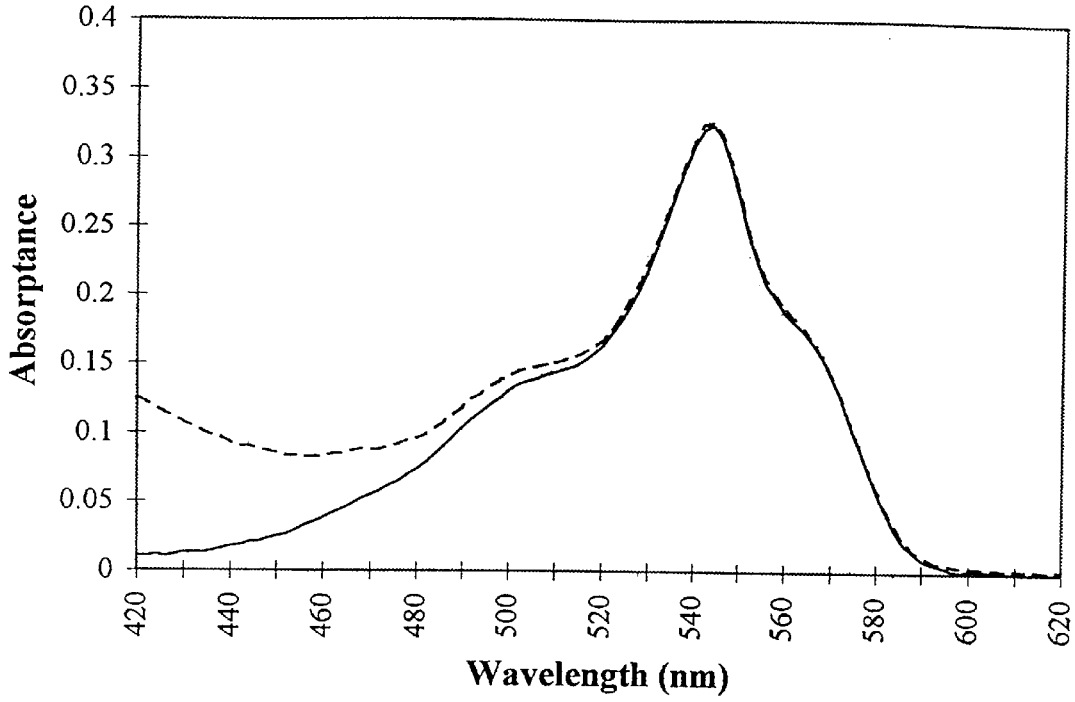
Figure 2B:
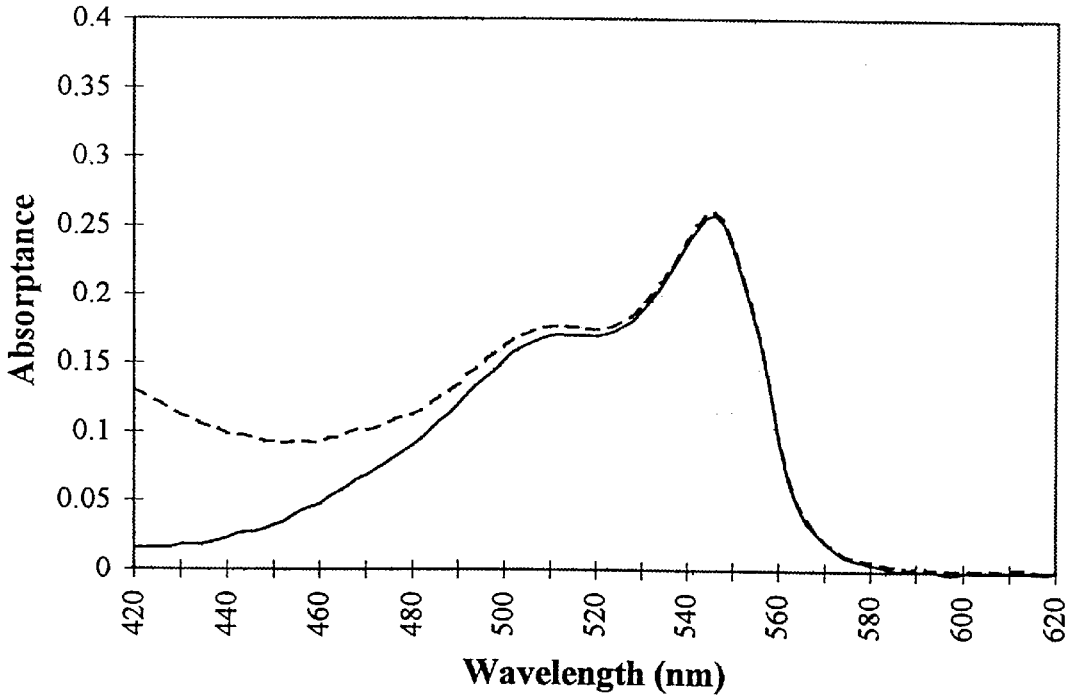
Figure 2C:
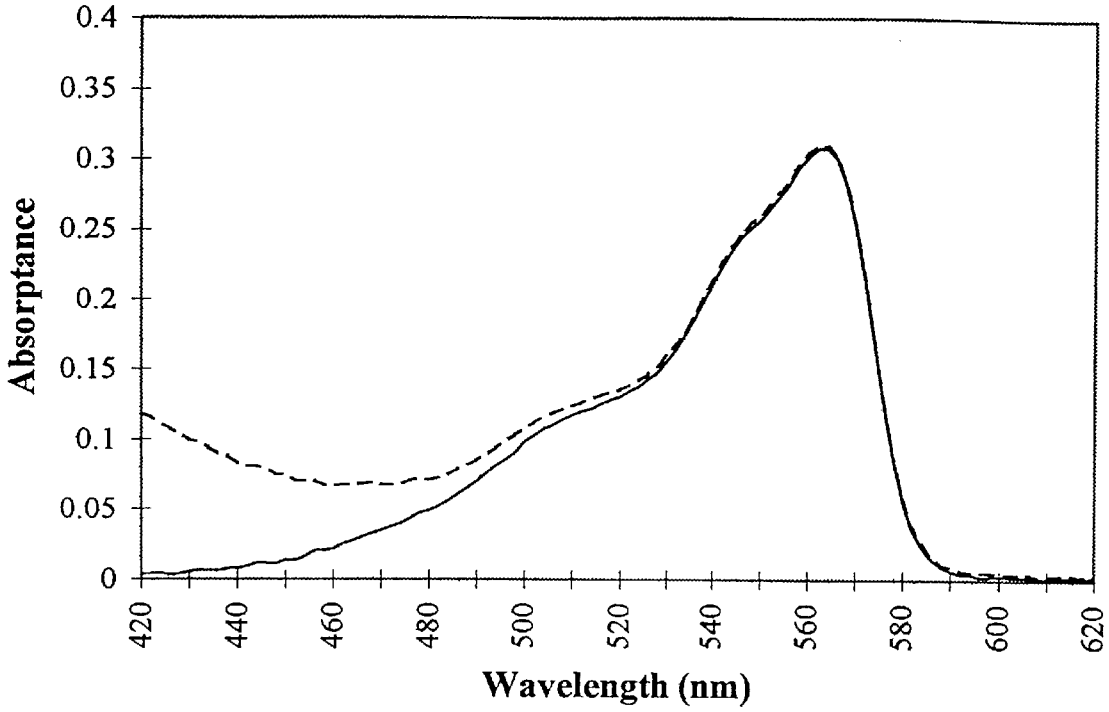
Figure 2D:
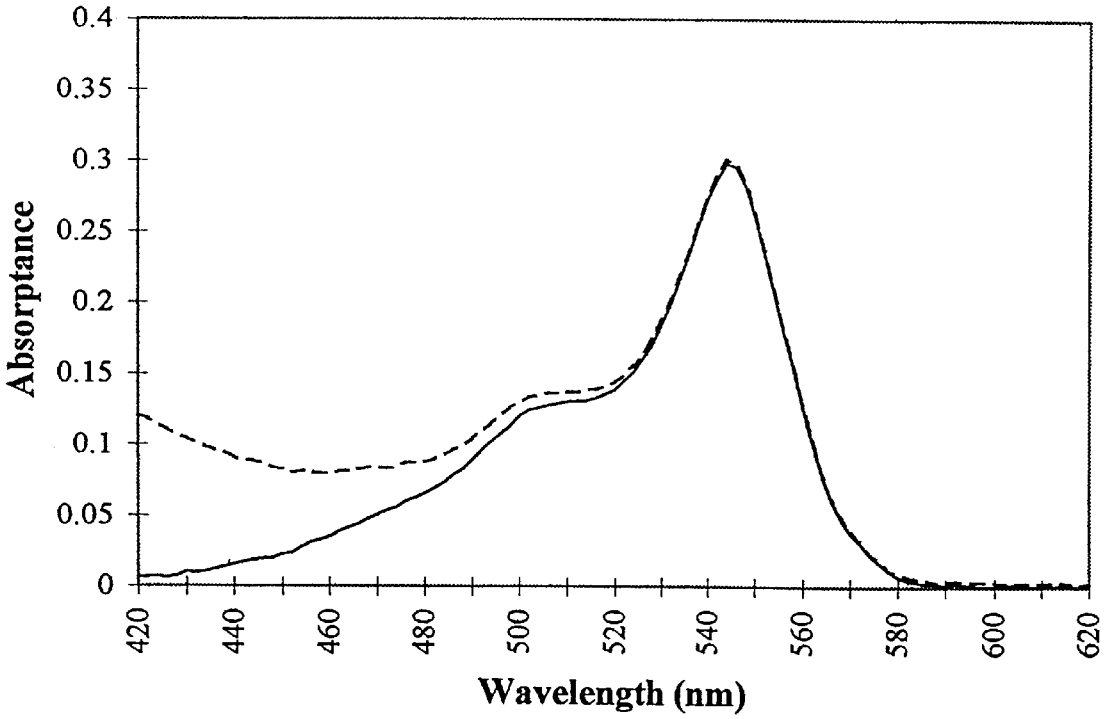
Figure 2E:
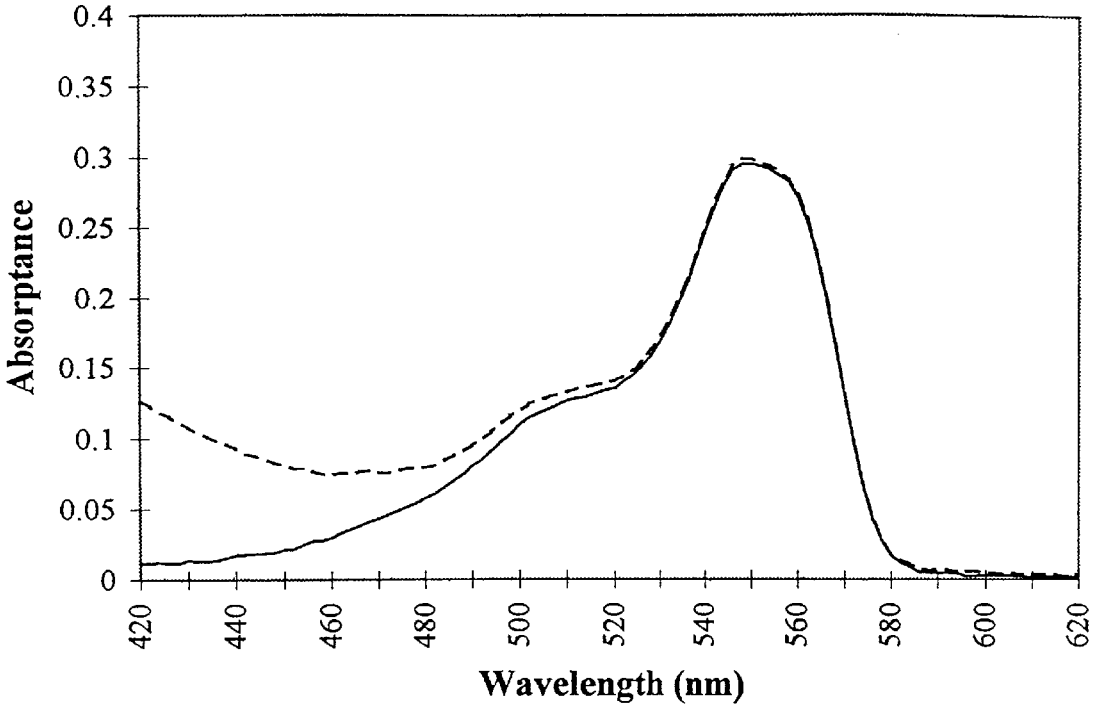
Figure 2F:
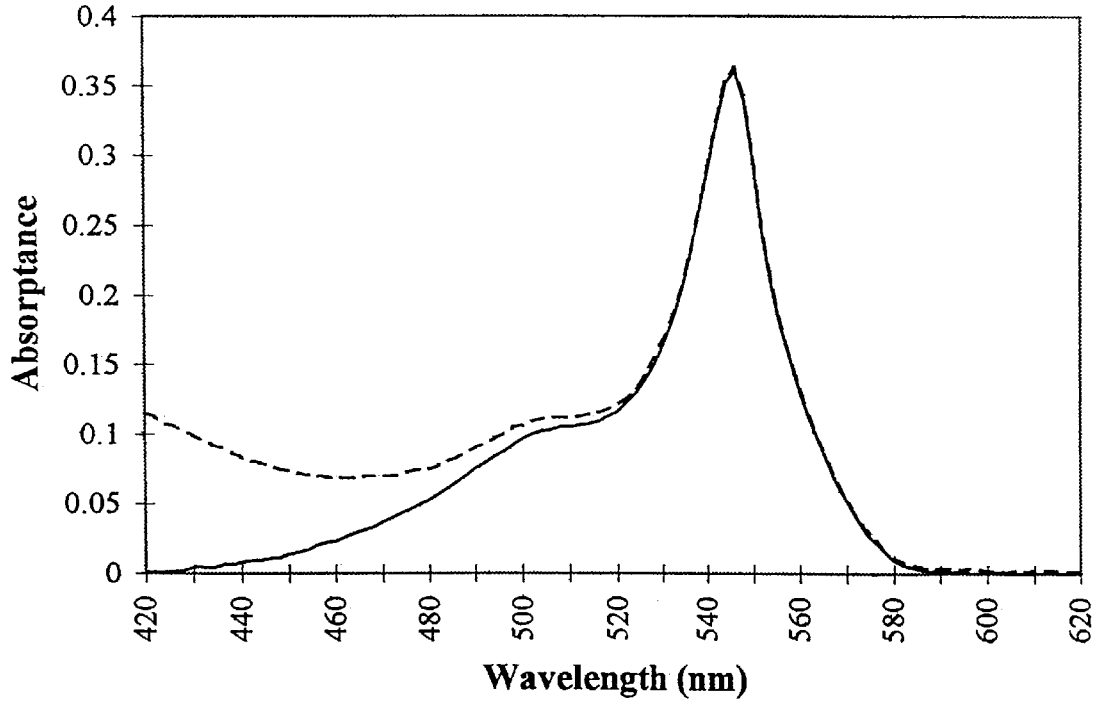
Figure 2G:
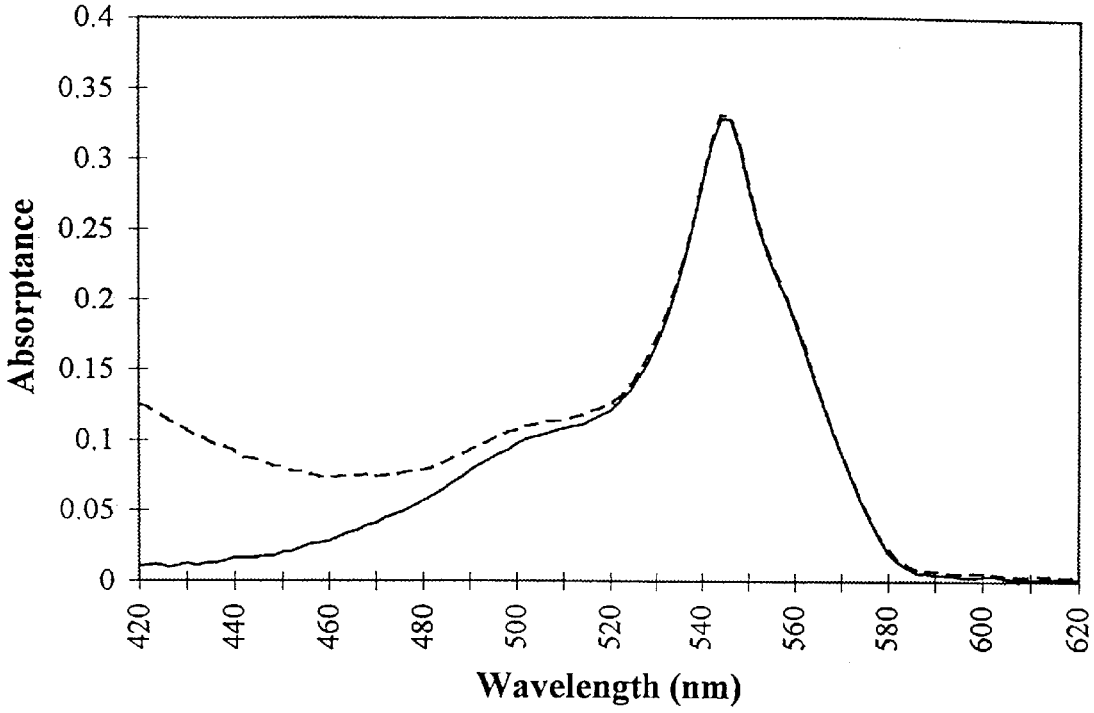
Figure 2H:
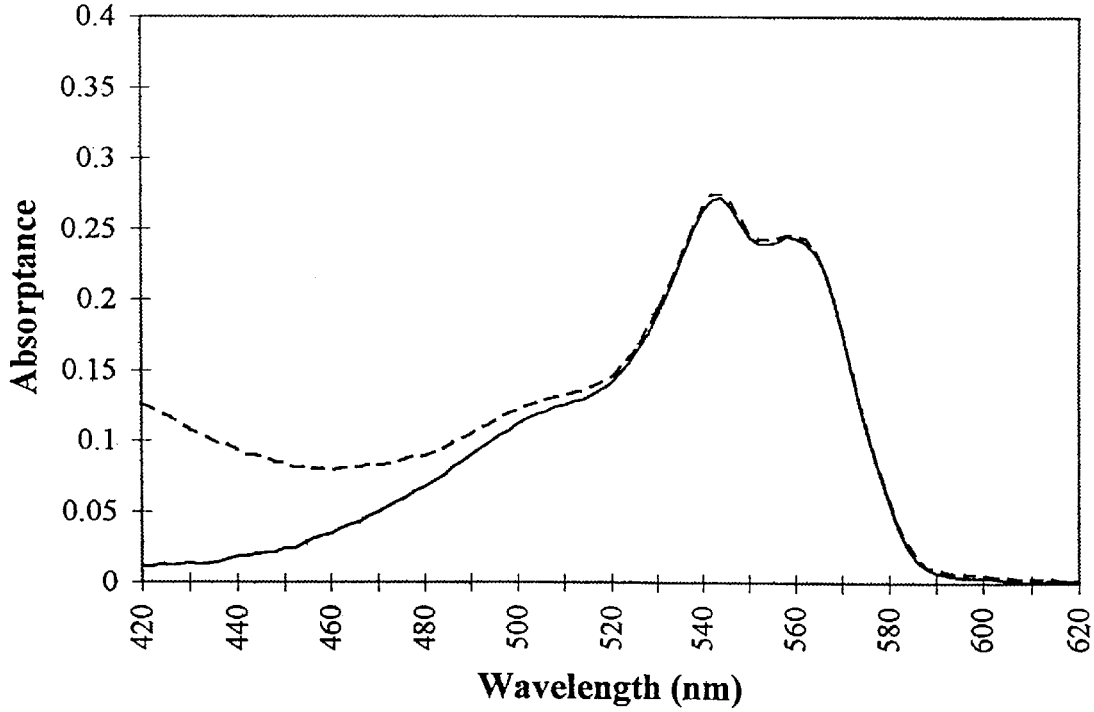
Figure 2I:
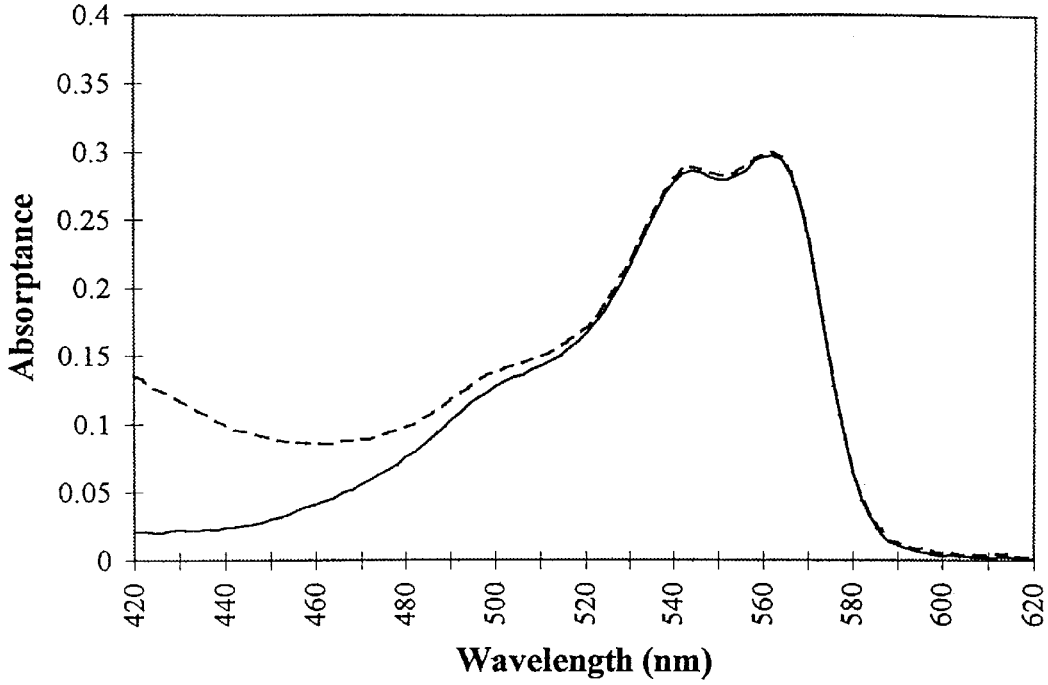
Figure 2J:
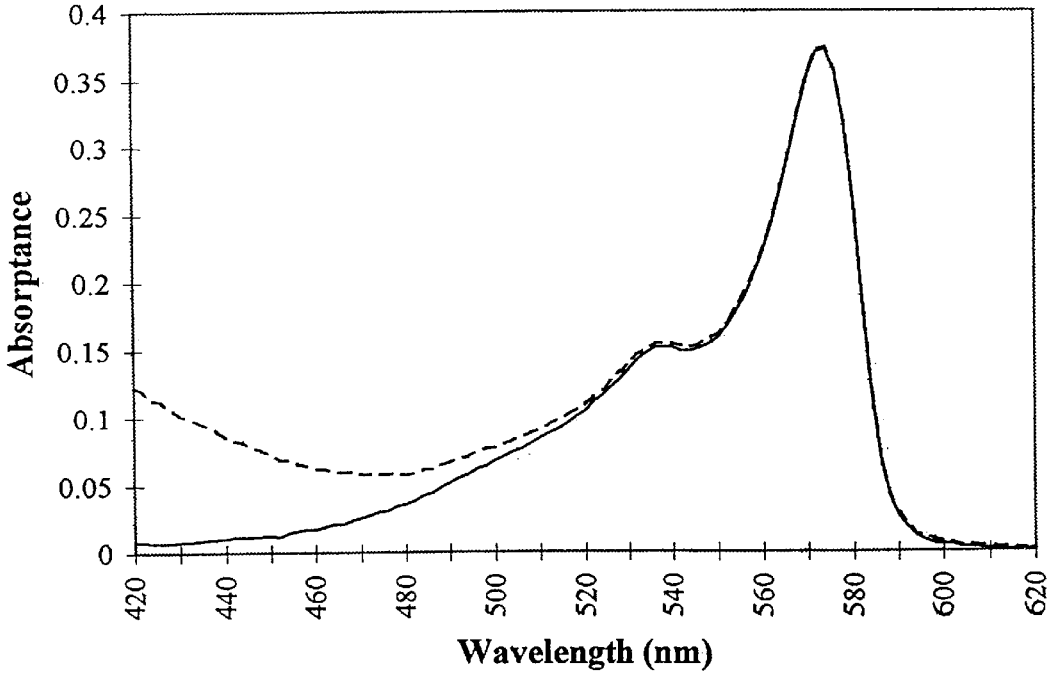
Figure 2K:
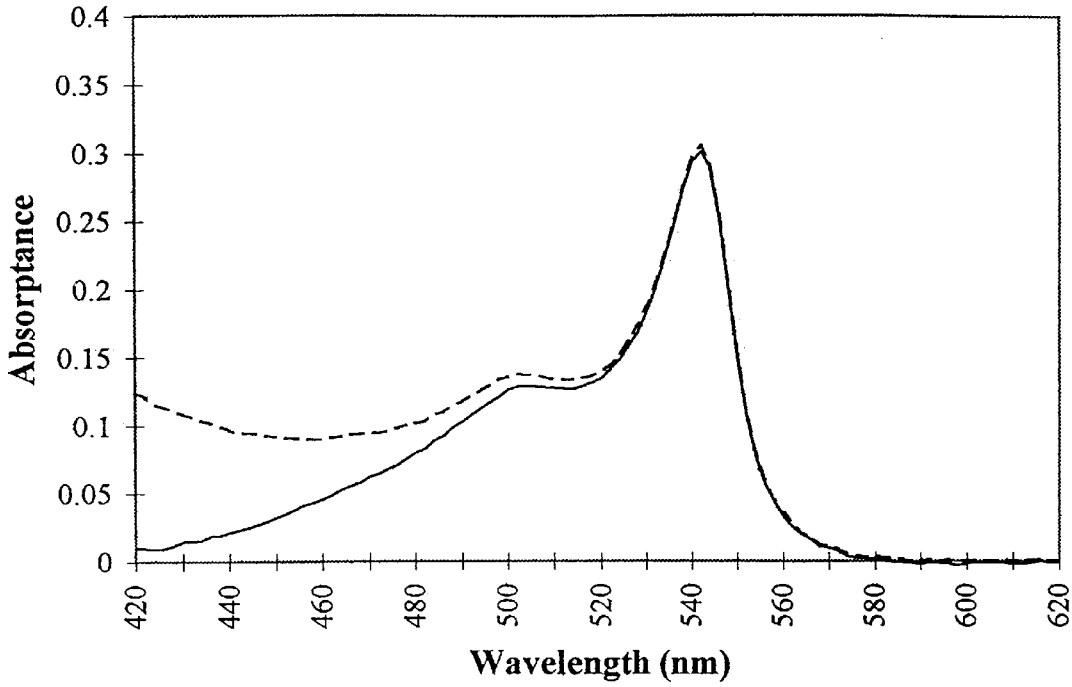
Figure 2L:
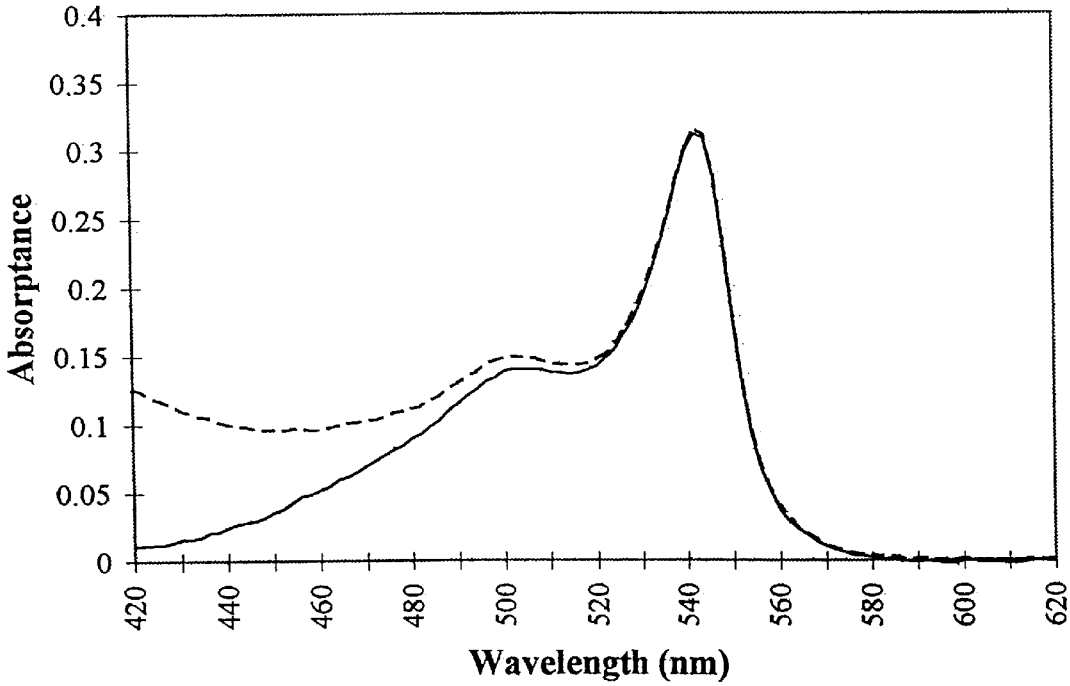
Figure 2M:
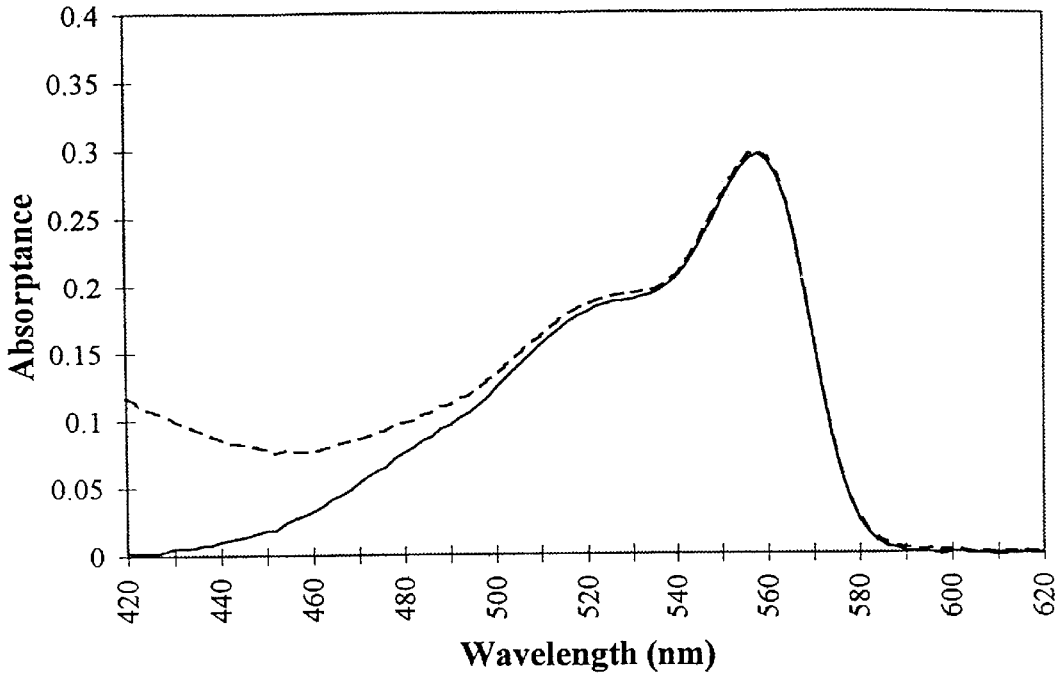
Figure 2N:
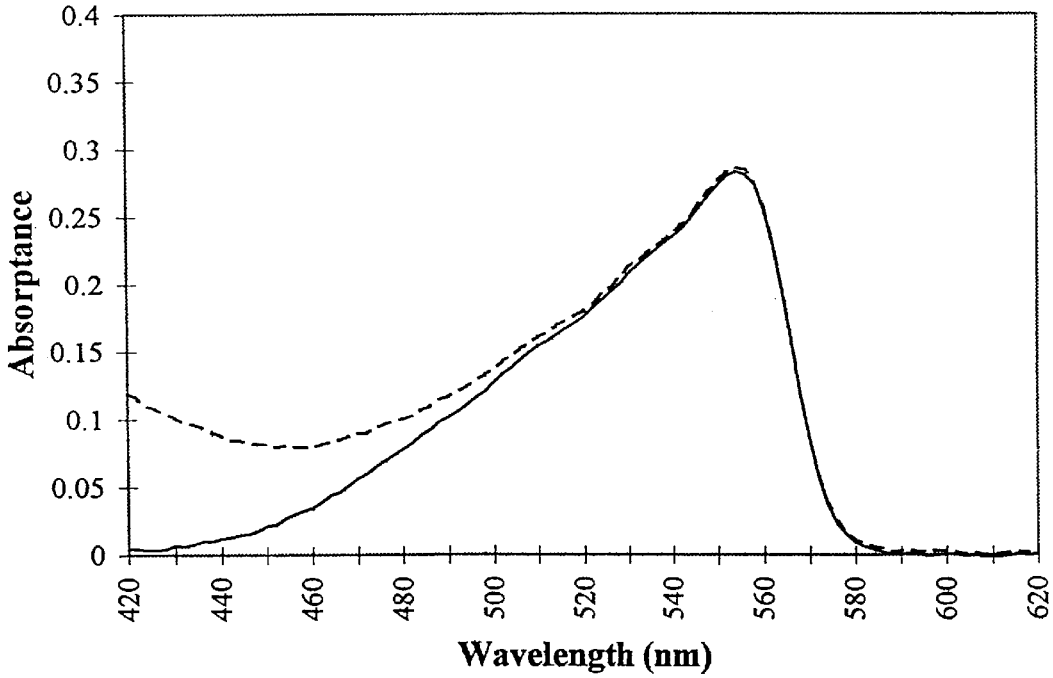
Figure 2O:
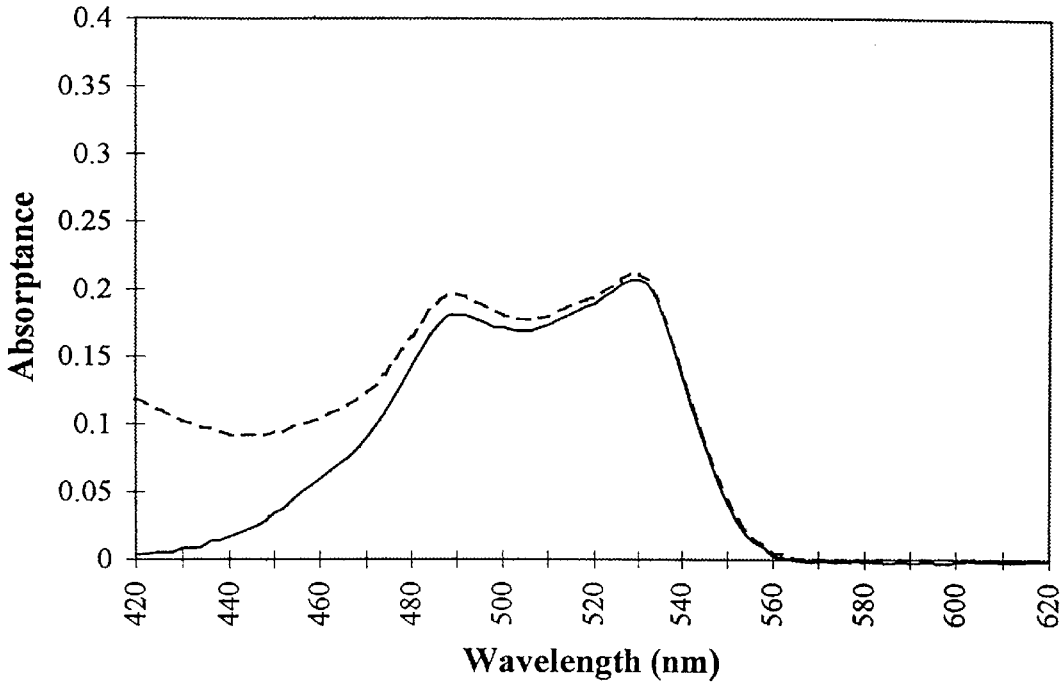
Figure 2P:
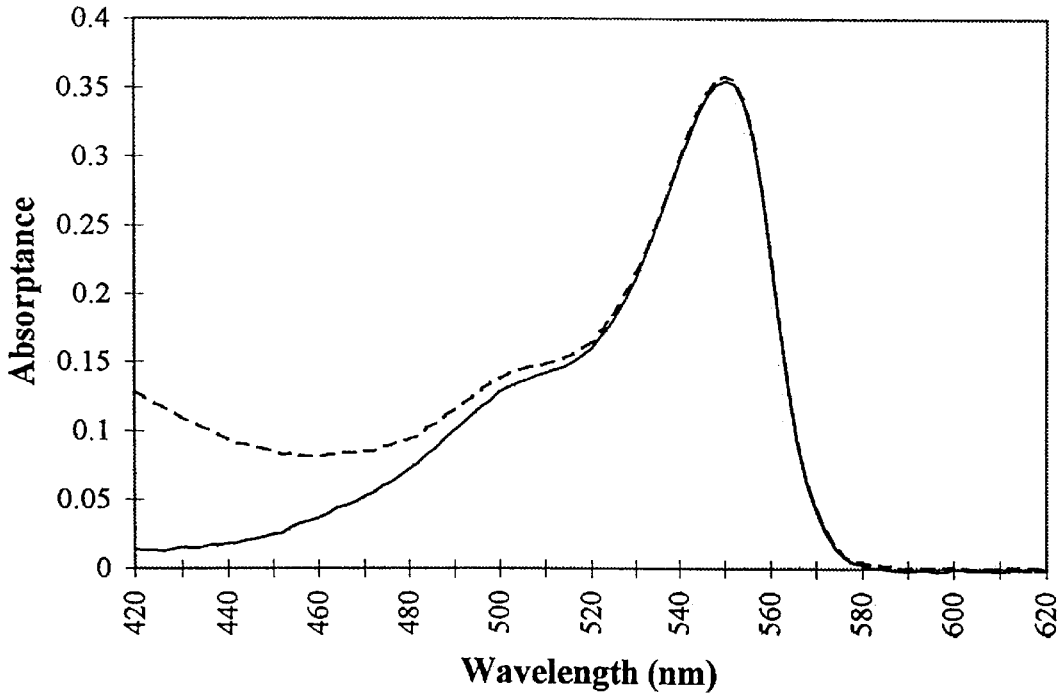
Figure 2Q:
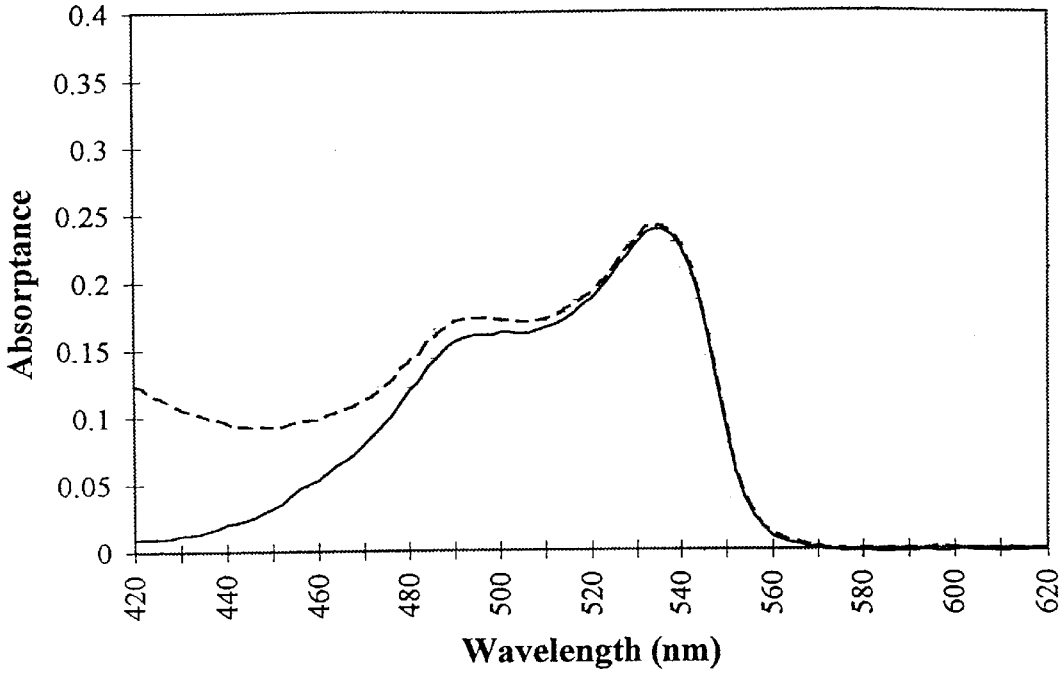
Figure 2R:
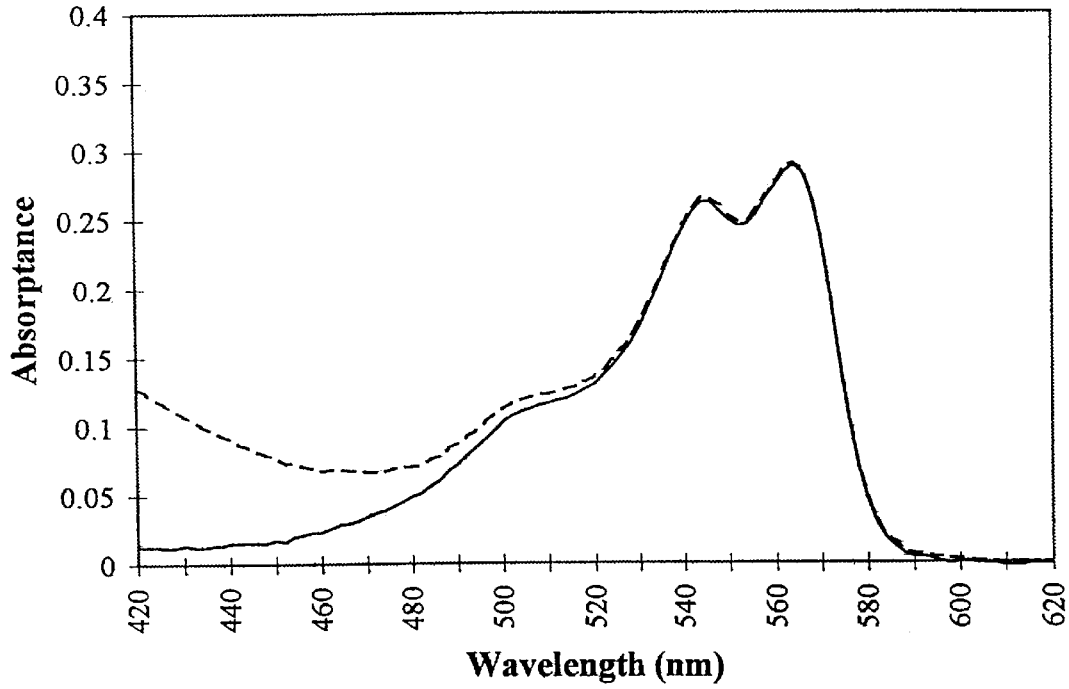

The spectral sensitivity distribution of a silver halide emulsion is a representation of how the emulsion converts photons of absorbed light to developable latent image. It is conveniently displayed as a graph of photographic sensitivity (speed) versus wavelength of visible light. The light actually absorbed by a dyed emulsion in a gelatin coating on a support can be measured spectrophotometrically. Since silver halide crystals scatter light, some light is transmitted by the coating, some light is reflected, and the remainder is absorbed. The absorptance of a coating of a silver halide emulsion is determined by measuring wavelength-by-wavelength the total amount of light transmitted, and the total amount of light reflected. The absorptance at each wavelength is then expressed as (1−T−R) where T is the amount of light transmitted and R is the amount of light reflected. The absorptance is plotted as the percent of light absorbed versus the wavelength. Silver halide also absorbs blue light, especially as the halide is comprised of increasing concentrations of iodide. An absorptance spectrum for sensitizing dyes on silver halide can be obtained by subtracting, wavelength by wavelength, the absorptance spectrum of an undyed emulsion from that of the dyed emulsion, both coated on a transparent support at an equal coverage of silver. This technique is necessary in the blue light absorbing region of the visible spectrum, and is useful for emulsions dyed in the green region of the visible spectrum, especially the short green region (<540 nm).

A combination of cyanine dyes on the surface of a silver halide emulsion is generally equally efficient at all wavelengths at converting absorbed photons to conduction band elections. Therefore, percent absorptance spectra can be used as a substitute for spectral sensitivity distribution.

In order to construct a film element with red, green and blue light recording layer units and to provide a red recording unit with spectral sensitivity that approaches color matching functions for the human eye, it is necessary to use a broader emulsion absorptance with more hypsochromic absorption in the green region of the spectrum than has been used in prior color photographic films. In particular, the green absorptance extends into the green region below 520 nm. Thus for the green recording layer unit, it is necessary to use silver halide emulsions that also have a combination of sensitizing dyes such that the green recording layer unit comprises at least one green sensitive emulsion, when coated singly, has:

(i) a peak dyed absorptance of between 520 and 560 nm, (ii) an absorption bandwidth at 50% of the peak dyed absorptance greater than or equal to 50 nm, (iii) an absorption bandwidth at 80% of the peak dyed absorptance greater than or equal to 27 nm, (iv) a ratio of the absorptance at 560 nm to the peak dyed absorptance greater than or equal to 0.40, (v) a ratio of the absorptance at 550 nm to the peak dyed absorptance greater than or equal to 0.60, and (vi) a ratio of the absorptance at 520 nm to the peak dyed absorptance greater than or equal to 0.55.

The green emulsion layer has a peak dyed absorptance of between 520 and 560 nm, preferably between 522 and 558 nm, and more preferably between 524 and 556 nm.

The green emulsion layer has an absorption bandwidth at 50% of the peak dyed absorptance greater than or equal to 50 nm, preferably greater than or equal to 53 nm, and more preferably greater than or equal to 55 nm. The upper limit of the absorption bandwidth at 50% of the peak dyed absorptance is not critical and preferably is about 125 nm.

The green emulsion layer has an absorption bandwidth at 80% of the peak dyed absorptance greater than or equal to 27 nm, preferably greater than or equal to 29 nm and more preferably greater than or equal to 30 nm. Preferably the absorption bandwidth at 80% of the peak dyed absorptance is less than about 80 nm.

The green emulsion layer has a ratio of the absorptance at 560 nm to the peak dyed absorptance greater than or equal to 0.40, preferably greater than or equal to 0.42, and more preferably greater than or equal to 0.45. This ratio can be up to 1.0.

The green emulsion layer has a ratio of the absorptance at 550 nm to the peak dyed absorptance greater than or equal to 0.60, preferably greater than or equal to 0.62, and more preferably greater than or equal to 0.65.

The green emulsion has a ratio of the absorptance at 520 nm to the peak dyed absorptance greater than or equal to 0.55, preferably greater than or equal to 0.58 and more preferably greater than or equal to 0.60. This ratio can be up to 1.0.

In a more preferred embodiment of the invention, a silver halide emulsion used in the green recording layer unit contains a combination of sensitizing dyes such that the absorptance spectrum of the emulsion coated singly has:

(i) a peak dyed absorptance of between 524 and 560 nm, (ii) an absorption bandwidth at 50% of the peak dyed absorptance greater than or equal to 55 mn, (iii) an absorption bandwidth at 80% of the peak dyed absorptance greater than or equal to 27 nm, (iv) a ratio of the absorptance at 560 nm to the peak dyed absorptance greater than or equal to 0.40, (v) a ratio of the absorptance at 550 nm to the peak dyed absorptance greater than or equal to 0.60, and (vi) a ratio of the absorptance at 520 nm to the peak dyed absorptance greater than or equal to 0.60.

In an even more preferred embodiment of the invention, a silver halide emulsion used in the green recording layer unit contains a combination of sensitizing dyes such that the absorptance spectrum of the emulsion coated singly has:

(i) a peak dyed absorptance of between 524 and 556 nm, (ii) an absorption bandwidth at 50% of the peak dyed absorptance greater than or equal to 55 nm, (iii) an absorption bandwidth at 80% of the peak dyed absorptance greater than or equal to 30 nm, (iv) a ratio of the absorptance at 560 nm to the peak dyed absorptance greater than or equal to 0.45, (v) a ratio of the absorptance at 550 nm to the peak dyed absorptance greater than or equal to 0.65, and (vi) a ratio of the absorptance at 520 nm to the peak dyed absorptance greater than or equal to 0.60.

Preferably two or more sensitizing dyes are used in combination. Examples of employable sensitizing dyes include cyanine dyes, merocyanine dyes, complex cyanine dyes, holopolar cyanine dyes, hemicyanine dyes, styryl dyes, and hemioxonol dyes. The dyes are chosen such that the absorptance of the individual dyes on the silver halide emulsion are separated by more than 5 nm and together span the wavelength range of the broad absorptance desired. Particularly preferred are cyanine dyes having the general formula I shown below.

(I)

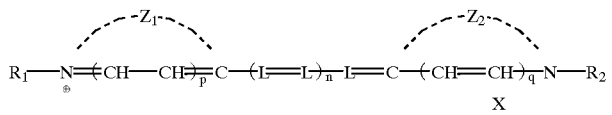

wherein each of $R_1$ and $R_2$ independently represents a substituted or unsubstituted alkyl group, preferably containing 1 to 10 carbon atoms, or substituted or unsubstituted aryl group; each of $Z_1$ and $Z_2$ independently represents the atoms necessary to complete a 5 or 6-membered heterocyclic ring system; each L is a substituted or unsubstituted methane group; each of p, q and n is independently 0 or 1; and X is a counterion as necessary to balance the charge.

Preferred dyes have the formula II below.

(II)

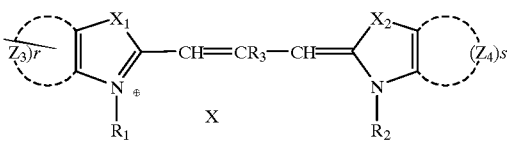

where $R_1$, $R_2$, and X have the same meaning as in formula I; each of r and s is independently 0 or 1; each of $Z_3$ and $Z_4$ independently represents the atoms necessary to complete a fused benzene, naphthalene, pyridine, or pyrazine ring, which can be further substituted; $R_3$ is a substituted or unsubstituted alkyl group, preferably containing 1–6 carbon atoms, or a substituted or unsubstituted aryl group; $X_1$ and $X_2$ can each individually be O, S, Se, Te, N—$R_4$, where $R_4$ is a substituted or unsubstituted alkyl group, preferably containing 1 to 10 carbon atoms, or substituted or unsubstituted aryl group, with the proviso that $X_1$ and $X_2$ are not both S, Se or Te; and when r or s is 0, the five membered ring containing $X_1$ or $X_2$, respectively, may be further substituted at the 4 and/or 5 position.

Preferred dyes of formula II are those where $X_1$ and $X_2$ are O, S, Se, or N—$R_4$. It is also preferred that one or both of r and s is equal to 1, and that at least one of $R_1$ and $R_2$ contains an acid solubilizing group. It will be recognized by those skilled in the art that as $X_1$ and $X_2$ are changed from O to N—$R_4$ to S, to Se, the dyes will absorb light at longer wavelengths. Therefore, it is anticipated that a mixture of dyes used in the practice of this invention will typically utilize two or more carbocyanine dyes with a range of values for $X_1$ and $X_2$.

Cyanine spectral sensitizing dyes that form J-aggregates are preferred for building the needed breadth of absorption with good quantum efficiency on silver halide emulsions of the invention; J-aggregating carbocyanine dyes are the most preferred dyes for the practice of this invention.

In order to achieve adequate sensitivity at wavelengths <540 nm, the "short green" region of the spectrum, and still maintain a high sensitivity of the silver halide, it is further preferred that a J-aggregating "short green" sensitizing dye be employed in the invention. Examples of J-aggregating short green sensitizing dyes are described by, but not limited to, the following general structures SG-I to SG-IV.

SG-I

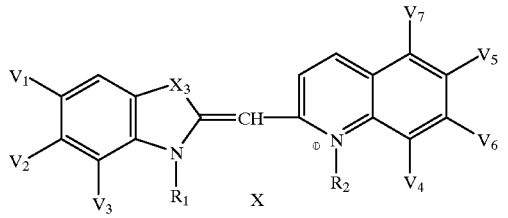

wherein $R_1$, $R_2$ and X have the same meaning as in structure I; $X_3$ is S or Se, and each of $V_1$ to $V_7$ independently represents hydrogen, a substituted or unsubstituted alkyl group, a substituted or unsubstituted aromatic group, a halogen atom, an acylamino group, a carbamoyl group, a carboxy group, or a substituted or unsubstituted alkoxy group and adjacent pairs of substituents $V_1$ to $V_7$ may be joined to form a fused carbocyclic, heterocyclic, aromatic, or heteroaromatic ring, which may be substituted.

SG-II

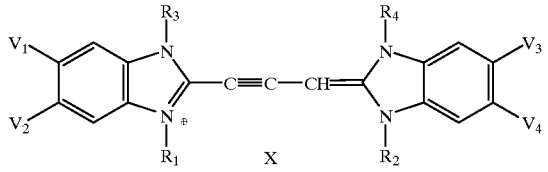

wherein $R_1$, $R_2$, and X have the same meaning as in structure I; $V_1$ to $V_4$ have the same meaning as in SG-I; and each of $R_3$ and $R_4$ independently represents a substituted or unsubstituted alkyl group, preferably containing 1 to 10 carbon atoms, or substituted or unsubstituted aryl group;

SG-III

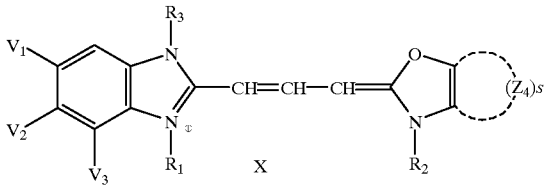

wherein, $R_1$, $R_2$, $Z_3$, and X, have the same meaning as in formula II and $V_1$–$V_3$ have the same meaning as in formula SG-I; and $R_3$ represents a substituted or unsubstituted alkyl group, preferably containing 1 to 10 carbon atoms, or substituted or unsubstituted aryl group. Dyes of type SG-III are benzimidazolooxacarbocyanines or benzimidazolooxazolocarbocyanines and in order to achieve a J-aggregate that absorbs light at a short green wavelength, it is necessary to make the chromophore very unsymmetrical with respect to the charge distribution. This is accomplished by incorporating electron withdrawing substituents into the oxazole or benzoxazole ring. An example of electron withdrawing groups for $R_2$ are fluoro substituted alkyl groups. Examples of electron withdrawing substituents on $Z_3$ are trifluoromethyl and cyano.

SG-IV

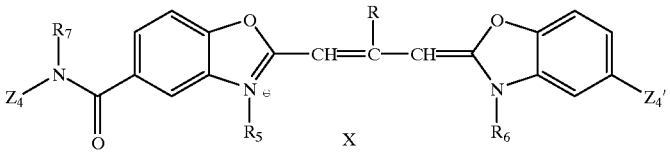

wherein R is hydrogen or a substituted or unsubstituted aryl group (e.g.phenyl) or more preferably a substituted or unsubstituted alkyl group (e.g. lower alkyl, such as methyl, ethyl); $R_5$ and $R_6$ are both substituted or unsubstituted alkyl groups, for example both may be 1–8 carbon alkyl groups, and may be the same or different; at least one of $R_5$ or $R_6$ is preferably substituted by an acid or acid salt group and preferably both $R_5$ and $R_6$ may be substituted by an acid or acid salt group (particularly preferred acid salt groups are carboxy and sulfo groups, for example 3-sulfobutyl, 4-sulfobutyl, 3-sulfopropyl, 2-sulfoethyl, carboxyethyl, carboxypropyl, and the like); $R_7$ is hydrogen or a substituted or unsubstituted alkyl group (such as a methyl or ethyl group); $Z_4$ represents a substituted or unsubstituted aromatic group and X is one or more ions needed to balance the charge on the molecule.

The $Z_4$ aromatic group can be hydrocarbon or heterocyclic (The definition of aromatic rings is described in J. March *Advanced Organic Chemistry*, Chapter 2, (1985), John Wiley & Sons, New York). Examples of $Z_4$ include a substituted or unsubstituted phenyl group, substituted or unsubstituted thiophene-3-yl group, etc. $Z_4'$ in structure SG-IV represents a substituted or unsubstituted aromatic group which may be appended directly to the dye or $Z_4'$ may represent $LZ_5$ where L represents a linking group. Preferably the atoms of the linking group are sp2 hybridized. (Hybridization is described in J. March, *Advanced Organic Chemistry*, Chapter 1, (1985), John Wiley & Sons, New York). The linking group can be substituted or unsubstituted. Examples of linking groups are —CONR"— or —NR"CO—, wherein R" represents hydrogen or substituted or unsubstituted alkyl (preferably a lower alkyl group). Preferred examples of J-aggregating short green dyes are those of formula SG-IV.

Non-limiting examples of J-aggregating short green dyes which may be used in the practice of this invention are as follows:

SD-1

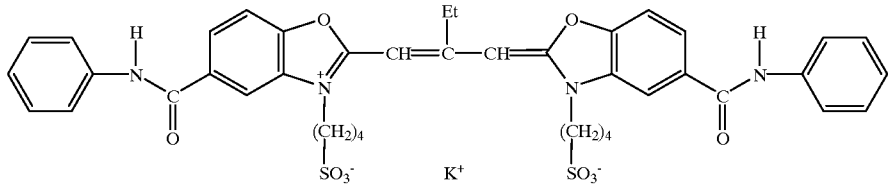

SD-2

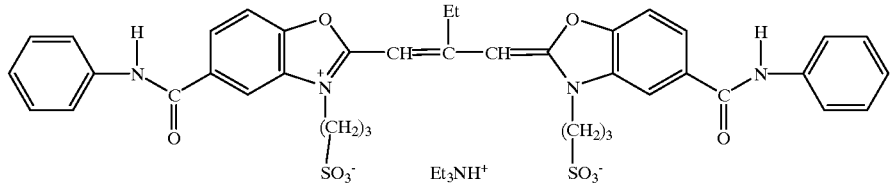

SD-3

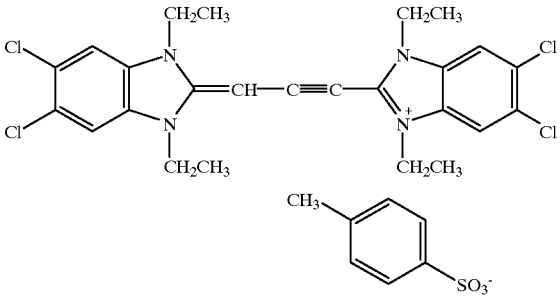

-continued
SD-4
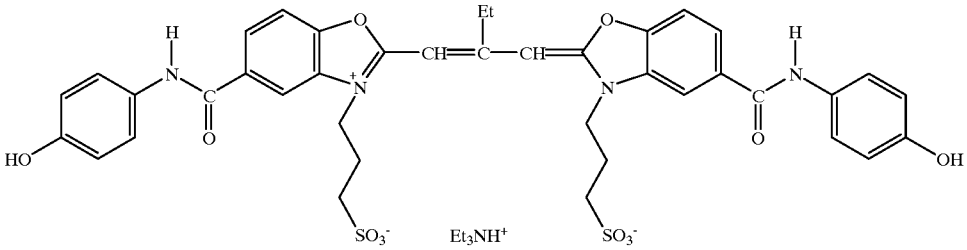
SD-5
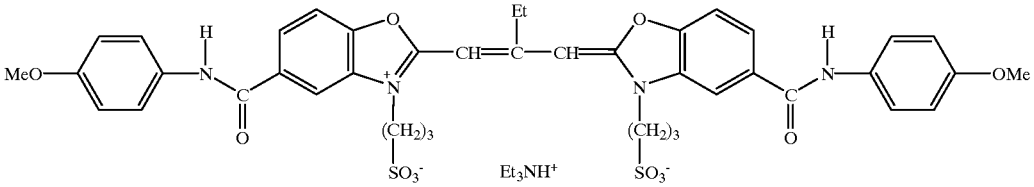
SD-6
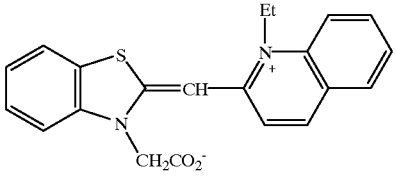
SD-7
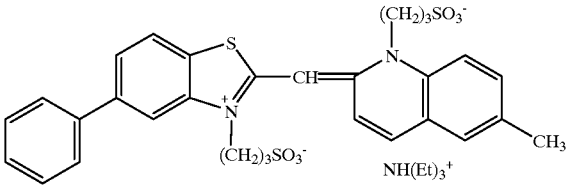
SD-8
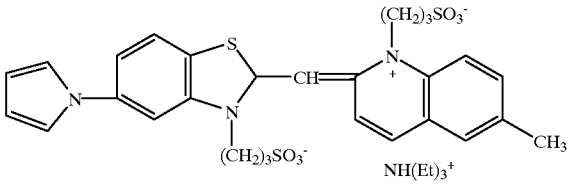
SD-9
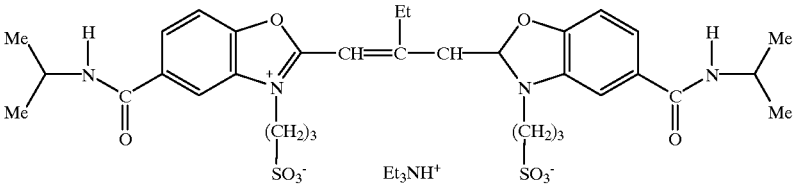

-continued
SD-10
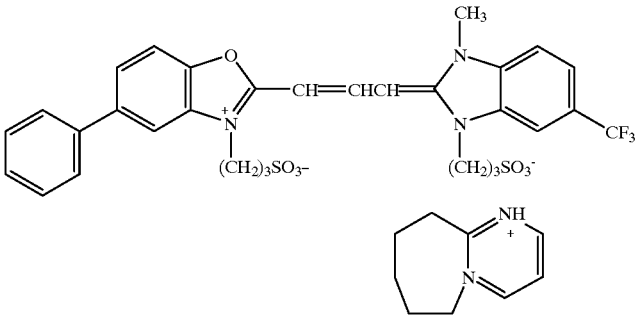
SD-11
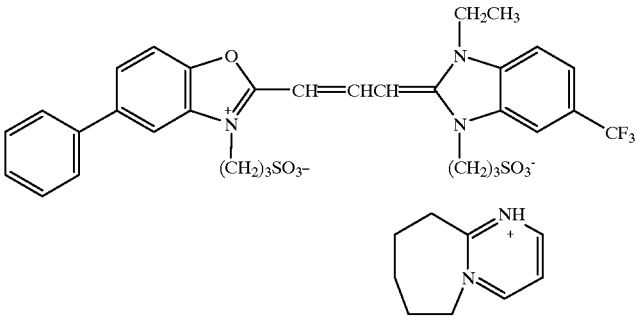
SD-12
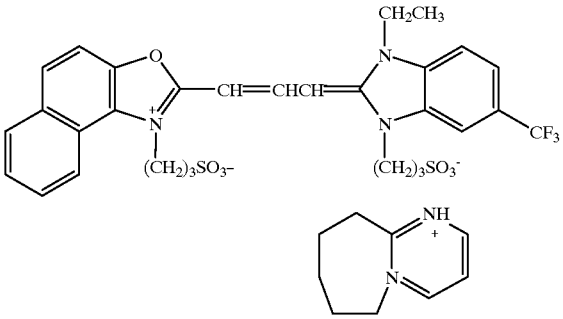
SD-13
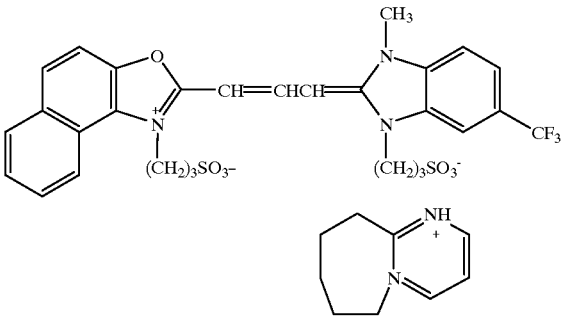

-continued

SD-14

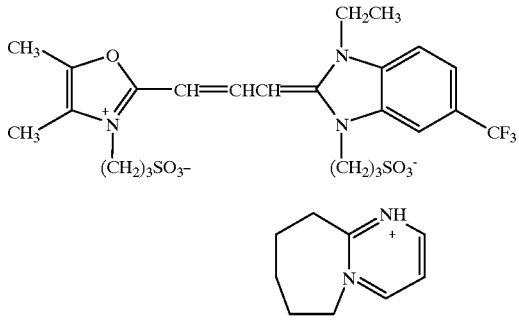

SD-15

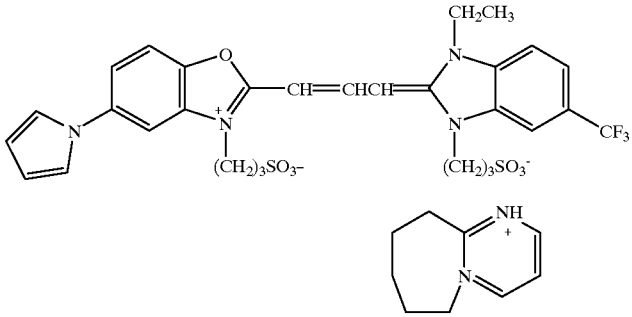

SD-16

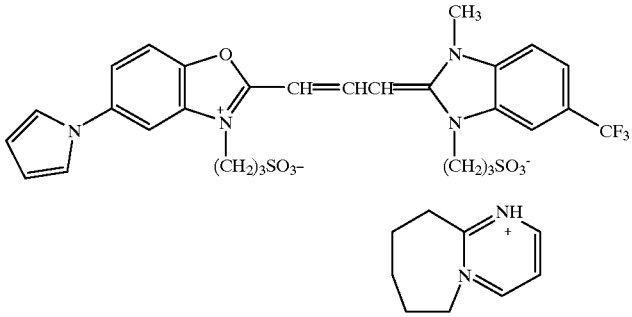

SD-17

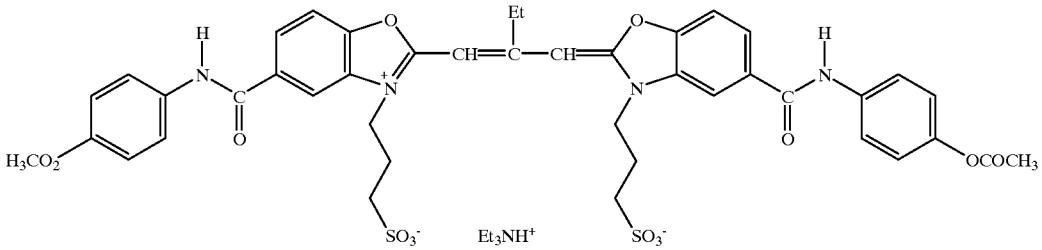

The broad green sensitive silver halide emulsion may be sensitized by sensitizing dyes using any method known in the art. Dyes may be added to the silver halide emulsion singly or together, but since the desired all-positive color-matching-function spectral sensitivities are smooth curves with a single peak, it is preferred that the absorptance spectrum of the dyed silver halide emulsions should also have only a single peak. A highly preferred method of addition of the dyes to the silver halide is by premixing them as a solution in a suitable solvent, as a mixed dispersion in aqueous gelatin, or as a mixed liquid crystalline dispersion in water. Of course, green sensitized silver halide emulsions will be sensitized in accord with the requirements as described. The dye or dyes may be added to the silver halide emulsion grains and hydrophilic colloid at any time prior to or simultaneous with the application of a liquid coating solution comprised of the emulsion to a support. The sensitizing dye or dyes may be added prior to, during or following the chemical sensitization of the emulsion grains. With tabular silver halide emulsions, the dyes are preferably added to the grains before chemical sensitization.

Three or more sensitizing dyes are typically used to achieve the objectives of the invention. It is preferred to use four or five dyes to achieve the required half-peak bandwidth, but more dyes can be added as is useful. As many as seven dyes, or more, blended in the spectrochemical sensitization are contemplated to provide both breadth of sensitivity and high continuity of the spectral response. A combination of dyes is useful also for supersensitization as well as spectral response adjustment. Since the spectral absorption characteristics of a sensitizing dye on an emulsion will, to some extent, bear on the particular emulsion used as well as the other sensitizing dyes present on the same emulsion, the sensitizing dyes selected to sensitize the green light recording silver halide emulsion to within the required characteristics of the invention will be chosen with these characteristics in mind. Furthermore, other factors such as the order of addition, the silver ion potential (vAg), the emulsion surface and its halide type can be manipulated to achieve the desired spectral absorptances.

The light sensitive silver halide emulsion of the instant invention may contain a compound which is a dye having no spectral sensitization effect itself, or a compound substantially incapable of absorbing visible light in the spectral regions according to the invention, or which does absorb light in the spectral region of interest but is present in very low quantities but which exhibits a supersensitizing effect, such as compounds described in U.S. Pat. No. 3,615,641, or as disclosed in Research Disclosure, Vol. 389, September 1996, Item 38957.

In another embodiment of the invention, the silver halide emulsion comprises multiple layers of sensitizing dyes adsorbed to the silver halide surface. As disclosed in commonly assigned copending applications 09/151,974, 09/151,915 and 09/151,916, filed Sep. 11, 1998, the entire disclosures of which is incorporated herein by reference, emulsions sensitized with two or more dyes which form layers on the silver halide grains exhibit increased the light absorption.

Illustrations of useful spectral sensitizing dyes and techniques are provided by Research Disclosure, Item 38957, cited above, section V. Spectral sensitization and desensitization. More concrete examples of sensitizing dyes are disclosed, for example, in U.S. Pat. No. 4,617,257, U.S. Pat. No. 5,037,728, U.S. Pat. No. 5,166,042, and U.S. Pat. No. 5,180,657.

A typical color negative film construction useful in the practice of the invention is illustrated by the following:

| Element SCN-1 | |
|---|---|
| SOC | Surface Overcoat |
| BU | Blue Recording Layer Unit |
| IL1 | First Interlayer |
| GU | Green Recording Layer Sub-Unit |
| IL2 | Second Interlayer |
| RU | Red Recording Layer Unit |
| AHU | Antihalation Layer Unit |
| S | Support |
| SOC | Surface Overcoat |

The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. The element can contain additional layers, such as filter layers, interlayers, overcoat layers, subbing layers, antihalation layers and the like. Transparent and reflective support constructions, including subbing layers to enhance adhesion, are disclosed in *Research Disclosure*, Item 38957, cited above, XV. Supports. Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945, and U.S. Pat. No. 4,302,523.

Each of blue, green and red recording layer units BU, GU and RU are formed of one or more hydrophilic colloid layers and contain at least one radiation-sensitive silver halide emulsion and coupler, including at least one dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

The emulsion in BU is capable of forming a latent image when exposed to blue light. When the emulsion contains high bromide silver halide grains and particularly when minor (0.5 to 20, preferably 1 to 10, mole percent, based on silver) amounts of iodide are also present in the radiation-sensitive grains, the native sensitivity of the grains can be relied upon for absorption of blue light. Preferably the emulsion is spectrally sensitized with two or more blue spectral sensitizing dyes to achieve the required absorption breadth of color matching function spectral sensitivity which mimics human visual sensitivity. Tabular emulsions are preferred for providing dyed blue spectral sensitivity. The emulsions in GU and RU are spectrally sensitized with green and red spectral sensitizing dyes, respectively, in all instances, since silver halide emulsions have no native sensitivity to green and/or red (minus blue) light. The red unit emulsions of the invention preferably are comprised of at least four spectral sensitizing dyes. More preferably, at least five spectral sensitizing dyes are employed to achieve the required spectral breadth of responsivity to green-red light.

Any convenient selection from among conventional radiation-sensitive silver halide emulsions can be incorporated within the layer units and used to provide the spectral absorptances of the invention. Most commonly high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically preferred for the blue sensitive recording unit. The green sensitive recording unit is preferably comprised of tabular grains with an aspect ratio of less than or equal to 15. The grains preferably form surface latent images so that they produce negative images when processed in a surface developer in color negative film forms of the invention.

Illustrations of conventional radiation-sensitive silver halide emulsions are provided by *Research Disclosure*, Item 38957, cited above, I. Emulsion grains and their preparation. Chemical sensitization of the emulsions, which can take any conventional form, is illustrated in section IV. Chemical sensitization. Spectral sensitization and sensitizing dyes, which can take any conventional form, are illustrated by section V. Spectral sensitization and desensitization. The emulsion layers also typically include one or more antifoggants or stabilizers, which can take any conventional form, as illustrated by section VII. Antifoggants and stabilizers.

The average aspect ratio of the tabular grain emulsions are a function of the mean ECD of the tabular grains and their mean thickness. Typically tabular grain precipitation conditions are adjusted to obtain a convenient tabular grain thickness. As tabular grain growth progresses the mean ECD of the tabular grains increases with little, if any, increase in tabular grain thickness. Grain growth is terminated when an optimum mean ECD and average aspect ratio of the tabular grains has reached a level of optimum for the imaging application. It is specifically contemplated to allow grain thickness to increase during tabular grain growth to allow a selected ECD to be realized where limited average aspect ratios are sought.

Preferred tabular grain emulsions contemplated for use in the practice of this invention are high bromide tabular grain emulsions in which the tabular grains have {111} major faces, illustrated by the following patents, here incorporated by reference:

Solberg et al U.S. Pat. No. 4,433,048;
Wilgus et al U.S. Pat. No. 4,434,226;
Kofron et al U.S. Pat. No. 4,439,520;
Maskasky U.S. Pat. No. 4,435,501;
Maskasky U.S. Pat. No. 4,713,320;
Nottorf U.S. Pat. No. 4,722,886;
Saito et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Piggin et al U.S. Pat. No. 5,061,616;
Piggin et al U.S. Pat. No. 5,061,616;
Bell et al U.S. Pat. No. 5,132,203;
Antoniades et al U.S. Pat. No. 5,250,403;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Black et al U.S. Pat. No. 5,219,720;
Black et al U.S. Pat. No. 5,334,495;
Tsaur et al U.S. Pat. No. 5,272,048;
Delton U.S. Pat. No. 5,310,644;
Chaffee et al U.S. Pat. No. 5,358,840;
Delton U.S. Pat. No. 5,372,927;
Delton U.S. Pat. No. 5,460,934;
Wen U.S. Pat. No. 5,470,698;
Fenton et al U.S. Pat. No. 5,476,760;
Mignot U.S. Pat. No. 5,484,697;
Maskasky U.S. Pat. No. 5,492,801;
Daubendiek et al U.S. Pat. No. 5,494,789;
Olm et al U.S. Pat. No. 5,503,970;
Daubendiek et al U.S. Pat. No. 5,503,971;
King et al U.S. Pat. No. 5,518,872;
Wen et al U.S. Pat. No. 5,536,632;
Daubendiek et al U.S. Pat. No. 5,573,902;
Daubendiek et al U.S. Pat. No. 5,576,168;
Olm et al U.S. Pat. No. 5,576,171;
Olm et al U.S. Pat. No. 5,576,172;
Deaton et al U.S. Pat. No. 5,582,965;
Maskasky U.S. Pat. No. 5,604,085;
Reed et al U.S. Pat. No. 5,604,086;
Maskasky U.S. Pat. No. 5,620,840; and
Eshelman et al U.S. Pat. No. 5,612,175.

Chemical sensitization of silver halide emulsions is illustrated by *Research Disclosure*, Item 38957, IV. Chemical sensitization, and by the patents incorporated by reference above. Spectral sensitizing dyes are illustrated by *Research Disclosure*, Item 38957, V. Spectral sensitization and desensitization A. Sensitizing dyes, and by the patents incorporated by reference above (note Kofron et al particularly). Antifoggants and stabilizers are illustrated by *Research Disclosure*, Item 38957, VII. Antifoggants and stabilizers.

Couplers, including dye-forming couplers and other image modifying couplers, suitable for use in BU, GU and RU are illustrated in the patents incorporated by reference above and in *Research Disclosure*, Item 38957, X. Dye image formers and modifiers.

The vehicle and related addenda for the layers of BU, GU and RU as well as the remaining processing solution permeable layers of the color negative element can be selected from among the vehicles disclosed in the patents incorporated by reference above and *Research Disclosure*, Item 38957, II. Vehicles, vehicle extenders, vehicle-like addenda and vehicle related addenda. Generally, hardened gelatin and gelatin derivatives are preferred vehicles; however, cationic starch and, particularly, oxidized cationic starch, disclosed by Maskasky U.S. Pat. Nos. 5,604,085, 5,620,840, and 5,633,127, as well as Maskasky U.S. Ser. Nos. 08/662,904, filed June 1996, and 08/662,300, filed Jul. 29, 1996, both commonly assigned, allowed and here incorporated by reference, are also contemplated.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by *Research Disclosure*, Item 38957, cited above, X. Dye image formers and modifiers, B. Image-dye-forming couplers.

The remaining elements SOC, IL1, IL2 and AHU of the element SCN-1 are optional and can take any convenient conventional form.

The interlayers IL1 and IL2 are hydrophilic colloid layers having as their primary function stain reduction—i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate an oxidized developing agent scavenger. When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. IL2 can also contain a yellow filter. Suitable yellow filter dyes can be selected from among those illustrated by *Research Disclosure*, Item 38957, VIII. Absorbing and scattering materials, B. Absorbing materials. Antistain agents (oxidized developing agent scavengers) can be selected from among those disclosed by *Research Disclosure*, Item 38957, X. Dye image formers and modifiers, D. Hue modifiers/stabilization, paragraph (2).

The antihalation layer unit AHU typically contains a processing solution removable or decolorizable light absorbing material, such as one or a combination of pigments and dyes. Suitable materials can be selected from among those disclosed in *Research Disclosure*, Item 38957, VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure*, Item 38957, IX. Coating physical property modifying addenda. The SOC overlying the emulsion layers additionally preferably contains an ultraviolet absorber, such as illustrated by *Research Disclosure*, Item 38957, VI. UV dyes/optical brighteners/luminescent dyes, paragraph (1).

When the silver halide emulsions employed in GU and RU exhibit no significant amount of native blue sensitivity, as is common in high (>50 mole %, based on silver) chloride silver halide emulsions, the layer arrangements noted above can be varied by moving BU to any desired location in the coating sequence. When GU and RU lack native blue sensitivity, there is no need to use a blue absorbing (i.e., yellow) filter to avoid blue light exposure. Thus, layer unit arrangements become attractive that allow the fGU followed by fRU to first receive exposing radiation.

When high chloride tabular grain emulsions are employed, the tabular grains can have {111} or {100} major faces. The following, here incorporated by reference, are illustrative of high chloride {111} tabular grain emulsions that can be utilized Wey U.S. Pat. No. 4,399,215;
Maskasky U.S. Pat. No. 4,400,463;
Maskasky U.S. Pat. No. 4,713,323;
Maskasky U.S. Pat. No. 5,061,617;
Maskasky et al U.S. Pat. No. 5,176,992;
Maskasky et al U.S. Pat. No. 5,178,997;
Maskasky U.S. Pat. No. 5,185,239;
Maskasky U.S. Pat. No. 5,399,478; and
Maskasky U.S. Pat. No. 5,411,852.

The following, here incorporated by reference, are illustrative of high chloride {100} tabular grain emulsions that can be utilized:

Maskasky U.S. Pat. No. 5,275,930;
House et al U.S. Pat. No. 5,320,938;
Brust et al U.S. Pat. No. 5,314,798;
Maskasky U.S. Pat. No. 5,399,477;
Chang et al U.S. Pat. No. 5,413,904;
Olm et al U.S. Pat. No. 5,457,021;
Maskasky U.S. Pat. No. 5,604,085;
Yamashita et al U.S. Pat. No. 5,641,620;
Chang et al U.S. Pat. No. 5,663,041; and
Ovamada et al U.S. Pat. No. 5,665,530.

The color negative elements of the invention can be imagewise exposed in any convenient conventional manner. The imagewise exposed color negative elements can be processed using conventional color developer compositions and color negative processing systems. Such compositions and systems are included among those disclosed in *Research Disclosure*, Item 38957, XVIII. Chemical development systems, B. Color-specific processing systems, XIX. Development, and XX. Desilvering, washing, rinsing and stabilizing.

Though constructed with a unique combination of features to permit superior dye images to be formed for viewing following image retrieval by digital scanning, in the embodiments described above the color negative films of the invention have been described in terms of the most frequently selected components of color negative elements intended to be used for imagewise exposure of color print elements. Numerous alternative component selections are known and compatible with the practice of this invention.

Instead of employing dye-forming couplers, any of the conventional incorporated dye image generating compounds employed in multicolor imaging can be alternatively incorporated in the blue, green and red recording layer units. Dye images can be produced by the selective destruction, formation or physical removal of dyes as a function of exposure. For example, silver dye bleach processes are well known and commercially utilized for forming dye images by the selective destruction of incorporated image dyes. The silver dye bleach process is illustrated by *Research Disclosure*, Item 38957, X. Dye image formers and modifiers, A. Silver dye bleach.

It is also well known that preformed image dyes can be incorporated in blue, green and red recording layer units, the dyes being chosen to be initially immobile, but capable of releasing the dye chromophore in a mobile moiety as a function of entering into a redox reaction with oxidized developing agent. These compounds are commonly referred to as redox dye releasers (RDR's). By washing out the released mobile dyes, a retained dye image is created that can be scanned. It is also possible to transfer the released mobile dyes to a receiver, where they are immobilized in a mordant layer. The image-bearing receiver can then be scanned. Initially the receiver is an integral part of the color negative element. When scanning is conducted with the receiver remaining an integral part of the element, the receiver typically contains a transparent support, the dye image bearing mordant layer just beneath the support, and a white reflective layer just beneath the mordant layer. Where the receiver is peeled from the color negative element to facilitate scanning of the dye image, the receiver support can be reflective, as is commonly the choice when the dye image is intended to be viewed, or transparent, which allows transmission scanning of the dye image. RDR's as well as dye image transfer systems in which they are incorporated are described in *Research Disclosure*, Vol. 151, November 1976, Item 15162.

It is also recognized that the dye image can be provided by compounds that are initially mobile, but are rendered immobile during imagewise development. Image transfer systems utilizing imaging dyes of this type have long been used in Polaroid ? dye image transfer systems. These and other image transfer systems compatible with the practice of the invention are disclosed in *Research Disclosure*, Vol. 176, December 1978, Item 17643, XXIII. Image transfer systems.

One of the advantages of incorporating a color negative element in an image transfer system is that processing solution handling during photographic processing is not required. A common practice is to encapsulate a developer in a pod. When the image transfer unit containing the pod is passed between pressure rollers, developing agent is released from the pod and distributed over the uppermost processing solution permeable layer of the film, followed by diffusion into the recording layer units.

Similar release of developer is possible in color negative elements according to the invention intended to form only a retained dye image. Prompt scanning at a selected stage of development can obviate the need for subsequent processing. For example, it is specifically contemplated to scan the film as it passes a fixed point after passing between a set of pressure (optionally heated) rollers to distribute developing agent for contact with the recording layer units. If silver coating coverages are low, as is feasible with low maximum density images and, particularly, dye image amplification systems [illustrated by *Research Disclosure*, Item 38957, XVIII. Chemical development systems, B. Color-specific processing systems, paragraphs (5) through (7)], the neutral density of developed silver need not pose a significant impediment to the scanning retrieval of dye image information.

It is possible to minimize or even eliminate reliance on bringing a processing agent into contact with the recording layer units for achieving development by relying on heat to accelerate or initiate processing. Color negative elements according to the invention contemplated for processing by heat can be elements, such as those containing i) an oxidation-reduction image-forming combination, such as described by Sheppard et al U.S. Pat. No. 1,976,302, Sorensen et al U.S. Pat. No. 3,152,904, Morgan et al U.S. Pat. No. 3,846,136; ii) at least one silver halide developing agent and an alkaline material and/or alkali release material, as described in Stewart et al U.S. Pat. No. 3,312,550, Yutzy et al U.S. Pat. No. 3,392,020; or iii) a stabilizer or stabilizer precursor, as described in Humphlett et al U.S. Pat. No. 3,301,678, Haist et al U.S. Pat. No. 3,531,285 and Costa et al U.S. Pat. No. 3,874,946. These and other silver halide photothermographic imaging systems that are compatible with the practice of this invention are also described in greater detail in *Research Disclosure*, Vol. 170, June 1978, Item 17029. More recent illustrations of silver halide photothermographic imaging systems that are compatible with this invention are illustrated by Levy et al UK 2,318,645, published Apr. 29, 1998, and Japanese Kokai (published application) 98/0133325, published May 22, 1998, and Ishikawa et al EPO 0 800 114 A2, published Oct. 8, 1997.

In the foregoing discussion the blue, green and red recording layer units are described as containing yellow, magenta and cyan image dye-forming couplers, respectively, as is conventional practice in color negative elements used for printing. The invention can be suitably applied to conventional color negative construction as illustrated. Color reversal film construction would take a similar form, with the exception that colored masking couplers would be absent; in preferred forms, development inhibitor releasing couplers would also be absent. In preferred embodiments, the color negative elements are intended for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half-peak bandwidth in any other convenient region of the spectrum, ranging from the near ultraviolet (300–400 nm) through the visible and through the near infrared (700–1200 nm), so long as the absorption half-peak bandwidths of the image dye in the layer units extend noncoextensive wavelength ranges. Preferably each image dye exhibits an absorption half-peak band width that extends over at least a 25 (most preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half peak bandwidth that lies in a different spectral region than the dye images of the other emulsion layers of the layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements of the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta$ log E) by doubling changes in density ($\Delta D$). Thus, gamma's as low as 1.0 or even 0.5 are contemplated and exposure latitudes of up to about 5.0 log E or higher are feasible.

A number of modifications of color negative elements have been suggested for accommodating scanning, as illustrated by *Research Disclosure*, Item 38957, XIV. Scan facilitating features. These systems to the extent compatible with the color negative element constructions described above are contemplated for use in the practice of this invention. The retained silver and reflective (including fluorescent) interlayer constructions of paragraph (1) are not preferred. The features of paragraphs (2) and (3) are generally compatible with the preferred forms of the invention.

To avoid burdensome repetition of what is well known to those skilled in the art, this disclosure extends to the publications cited above (including the further publications therein identified) to show features compatible with the practice of the invention.

The invention is applicable to conventional color negative film or color reversal film constructions. The spectral sensitivities can also be employed in photothermographic elements, and in particular, camera speed photothermographic elements as known in the art. Specific examples of multicolor photothermographic elements are described by Levy et al. In U.S. patent application Ser. No. 08/740,110, filed Oct. 28, 1996, by Ishikawa et al in European Patent Application EP 0, 762,201 A1, and by Asami in U.S. Pat. No. 5,573,560, the disclosures of which are both incorporated by reference. The invention is also applicable to image transfer photothermographic elements such as disclosed in Ishikawa et al European Patent Application EP 0 800 114 A2. In a preferred embodiment, contrary to conventional color negative film constructions, RU, GU and BU are each substantially free of colored masking coupler. Preferably the layer units each contain less than 0.05 (most preferably less than 0.01) millimole/$m^2$ of colored masking coupler. No colored masking coupler is required in the color negative elements of this invention.

Development inhibitor releasing compound is incorporated in at least one and, preferably, each of the layer units in color negative film forms of the invention. DIR's are commonly employed to improve image sharpness and to tailor dye image characteristic curve shapes. The DIR's contemplated for incorporation in the color negative elements of the invention can release development inhibitor moieties directly or through intermediate linking or timing groups. The DIR's are contemplated to include those that employ anchimeric releasing mechanisms. Illustrations of development inhibitor releasing couplers and other compounds useful in the color negative elements of this invention are provided by *Research Disclosure*, Item 38957, cited above, X. Dye image formers and modifiers, C. Image dye modifiers, particularly paragraphs (4) to (11).

The layer unit comprised of the green sensitive emulsion of the invention is preferably subdivided into at least two, and more preferably three or more sub-unit layers. It is preferred that all light sensitive silver halide emulsions in the color recording unit have spectral sensitivity in the same region of the visible spectrum, that is, the green region. In this embodiment, while all silver halide emulsions incorporated in the unit have green spectral absorptance according to invention, it is expected that there are minor differences in spectral absorptance properties between them. In still more preferred embodiments, the sensitizations of the slower silver halide emulsions are specifically tailored to account for the green light shielding effects of the faster silver halide emulsions of the layer unit that reside above them, in order to provide an imagewise uniform spectral response by the photographic recording material as exposure varies with low to high light levels. Thus higher proportions of green light absorbing spectral sensitizing dyes may be desirable in the slower emulsions of the subdivided layer unit. It is also contemplated, however, that mixtures of conventional green sensitized silver halide emulsion and the green sensitized silver halide emulsion of the invention can be employed together within the same layer unit: in this circumstance, it is preferred that the most sensitive emulsion bear the green spectral sensitization of the invention and be located nearest the source of exposing radiation, while any slower emulsions provide green or other spectral responsivities and be located nearer the support and farther from the incident exposing radiation.

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichiometric amount, based on silver. The function of the highest speed emulsion layer is to create the portion of the characteristic curve just above the minimum density—i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

EXAMPLES

The invention can be better appreciated by reference to the following specific embodiments. All coating coverages are reported in parentheses in terms of g/m2, except as otherwise indicated. Silver halide coating coverages are reported in terms of silver.

| Glossary of Acronyms | |
|---|---|
| HBS-1 | Tritolyl phosphate |
| HBS-2 | Di-n-butyl phthalate |

-continued

| Glossary of Acronyms | |
|---|---|
| HBS-3 | Tris(2-ethylhexyl)phosphate |
| HBS-4 | Di-n-butyl sebacate |
| HBS-5 | N,N-Diethyl lauramide |
| HBS-6 | 1,4-Cyclohexylenedimethylene bis(2-ethylhexanoate) |
| H-1 | Bis(vinylsulfonyl)methane |
| ST-1 | 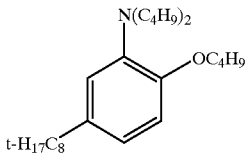 |

C-1

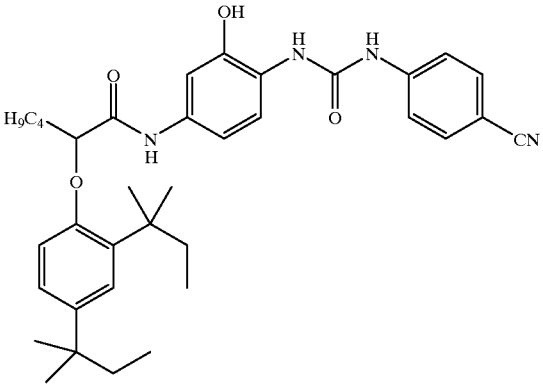

C-2

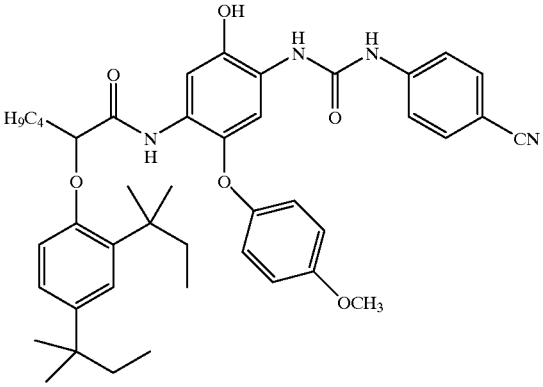

-continued
M-1
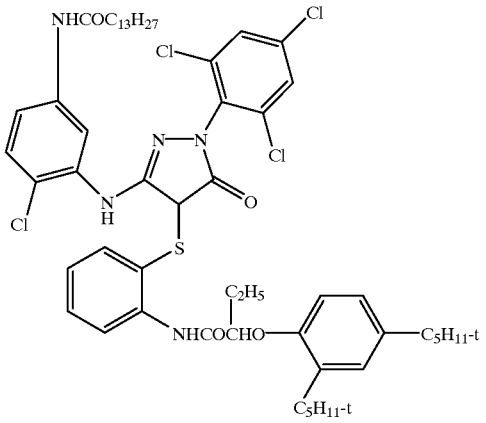
Y-1
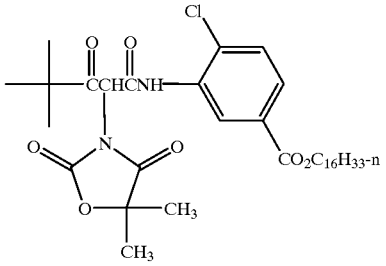
D-1
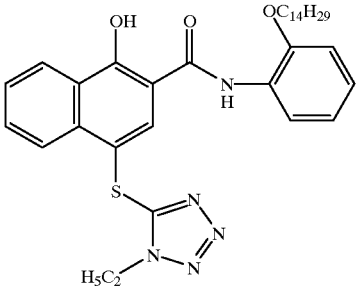
D-2
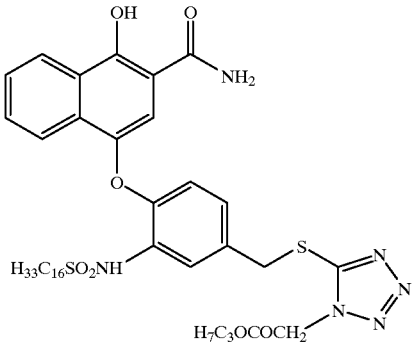

-continued
MM-1
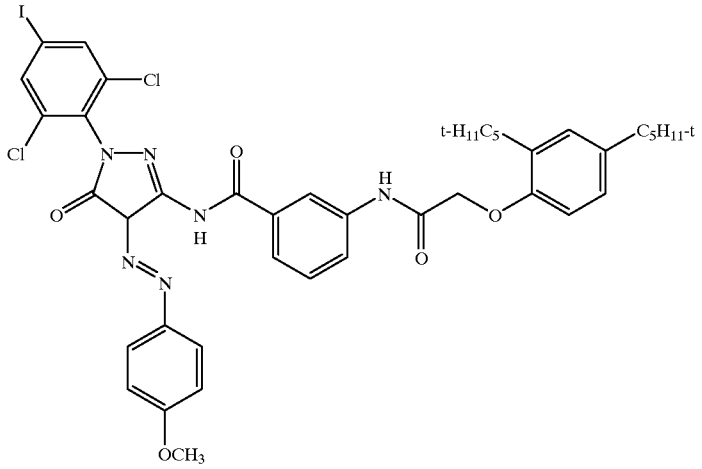
MD-1
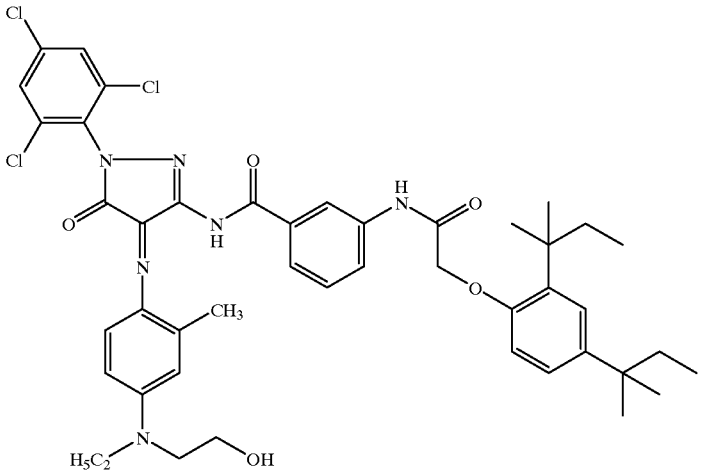
CD-1
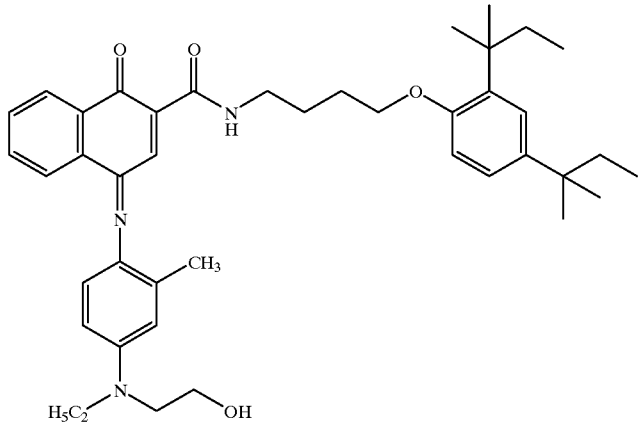

-continued
B-1
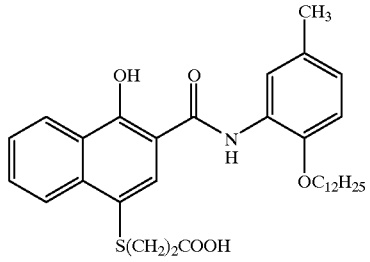
YD-1
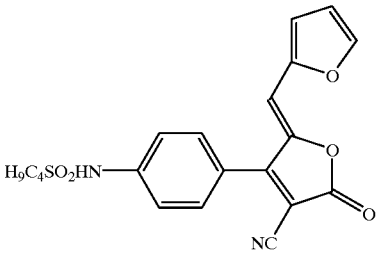
UV-1
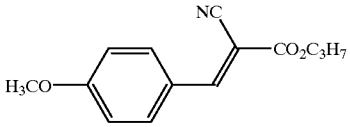
UV-2
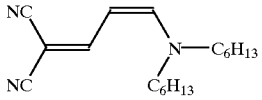
S-1
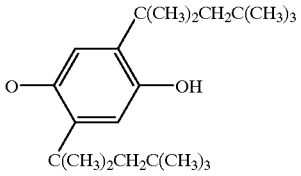
S-2
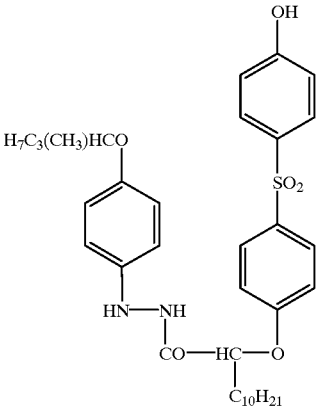

-continued
SSD-1
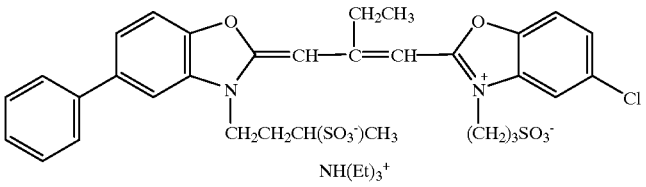
SSD-2
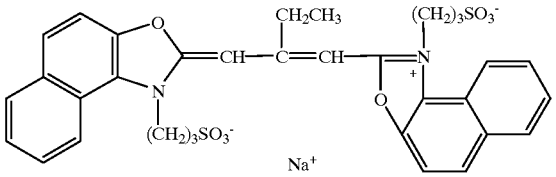
SSD-3
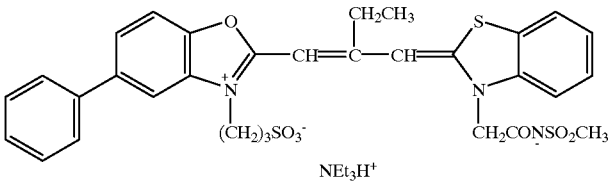
SSD-4
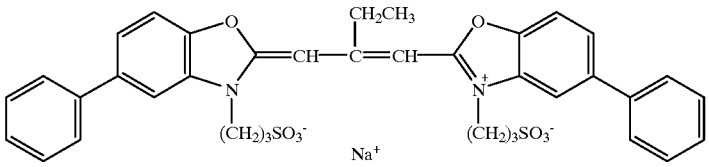
SSD-5
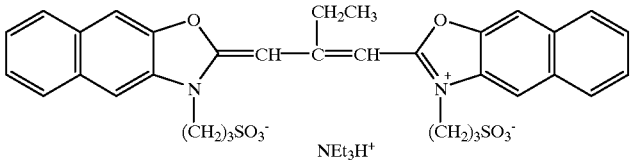
SSD-6
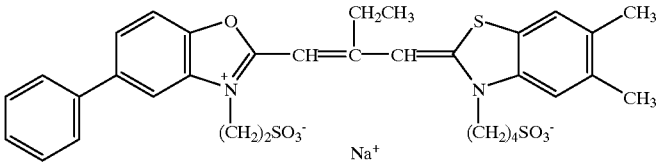
SSD-7
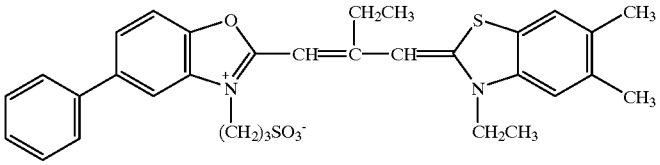
SSD-8
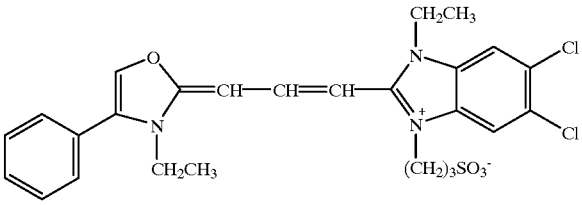

-continued
SSD-9
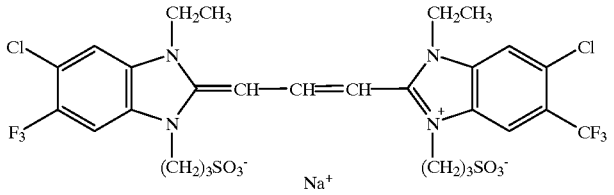
SSD-10
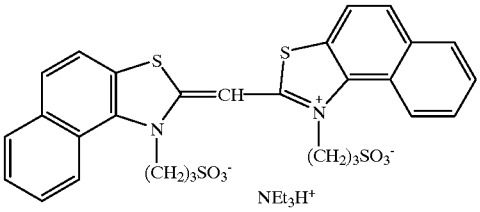
SSD-11
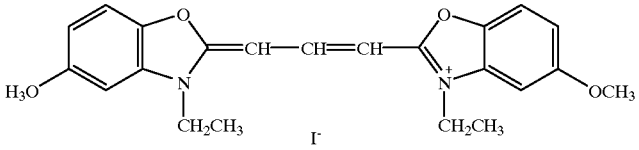
SSD-12
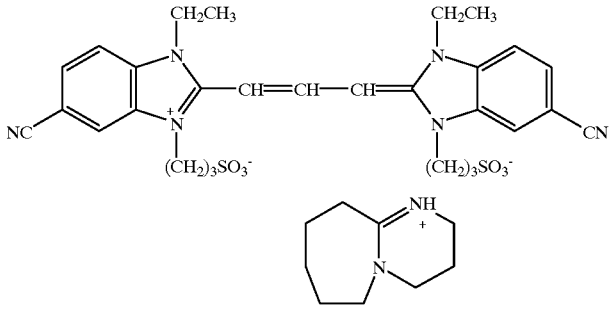
SSD-13
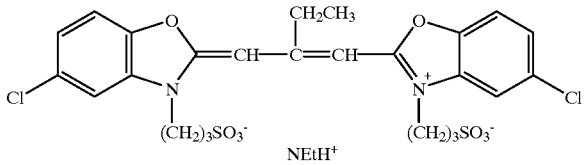
SSD-14
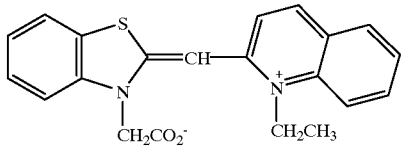
SSD-15
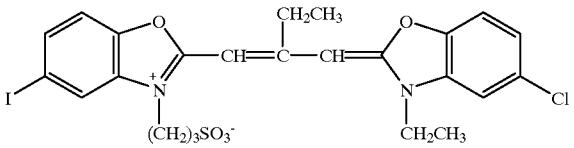

-continued
SSD-16
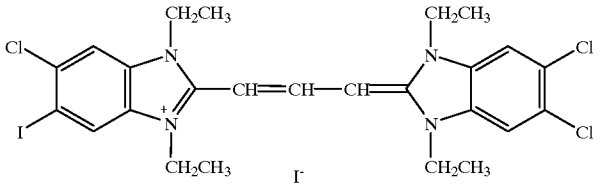
SSD-17
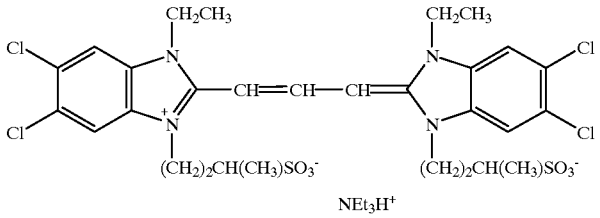
SSD-18
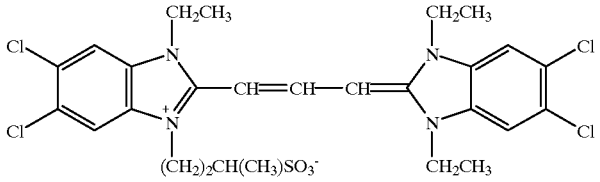
SSD-19
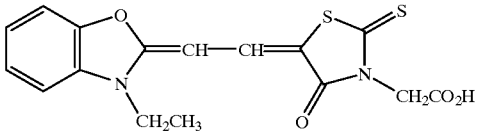
SSD-20
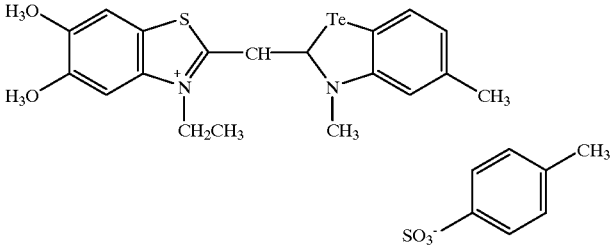
SSD-21
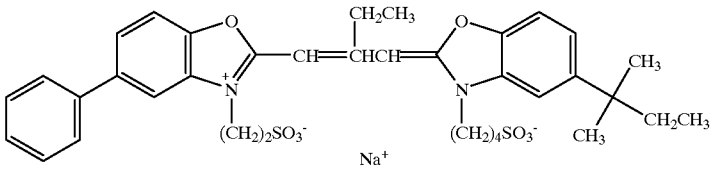
XSD-1
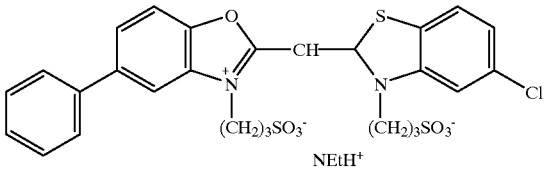

-continued

XSD-2

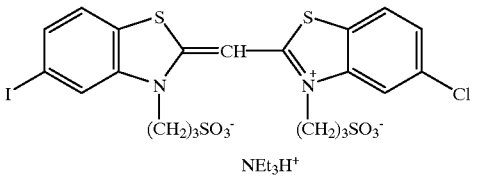

XSD-3

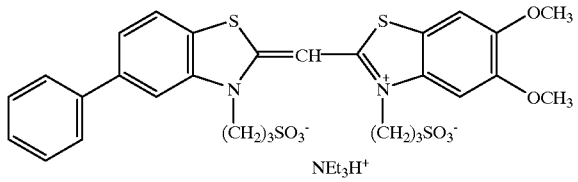

XSD-4

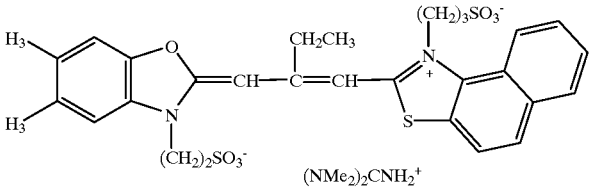

XSD-5

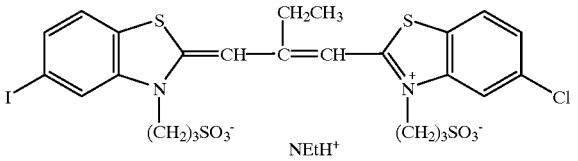

XSD-6

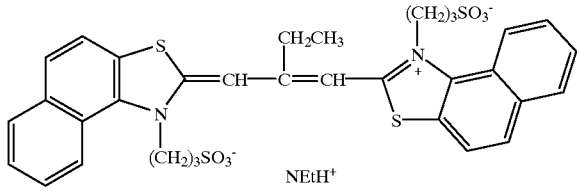

XSD-7

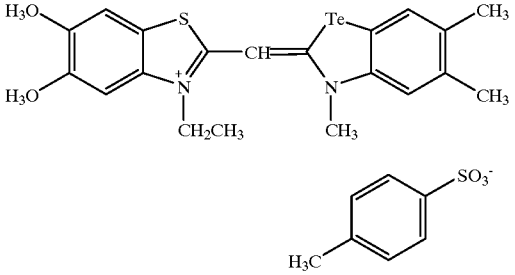

EXAMPLE I

COMPONENT PROPERTIES

Photographic samples 101 through 144 were prepared. For all samples except sample 103 a silver iodobromide tabular grain, emulsion A, with an iodide content of 3.8 mole percent, based on silver, was used. The mean equivalent circular diameter of the emulsion was 2.5 μm, the average thickness of the tabular grains was 0.12 μm, and the average aspect ratio of the tabular grains was 20.8. Tabular grains accounted for greater than 90% of the total grain projected area. Sample 103 used a silver iodobromide tabular grain, emulsion B, with an iodide content of 3.6 mole percent, based on silver. The mean equivalent circular diameter of the emulsion was 1.5 μm, the average thickness of the tabular grains was 0.29 μm, and the average aspect ratio of the tabular grains was 5.2, and tabular grains accounted for greater than 90% of the total grain projected area.

Emulsion A was sensitized using sodium thiocyanate at 100 mg/mole of silver, 0.90 mmole of spectral sensitizing dye per mole of silver, sodium aurous(I) dithiosulfate dihydrate at 2.2 mg/mole of silver, sodium thiosulfate pentahydrate at 1.1 mg/mole of silver, and 3-(N-methylsulfonyl) carbamoyl-ethylbenzothiazolium tetrafluoroborate at 45 mg/mole of silver. Following the chemical additions the emulsion was subjected to a heat treatment at 62.5 ° C. for 20 minutes as is common in the art.

Emulsion B was sensitized using sodium thiocyanate at 100 mg/mole of silver, 0.52 mmole of spectral sensitizing dye per mole of silver, sodium aurous(I) dithiosulfate dihydrate at 1.39 mg/mole of silver, sodium thiosulfate pentahydrate at 0.69 mg/mole of silver, and 3-(N-methylsulfonyl) carbamoyl-ethylbenzothiazolium tetrafluoroborate at 25 mg/mole of silver. Following the chemical additions the emulsion was subjected to a heat treatment at 62.5 ° C. for 11 minutes as is common in the art.

The sensitizing dyes used for the spectral sensitization are given in Table 1-1. The multiple dye sensitizations were accomplished by either adding the dyes simultaneously, as two separate additions of two dye mixtures (sets of dyes added together are given in parentheses), or each dye added separately in the order shown. Multiple dye sensitizations were accomplished by simultaneously adding the dyes to the emulsion during sensitization, and the dyes were first co-dissolved in methanol solution prior to addition to the emulsion or co-dissolved in a water and gelatin mixture prior to addition to the emulsion.

TABLE 1-1

| Sample Number (Inventive/ Comparative) | Method of Dye Addition | Dyes Used | Mole Ratio of Dye Component | Figure Number |
|---|---|---|---|---|
| 101 (Inv) | one dye alone/ three dyes mixed | SD-2/ (SSD-1 SSD-9 SSD-3) | 25/ (48.4 15 11.6) | 1A |
| 102 (Inv) | separately | SD-2 SSD-1 SSD-9 SSD-3 | 30 40 17 13 | 1B |
| 103 (Inv) | (two dyes mixed)/ (two dyes/ mixed) | (SD-3 SSD-1) (SSD-2/ SSD-3) | (39.4 39.4) (13.4 7.8) | 1C |
| 104 (Inv) | mixed | SD-2 SSD-1 SSD-9 SSD-3 | 25 48.4 15 11.6 | 1D |
| 105 (Inv) | (two dyes mixed)/ (two dyes/ mixed) | (SD-3 SSD-1) (SSD-2/ SSD-3) | (32.5 32.5) (20 15) | 1E |
| 106 (Inv) | (two dyes mixed)/ (two dyes/ mixed) | (SD-3 SSD-1) (SSD-2/ SSD-3) | (39.4 39.4) (13.4 7.8) | 1F |
| 107 (Inv) | (two dyes mixed)/ (two dyes/ mixed) | (SD-3 SSD-1) (SSD-2/ SSD-3) | (20 45) (20 15) | 1G |
| 108 (Inv) | mixed | SD-1 SSD-1 SSD-2 SSD-3 | 15 50 20 15 | 1H |
| 109 (Inv) | mixed | SD-1 SSD-1 SSD-2 SSD-3 | 20 50 20 10 | 1I |
| 110 (Inv) | separately | SD-2 SSD-1 SSD-9 SSD-3 | 25 48.4 15 11.6 | 1J |
| 111 (Inv) | separately | SD-2 SSD-1 SSD-9 SSD-3 | 25 50 16 9 | 1K |
| 112 (Comp) | mixed | SSD-4 SSD-5 | 65 35 | 1L |
| 113 (Comp) | mixed | SSD-6 SSD-1 | 16.7 83.3 | 1M |

TABLE 1-1-continued

| Sample Number (Inventive/ Comparative) | Method of Dye Addition | Dyes Used | Mole Ratio of Dye Component | Figure Number |
|---|---|---|---|---|
| 114 (Comp) | mixed | SSD-7 SSD-1 | 16.7 83.3 | 1N |
| 115 (Comp) | mixed | SSD-7 SSD-5 SSD-1 | 6 20 74 | 1O |
| 116 (Comp) | mixed | SSD-7 SSD-2 SSD-1 | 6 20 74 | 1P |
| 117 (Comp) | mixed | SSD-8 SSD-1 SSD-7 | 42.9 42.9 14.2 | 1Q |
| 118 (Comp) | mixed | SSD-21 SSD-1 SSD-7 | 55.6 33.3 11.1 | 1R |
| 119 (Comp) | mixed | SSD-21 SSD-1 SSD-7 | 68.6 28.6 2.8 | 1S |
| 120 (Comp) | mixed | SSD-10 SSD-1 SSD-7 | 62.9 28.6 8.5 | 1T |
| 121 (Comp) | mixed | SSD-21 SSD-1 SSD-7 | 62.9 28.6 8.5 | 1U |
| 122 (Comp) | mixed | SSD-21 SSD-6 | 83.3 16.7 | 1V |
| 123 (Comp) | mixed | SSD-21 SSD-7 | 83.3 16.7 | 1W |
| 124 (Comp) | mixed | SSD-21 SSD-1 SSD-7 | 20 70 10 | 1X |
| 125 (Comp) | mixed | SSD-1 SSD-6 SSD-5 | 80 15.4 4.5 | 1Y |
| 126 (Comp) | mixed | SSD-1 SSD-7 SSD-5 | 80 15.4 4.6 | 1Z |
| 127 (Comp) | mixed | SSD-1 SSD-7 SSD-2 | 80 15.4 4.6 | 2A |
| 128 (Comp) | mixed | SSD-4 SSD-11 | 33 67 | 2B |
| 129 (Comp) | mixed | SSD-12 SSD-4 SSD-5 SSD-13 | 8.1 50.4 40.3 1.2 | 2C |
| 130 (Comp) | mixed | SSD-5 SSD-4 SSD-14 | 12.5 62.5 25 | 2D |
| 131 (Comp) | mixed | SSD-5 SSD-4 SSD-15 | 31.3 56.3 12.4 | 2E |
| 132 (Comp) | mixed | SSD-13 SSD-16 | 83 17 | 2F |
| 133 (Comp) | mixed | SSD-13 SSD-16 | 75 25 | 2G |
| 134 (Comp) | mixed | SSD-13 SSD-17 SSD-1 | 65.8 21 13.2 | 2H |
| 135 (Comp) | mixed | SSD-1 SSD-17 SSD-7 | 68.5 27.4 4.1 | 2I |
| 136 (Comp) | mixed | SSD-1 SSD-17 SSD-7 SSD-18 | 27.8 27.8 2.8 41.6 | 2J |
| 137 (Comp) | mixed | SSD-19 SSD-1 SSD-20 | 23.6 38.2 38.2 | 2K |
| 138 (Comp) | mixed | SSD-19 SSD-1 SSD-20 | 25 45 30 | 2L |
| 139 (Comp) | mixed | SSD-2 SSD-13 | 65 35 | 2M |

TABLE 1-1-continued

| Sample Number (Inventive/ Comparative) | Method of Dye Addition | Dyes Used | Mole Ratio of Dye Component | Figure Number |
|---|---|---|---|---|
| 140 (Comp) | mixed | SSD-2 | 35 | 2N |
| | | SSD-13 | 65 | |
| 141 (Comp) | mixed | SSD-21 | 100 | 2O |
| 142 (Comp) | mixed | SSD-9 | 25 | 2P |
| | | SSD-1 | 75 | |
| 143 (Comp) | mixed | SSD-21 | 71.4 | 2Q |
| | | SSD-1 | 28.6 | |
| 144 (Comp) | mixed | SSD-4 | 67 | 2R |
| | | SSD-17 | 33 | |

A transparent film support of cellulose triacetate with conventional subbing layers was provided for coating. The side of the support to be emulsion coated received an undercoat layer of gelatin (4.9). The reverse side of the support was comprised of dispersed carbon pigment in a non-gelatin binder (Rem Jet).

The coatings were prepared by applying the following layers in the sequence set out below to the support. Hardener H-1 was included at the time of the coating at 1.80 percent by weight of total gelatin, including the undercoat, but excluding the previously hardened gelatin subbing layer forming a part of the support. Surfactant was also added to the various layers as is commonly practiced in the art.

| Layer 1: Light-Sensitive Layer | |
|---|---|
| Sensitized Emulsion silver | (1.08) |
| Cyan dye forming coupler C-1 | (0.97) |
| HBS-2 | (0.97) |
| Gelatin | (3.23) |
| TAI | (0.017) |

| Layer 2: Gelatin Overcoat | |
|---|---|
| Gelatin | (4.30) |

The dispersed carbon pigment on the back of the coating was removed with methanol. The light transmittance and reflectance of the sample was measured using a spectrophotometer over the visible light range (360 to 700 nanometers) at two nanometer wavelength increments. The total reflectance (R) is the fraction of light reflected from the coating, measured with an integrating sphere which includes all light exiting the coating regardless of angle. The total transmittance (T) is the fraction of light transmitted through the coating regardless of angle. The total absorptance (A) of the coating is determined from the measured total reflectance and total transmittance using the equation A=1−T−R. FIGS. 1A through 2R show the absorption of Samples 101 through 144, respectively (see Table 1-1), in the dashed line.

These data represent the absorption of the sensitizing dyes as adsorbed onto the grain surface as well as the intrinsic absorption of the silver halide emulsion. In order to separate the intrinsic absorption of the emulsion from the absorption due to the spectral sensitizing dye, coatings were prepared and evaluated as for this example of the unsensitized emulsion. The intrinsic absorption from these coatings was subtracted from the coatings (samples 101 through 144) containing sensitizing dye.

FIGS. 1A through 2R show the absorption due to the sensitizing dye absorption in solid lines.

The wavelength of peak light absorption and the half-peak bandwidth of the light absorption (difference in wavelengths at which absorptance is half of the peak value, bandwidth at 50% dye absorptance) were then determined from the sensitizing dye absorptance data. These data are tabulated in Table 1-2. The bandwidth at 80 percent absorption is also tabulated. The ratio of the dye absorptance at 520 nm, 550 nm, and 560 nm to the peak dye absorptance were calculated and are tabulated in Table 1-2.

This example illustrates examples of the invention, with peak dyed absorptance between 520 and 560 nm, an absorption bandwidth at 50% of the peak dyed absorptance of greater or equal to 50 nm, and absorption bandwidth at 80% of the peak dyed absorptance of greater than or equal to 27 nm, a ratio of the A560 to A λmax greater than or equal to 0.40, a ratio of the A550 to A λmax greater than or equal to 0.60, and a ratio of the A520 to A λmax greater than or equal to 0.55. Examples of the invention are uniquely broad, with substantial absorption in both the short and long green region of the spectrum. It demonstrates these properties using multiple dyes, including a sensitizing dye which alone absorbs in the short green region of the spectrum.

TABLE 1-2

| Sample Number (Inventive/ Comparative) | λ of Maximum Dye Absorption (nm) | Bandwidth at 80% Dye Absorption (nm) | Bandwidth at 50% Dye Absorption (nm) | $A_{520}/A_{\lambda max}$ | $A_{550}/A_{\lambda max}$ | $A_{560}/A_{\lambda max}$ |
|---|---|---|---|---|---|---|
| 101 (Inv) | 528 | 45 | 74 | 0.82 | 0.84 | 0.84 |
| 102 (Inv) | 528 | 28 | 67 | 0.79 | 0.77 | 0.66 |
| 103 (Inv) | 540 | 30 | 74 | 0.76 | 0.87 | 0.72 |
| 104 (Inv) | 538 | 38 | 70 | 0.73 | 0.92 | 0.82 |
| 105 (Inv) | 540 | 48 | 85 | 0.78 | 0.89 | 0.85 |
| 106 (Inv) | 540 | 29 | 74 | 0.77 | 0.84 | 0.71 |
| 107 (Inv) | 544 | 36 | 80 | 0.68 | 0.91 | 0.83 |
| 108 (Inv) | 558 | 43 | 73 | 0.69 | 0.96 | 0.99 |
| 109 (Inv) | 538 | 42 | 74 | 0.74 | 0.95 | 0.91 |
| 110 (Inv) | 530 | 29 | 69 | 0.80 | 0.79 | 0.63 |
| 111 (Inv) | 530 | 30 | 67 | 0.81 | 0.79 | 0.61 |
| 112 (Comp) | 548 | 28 | 47 | 0.47 | 1.00 | 0.98 |
| 113 (Comp) | 542 | 15 | 48 | 0.49 | 0.57 | 0.49 |
| 114 (Comp) | 542 | 15 | 53 | 0.51 | 0.77 | 0.60 |
| 115 (Comp) | 550 | 24 | 70 | 0.52 | 1.00 | 0.81 |
| 116 (Comp) | 544 | 20 | 47 | 0.52 | 0.91 | 0.62 |
| 117 (Comp) | 542 | 16 | 58 | 0.55 | 0.70 | 0.60 |
| 118 (Comp) | 536 | 23 | 81 | 0.77 | 0.59 | 0.51 |
| 119 (Comp) | 534 | 24 | 69 | 0.82 | 0.42 | 0.22 |
| 120 (Comp) | 530 | 24 | 75 | 0.89 | 0.46 | 0.50 |
| 121 (Comp) | 536 | 26 | 70 | 0.81 | 0.52 | 0.42 |
| 122 (Comp) | 530 | 53 | 72 | 0.93 | 0.35 | 0.28 |
| 123 (Comp) | 530 | 52 | 116 | 0.94 | 0.56 | 0.61 |
| 124 (Comp) | 542 | 15 | 40 | 0.54 | 0.67 | 0.45 |
| 125 (Comp) | 544 | 16 | 48 | 0.49 | 0.86 | 0.62 |
| 126 (Comp) | 544 | 29 | 42 | 0.47 | 0.86 | 0.56 |
| 127 (Comp) | 544 | 17 | 46 | 0.50 | 0.83 | 0.58 |
| 128 (Comp) | 546 | 19 | 67 | 0.66 | 0.91 | 0.37 |
| 129 (Comp) | 564 | 23 | 45 | 0.42 | 0.84 | 0.98 |
| 130 (Comp) | 544 | 16 | 35 | 0.47 | 0.88 | 0.42 |
| 131 (Comp) | 550 | 25 | 44 | 0.46 | 1.00 | 0.92 |
| 132 (Comp) | 546 | 10 | 24 | 0.32 | 0.82 | 0.36 |
| 133 (Comp) | 544 | 12 | 33 | 0.37 | 0.85 | 0.56 |
| 134 (Comp) | 544 | 32 | 55 | 0.14 | 0.90 | 0.89 |
| 135 (Comp) | 562 | 37 | 61 | 0.56 | 0.94 | 1.00 |
| 136 (Comp) | 574 | 3 | 26 | 0.28 | 0.43 | 0.60 |
| 137 (Comp) | 542 | 10 | 25 | 0.45 | 0.49 | 0.11 |
| 138 (Comp) | 542 | 11 | 27 | 0.46 | 0.57 | 0.12 |
| 139 (Comp) | 558 | 20 | 62 | 0.61 | 0.88 | 0.98 |
| 140 (Comp) | 554 | 25 | 62 | 0.62 | 0.97 | 0.90 |
| 141 (Comp) | 530 | 53 | 70 | 0.91 | 0.20 | 0.01 |
| 142 (Comp) | 550 | 18 | 38 | 0.45 | 1.00 | 0.63 |

TABLE 1-2-continued

| Sample Number (Inventive/ Comparative) | λ of Maximum Dye Absorption (nm) | Bandwidth at 80% Dye Absorption (nm) | Bandwidth at 50% Dye Absorption (nm) | $A_{520}/A_{\lambda max}$ | $A_{550}/A_{\lambda max}$ | $A_{560}/A_{\lambda max}$ |
|---|---|---|---|---|---|---|
| 143 (Comp) | 534 | 23 | 68 | 0.78 | 0.37 | 0.04 |
| 144 (Comp) | 564 | 32 | 50 | 0.45 | 0.86 | 0.95 |

EXAMPLE II

Color Negative Subdivided Unit Element Properties

Red light sensitive emulsions

Silver iodobromide tabular grain emulsions EC-01, EC-02, EC-03, EC-04, and EC-05 were provided having the significant grain characteristics set out in Table 2-1 below. Tabular grains accounted for greater than 70 percent of total grain projected area in all instances. Each of Emulsions EC-01 through EC-05 were optimally sulfur and gold sensitized. In addition, these emulsions were optimally spectrally sensitized with SD-08, SD-07, SD-09, SD-10, and SD-11 in a 40:31:18 7:4 molar ratio. The wavelength of peak light absorption for all emulsions was around 570 nm, and the half-peak absorption bandwidth was around 100 nm.

TABLE 2-1

| Emulsion size and iodide content | | | | |
|---|---|---|---|---|
| Emulsion | Average grain ECD (μm) | Average grain thickness, (μm) | Average Aspect Ratio | Average Iodide Content (mol %) |
| EC-01 | 2.20 | 0.12 | 18.3 | 3.9 |
| EC-02 | 1.30 | 0.10 | 13.0 | 3.7 |
| EC-03 | 0.90 | 0.12 | 7.5 | 3.7 |
| EC-04 | 0.52 | 0.12 | 4.3 | 3.7 |
| EC-05 | 0.57 | 0.07 | 8.1 | 1.3 |

Green light-sensitive emulsions

Silver iodobromide tabular grain emulsions EM-01, EM-02, EM-03, and EM-04 were provided having the significant grain characteristics set out in 2-2 below. Tabular grains accounted for greater than 70 percent of total grain projected area in all instances. Each of Emulsions EM-01 through EM-04 were optimally sulfur and gold sensitized. In addition, emulsions EM-01 and EM-02 were optimally spectrally sensitized with SD-04, SD-05, SD-06, and SD-07 in a 39.4:39.4:13.4:7.8 molar ratio. Emulsions EM-03 and EM-04 were optimally spectrally sensitized with SD-04, SD-05, SD-06, and SD-07 in a 32.5:32.5:20:15 molar ratio. The wavelength of peak light absorption for all emulsions was around 540 nm, and the half-peak absorption bandwidth was around 75 nm. Substantial absorption was provided at 520, 550, and 560 nm.

TABLE 2-2

| Emulsion size and iodide content | | | | |
|---|---|---|---|---|
| Emulsion | Average grain ECD (μm) | Average grain thickness, (μm) | Average Aspect Ratio | Average Iodide Content (mol %) |
| EM-01 | 1.50 | 0.29 | 5.2 | 3.6 |
| EM-02 | 1.60 | 0.24 | 6.7 | 3.6 |

TABLE 2-2-continued

| Emulsion size and iodide content | | | | |
|---|---|---|---|---|
| Emulsion | Average grain ECD (μm) | Average grain thickness, (μm) | Average Aspect Ratio | Average Iodide Content (mol %) |
| EM-03 | 0.90 | 0.12 | 7.5 | 3.7 |
| EM-04 | 0.57 | 0.07 | 8.1 | 1.3 |

Silver iodobromide tabular grain emulsions EM-05, EM-06, EM-07, and EM-08 were provided having the significant grain characteristics set out in Table 2-3 below. Tabular grains accounted for greater than 70 percent of total grain projected area in all instances. Each of emulsions EM-05 through EM-08 were optimally sulfur and gold sensitized. In addition, the emulsions EM-05 and EM-06 were optimally spectrally sensitized with SD-12, SD-05, and SD-13 in a 23.6:38.2:38.2 molar ratio. Emulsions EM-07 and EM-08 were optimally spectrally sensitized with SD-12, SD-05, and SD-14 in a 23.6:38.2:38.2 molar ratio. The wavelength of peak light absorption for all emulsions was around 542 nm, and the half-peak absorption bandwidth was around 25 nm.

TABLE 2-3

| Emulsion size and iodide content | | | | |
|---|---|---|---|---|
| Emulsion | Average grain ECD (μm) | Average grain thickness, (μm) | Average Aspect Ratio | Average Iodide Content (mol %) |
| EM-05 | 1.40 | 0.30 | 4.7 | 3.5 |
| EM-06 | 0.70 | 0.34 | 2.1 | 3.5 |
| EM-07 | 0.90 | 0.12 | 7.5 | 3.7 |
| EM-08 | 0.57 | 0.07 | 8.1 | 1.3 |

Blue light sensitive emulsions

Silver iodobromide tabular grain emulsions EY-01, EY-02, EY-03, EY-04, and EY-05 were provided having the significant grain characteristics set out in Table 2-4 below. Tabular grains accounted for greater than 70 percent of total grain projected area in all instances. Each of Emulsions EY-01 through EY-05 were optimally sulfur and gold sensitized. In addition, these emulsions were optimally spectrally sensitized with SD-01, SD-02, and SD-03 in a 49:31:20 molar ratio. The wavelength of peak light absorption for all emulsions was around 456 nm, and the half-peak dye absorption bandwidth was around 50 nm.

TABLE 2-4

| Emulsion size and iodide content | | | | |
|---|---|---|---|---|
| Emulsion | Average grain ECD (μm) | Average grain thickness, (μm) | Average Aspect Ratio | Average Iodide Content (mol %) |
| EY-01 | 4.10 | 0.13 | 31.5 | 3.7 |
| EY-02 | 2.20 | 0.12 | 18.3 | 3.9 |
| EY-03 | 1.30 | 0.10 | 13.0 | 3.7 |
| EY-04 | 0.52 | 0.12 | 4.3 | 3.7 |
| EY-05 | 0.57 | 0.07 | 8.1 | 1.3 |

COLOR NEGATIVE ELEMENT PROPERTIES

All coating coverages are reported in parenthesis in terms of g/m2, except as otherwise indicated. Silver halide coating coverages are reported in terms of silver.

The slower, mid-speed, and faster emulsion layers within each of the blue (BU), green (GU), and red (RU) recording layer units are indicated by the prefix S, M, and F, respectively.

Sample 201 (Invention)

This sample was prepared by applying the following layers in the sequence recited to a transparent film support of cellulose triacetate with conventional subbing layers, with the red recording layer unit coated nearest the support. The side of the support to be coated had been prepared by the application of gelatin subbing.

| Layer 1: AHU | |
|---|---|
| Black colloidal silver sol | (0.151) |
| UV-1 | (0.075) |
| UV-2 | (0.108) |
| Oxidized developer scavenger S-1 | (0.161) |
| Compensatory printing density cyan dye CD-1 | (0.016) |
| Compensatory printing density magenta dye MD-1 | (0.038) |
| Compensatory printing density yellow dye MM-1 | (0.178) |
| HBS-1 | (0.105) |
| HBS-2 | (0.341) |
| HBS-3 | (0.038) |
| HBS-6 | (0.011) |
| Disodium salt of 3,5-disulfocatechol | (0.228) |
| Gelatin | (2.044) |

Layer 2: SRU

This layer was comprised of a blend of a lower, medium, and higher (lower, medium, and higher grain ECD) sensitivity, red-sensitized tabular silver iodobromide emulsions.

| | |
|---|---|
| Emulsion EC-03, silver content | (0.430) |
| Emulsion EC-04, silver content | (0.215) |
| Emulsion EC-05, silver content | (0.269) |
| Bleach accelerator releasing coupler B-1 | (0.057) |
| Oxidized developer scavenger S-2 | (0.183) |
| Development inhibitor releasing coupler D-2 | (0.013) |
| Cyan dye forming coupler C-1 | (0.344) |
| Cyan dye forming coupler C-2 | (0.038) |
| HBS-2 | (0.026) |
| HBS-4 | (0.118) |
| HBS-5 | (0.120) |
| TAI | (0.015) |
| Gelatin | (1.679) |

Layer 3: MRU

| | |
|---|---|
| Emulsion EC-02, silver content | (1.076) |
| Bleach accelerator releasing coupler B-1 | (0.022) |
| Development inhibitor releasing coupler D-1 | (0.011) |
| Development inhibitor releasing coupler D-2 | (0.013) |
| Oxidized developer scavenger S-2 | (0.183) |
| Cyan dye forming coupler C-1 | (0.086) |
| Cyan dye forming coupler C-2 | (0.086) |
| HBS-1 | (0.044) |
| HBS-2 | (0.026) |
| HBS-4 | (0.097) |
| HBS-5 | (0.074) |
| TAI | (0.021) |
| Gelatin | (1.291) |

Layer 4: FRU

| | |
|---|---|
| Emulsion EC-01, silver content | (1.291) |
| Development inhibitor releasing coupler D-1 | (0.011) |
| Development inhibitor releasing coupler D-2 | (0.011) |
| Oxidized developer scavenger S-1 | (0.014) |

-continued

Layer 4: FRU

| | |
|---|---|
| Cyan dye forming coupler C-1 | (0.065) |
| Cyan dye forming coupler C-2 | (0.075) |
| HBS-1 | (0.044) |
| HBS-2 | (0.022) |
| HBS-3 | (0.021) |
| HBS-4 | (0.161) |
| TAI | (0.021) |
| Gelatin | (1.076) |

Layer 5: Interlayer

| | |
|---|---|
| Oxidized developer scavenger S-1 | (0.086) |
| HBS-3 | (0.129) |
| Gelatin | (0.538) |

Layer 6: SGU

This layer was comprised of a blend of a lower and higher (lower and higher grain ECD) sensitivity, green-sensitized tabular silver iodobromide emulsions.

| | |
|---|---|
| Emulsion EM-03, silver content | (0.323) |
| Emulsion EM-04, silver content | (0.215) |
| Bleach accelerator releasing coupler B-1 | (0.012) |
| Development inhibitor releasing coupler D-2 | (0.011) |
| Oxidized developer scavenger S-2 | (0.183) |
| Magenta dye forming coupler M-1 | (0.301) |
| Stabilizer ST-1 | (0.060) |
| HBS-1 | (0.241) |
| HBS-2 | (0.022) |
| HBS-5 | (0.061) |
| TAI | (0.004) |
| Gelatin | (1.108) |

Layer 7: MGU

| | |
|---|---|
| Emulsion EM-02, silver content | (0.968) |
| Bleach accelerator releasing coupler B-1 | (0.005) |
| Development inhibitor releasing coupler D-1 | (0.011) |
| Development inhibitor releasing coupler D-2 | (0.011) |
| Oxidized developer scavenger S-1 | (0.011) |
| Oxidized developer scavenger S-2 | (0.183) |
| Magenta dye forming coupler M-1 | (0.113) |
| Stabilizer ST-1 | (0.023) |
| HBS-1 | (0.133) |
| HBS-2 | (0.022) |
| HBS-3 | (0.016) |
| HBS-5 | (0.053) |
| TAI | (0.016) |
| Gelatin | (1.399) |

Layer 8: FGU

| | |
|---|---|
| Emulsion EM-01, silver content | (0.968) |
| Development inhibitor releasing coupler D-1 | (0.009) |
| Development inhibitor releasing coupler D-2 | (0.011) |
| Oxidized developer scavenger S-1 | (0.011) |
| Magenta dye forming coupler M-1 | (0.097) |
| Stabilizer ST-1 | (0.019) |
| HBS-1 | (0.112) |
| HBS-2 | (0.022) |

-continued

| Layer 8: FGU | |
|---|---|
| HBS-3 | (0.016) |
| TAI | (0.009) |
| Gelatin | (1.399) |

| Layer 9: Yellow Filter Layer | |
|---|---|
| Yellow filter dye YD-1 | (0.032) |
| Oxidized developer scavenger S-1 | (0.086) |
| HBS-3 | (0.129) |
| Gelatin | (0.646) |

| Layer 10: SBU<br>This layer was comprised of a blend of a lower, lower-medium, medium, and higher (lower, lower-medium, medium, and higher grain ECD) sensitivity, blue-sensitized tabular silver iodobromide emulsions. | |
|---|---|
| Emulsion EY-02, silver content | (0.323) |
| Emulsion EY-03, silver content | (0.247) |
| Emulsion EY-04, silver content | (0.215) |
| Emulsion EY-05, silver content | (0.269) |
| Bleach accelerator releasing coupler B-1 | (0.003) |
| Development inhibitor releasing coupler D-2 | (0.011) |
| Oxidized developer scavenger S-2 | (0.183) |
| Yellow dye forming coupler Y-1 | (0.710) |
| HBS-2 | (0.022) |
| HBS-4 | (0.151) |
| HBS-5 | (0.050) |
| TAI | (0.016) |
| Gelatin | (1.872) |

| Layer 11: FBU | |
|---|---|
| Emulsion EY-01, silver content | (0.699) |
| Bleach accelerator releasing coupler B-1 | (0.005) |
| Development inhibitor releasing coupler D-2 | (0.013) |
| Yellow dye forming coupler Y-1 | (0.140) |
| HBS-2 | (0.026) |
| HBS-4 | (0.118) |
| HBS-5 | (0.007) |
| TAI | (0.011) |
| Gelatin | (1.291) |

| Layer 12: Protective Overcoat Layer | |
|---|---|
| Polymethylmethacrylate matte beads | (0.005) |
| Soluble polymethylmethacrylate matte beads | (0.054) |
| Unsensitized silver bromide Lippmann emulsion | (0.215) |
| Dye UV-1 | (0.108) |
| Dye UV-2 | (0.216) |
| Silicone lubricant | (0.040) |
| HBS-1 | (0.151) |
| HBS-6 | (0.108) |
| Gelatin | (1.237) |

This film was hardened at the time of coating with 1.75% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

Sample 202 (Comparative control) color photographic recording material for color negative development was prepared exactly as above in Sample 101, except where noted below.

| Layer 6: SGU Changes | |
|---|---|
| Emulsion EM-03, silver content | (0.000) |
| Emulsion EM-04, silver content | (0.000) |
| Emulsion EM-07, silver content | (0.323) |
| Emulsion EM-08, silver content | (0.215) |

| Layer 7: MGU Changes | |
|---|---|
| Emulsion EM-02, silver content | (0.000) |
| Emulsion EM-06, silver content | (0.968) |

| Layer 8: FGU Changes | |
|---|---|
| Emulsion EM-01, silver content | (0.000) |
| Emulsion EM-05, silver content | (0.968) |

The sensitivities over the visible spectrum of the individual color units of the photographic recording materials, Samples 201–202, were determined in 5-nm increments using nearly monochromatic light of carefully calibrated output from 360 to 715 nm. Photographic recording materials Samples 201–202 were individually exposed for 1/100 of a second to white light from a tungsten light source of 3000K color temperature that was filtered by a Daylight Va filter to 5500K and by a monochromator with a 4-nm bandpass resolution through a graduated 0–4.0 density step tablet with 0.3-density step increments to determine their speed. The samples were then processed using the KODAK FLEXICOLOR™ C-41 Process, as described by *The British Journal of Photography Annual* of 1988, pp. 196–98. Another description of the use of the FLEXICOLOR™ process is provided by *Using Kodak Flexicolor Chemicals*, Kodak Publication No. Z-13 1, Eastman Kodak Company, Rochester, N.Y.

Following processing and drying, Samples 201–202 were subjected to Status M densitometry and their sensitometric performance over the visible spectrum was characterized. A set of speeds was generated by taking the Status M densitometry and transforming it to analytical densities using a 3×3 matrix treatment appropriate for the image dye set according to methods disclosed in Analytical density determination has been summarized in the *SPSE Handbook of photographic Science and Engineering*, W. Thomas, editor, John Wiley and Sons, New York, 1973, Section 15.3, Color Densitometry, pp. 840–848. The exposure required to produce an analytical density increase of 0.20 above Dmin was determined for the color recording units at each 5-nm increment exposed. The exposure distribution for each of the red, green and blue responsivities was normalized by dividing by its maximum sensitivity to convert each of the 5-nm sample sensitivities to relative sensitivities for plotting and parameter determination.

The spectral sensitivity response of the photographic recording materials was also used to determine the relative colorimetric accuracy of color negative materials Samples 201–202 in recording a particular diverse set of 200 different color patches according to the method disclosed by Giorgianni et al, in U.S. Pat. No. 5,582,961. The computed color error variance is included in Table 2-5. This error value relates to the color difference between the CIELAB space coordinates of the specified set of test colors and the space coordinates resulting from a specific transformation of the test colors as rendered by the film. In particular, the test patch input spectral reflectance values for a given light source are convolved with the sample photographic materials' spectral sensitivity response to estimate colorimetric recording capability. It should be noted that the computed color error is sensitive to the responses of all three input color records, and an improved response by one record may not overcome the responses of one or two other limiting color records. A color error difference of at least 1 unit corresponds to a significant difference in color recording accuracy.

Figure 3A:
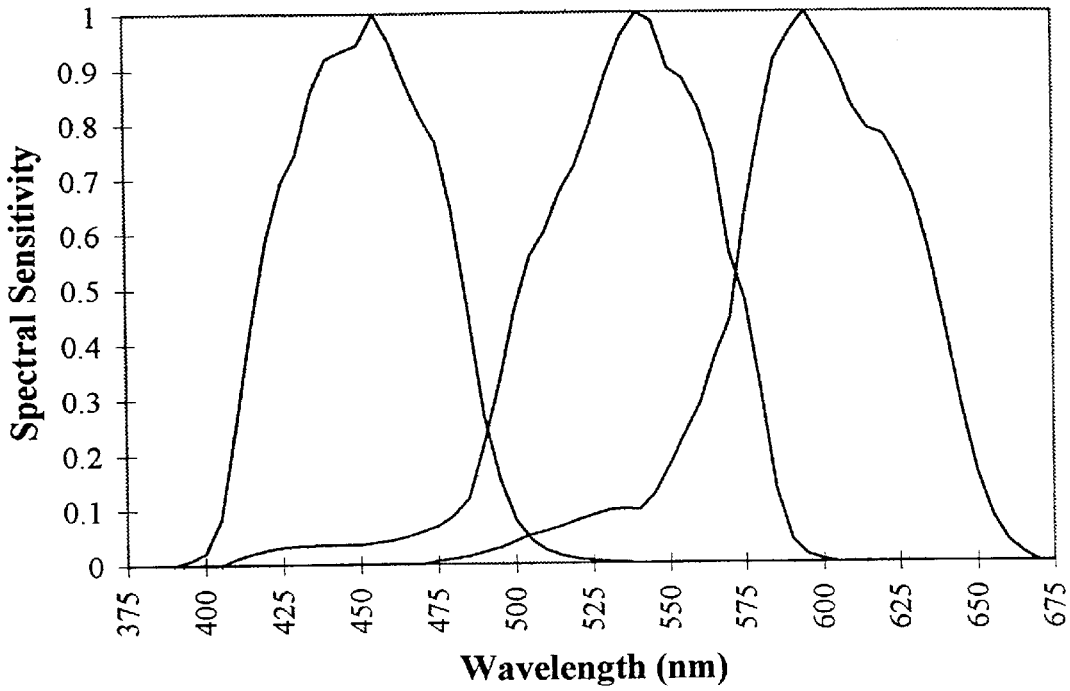
FIGS. 3A and 3B are multilayer sensitivity spectra for sample materials as described in Example II below.
Figure 3B:
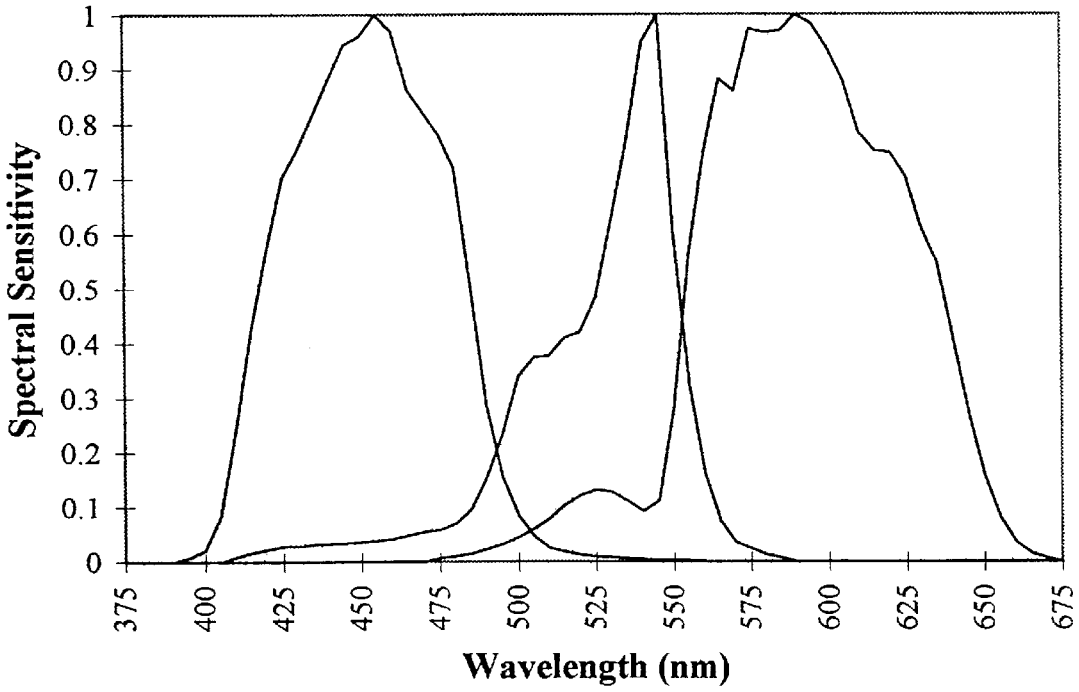

As can be seen from Table 2-5, when a green emulsion unit with relative sensitivity over all, 50%-maximum peak bandwidth of less than 50 nm, with relative sensitivity over all, 80%-maximum peak bandwidth of less than 27 nm, with 520-nm relative sensitivity of less than 55%, with 550-nm relative sensitivity of less than 60%, and with 560-nm relative sensitivity of less than 40% is employed, as in comparative control Sample 102 a quite substantial color error of 12 resulted. This high color error variance indicates quite significant metameric color failure at the time of capture of the scene light exposures. Only when all of the requirements of the invention are met simultaneously does a marked reduction in color error variance occur which is indicative of much higher color recording fidelity (e.g. inventive Sample 101). The use of the more hypsochromic, broad green spectral sensitivity produced calorimetrically accurate recording when used with the identical red and blue recording units as comparative control Sample 102, however. Sample 101, representing a preferred embodiment of the invention, was much better suited for providing image records of the incident scene light for electronic image processing into viewable form which had significantly reduced metameric color failure or fewer artifacts due to illuminant metamerism. The relative sensitivity spectra of Samples 101 and 102 are shown in Figs. FIGS. 3A and 3B, respectively.

TABLE 2-5

Multicolor recording material spectral sensitivity

| Sample | RU emulsion sensitivity λmax (nm) | GU emulsion sensitivity λmax (nm) | BU emulsion sensitivity λmax (nm) | GU emulsion relative sensitivity half-peak bandwidth (nm) | GU emulsion relative sensitivity 80%-peak bandwidth (nm) | GU emulsion relative sensitivity at 520 nm (%) | GU emulsion relative sensitivity at 550 nm (%) | GU emulsion relative sensitivity at 560 nm (%) | Capture Color Error |
|---|---|---|---|---|---|---|---|---|---|
| 101 (Inv) | 596 | 540 | 457 | 73 | 38 | 72 | 90 | 83 | 2.7 |
| 102 (Comp) | 592 | 546 | 458 | 27 | 12 | 42 | 60 | 16 | 12.0 |

The invention has been described in detail with particular reference to preferred embodiments thereof, but it will be understood that variations and modifications can be effected within the spirit and scope of the invention.

What is claimed is:

1. A photographic element for accurately recording a scene as an image comprising a support and coated on the support a plurality of hydrophilic colloid layers comprising radiation-sensitive silver halide emulsion layers forming recording layer units for separately recording blue, green and red exposures wherein, the green recording layer unit comprises at least one green sensitive emulsion having:

(i) a peak dyed absorptance of between 520 and 560 nm, (ii) an absorption bandwidth at 50% of the peak dyed absorptance greater than or equal to 50 nm, (iii) an absorption bandwidth at 80% of the peak dyed absorptance greater than or equal to 27 nm, (iv) a ratio of the absorptance at 560 nm to the peak dyed absorptance greater than or equal to 0.40, (v) a ratio of the absorptance at 550 nm to the peak dyed absorptance greater than or equal to 0.60, and (vi) a ratio of the absorptance at 520 nm to the peak dyed absorptance greater than or equal to 0.55.

2. A photographic element according to claim 1, wherein the green sensitive emulsion has a peak absorptance of between 522 and 558 nm.

3. A photographic element according to claim 1, wherein the green sensitive emulsion has a peak absorptance of between 524 and 556 nm.

4. A photographic element according to claim 1, wherein the green sensitive emulsion has an absorption bandwidth at 50% of the peak dyed absorptance greater than or equal to 53 nm.

5. A photographic element according to claim 1, wherein the green sensitive emulsion has an absorption bandwidth at 50% of the peak dyed absorptance greater than or equal to 55 nm.

6. A photographic element according to claim 1, wherein the green sensitive emulsion has an absorption bandwidth at 80% of the peak dyed absorptance greater than or equal to 29 nm.

7. A photographic element according to claim 1, wherein the green sensitive emulsion has an absorption bandwidth at 80% of the peak dyed absorptance greater than or equal to 30 nm.

8. A photographic element according to claim 1, wherein the green sensitive emulsion has a ratio of absorptance at 560 nm to the peak dyed absorptance greater than or equal to 0.42.

9. A photographic element according to claim 1, wherein the green sensitive emulsion has a ratio of absorptance at 560 nm to the peak dyed absorptance greater than or equal to 0.45.

10. A photographic element according to claim 1, wherein the green sensitive emulsion has a ratio of absorptance at 550 nm to the peak dyed absorptance greater than or equal to 0.62.

11. A photographic element according to claim 1, wherein the green sensitive emulsion has a ratio of absorptance at 550 nm to the peak dyed absorptance greater than or equal to 0.65.

12. A photographic element according to claim 1, wherein the green sensitive emulsion has a ratio of absorptance at 520 nm to the peak dyed absorptance greater than or equal to 0.58.

13. A photographic element according to claim 1, wherein the green sensitive emulsion has a ratio of absorptance at 520 nm to the peak dyed absorptance greater than or equal to 0.60.

14. A photographic element according to claim 1, wherein the green sensitive emulsion has:

(i) a peak dyed absorptance of between 522 and 558 nm, (ii) an absorption bandwidth at 50% of the peak dyed absorptance greater than or equal to 53 nm, (iii) an absorption bandwidth at 80% of the peak dyed absorptance greater than or equal to 29 nm, (iv) a ratio of the absorptance at 560 nm to the peak dyed absorptance greater than or equal to 0.42, (v) a ratio of the absorptance at 550 nm to the peak dyed absorptance greater than or equal to 0.62, and (vi) a ratio of the absorptance at 520 nm to the peak dyed absorptance greater than or equal to 0.58.

15. A photographic element according to claim 1, wherein the green sensitive emulsion has:

(i) a peak dyed absorptance of between 524 and 556 nm, (ii) an absorption bandwidth at 50% of the peak dyed absorptance greater than or equal to 55 nm, (iii) an absorption bandwidth at 80% of the peak dyed absorptance greater than or equal to 30 nm, (iv) a ratio of the absorptance at 560 nm to the peak dyed absorptance greater than or equal to 0.45, (v) a ratio of the absorptance at 550 nm to the peak dyed absorptance greater than or equal to 0.65, and (vi) a ratio of the absorptance at 550 nm to the peak dyed absorptance greater than or equal to 0.60.

16. A photographic element according to claim 1 or claim 15, wherein the green sensitive emulsion has been dyed with at least one dye that forms a J-aggregate between 500 nm and 540 nm.

17. A photographic element according to claim 1 or claims 15, wherein the green sensitive emulsion has been dyed with at least one green sensitizing dye of formula (I):

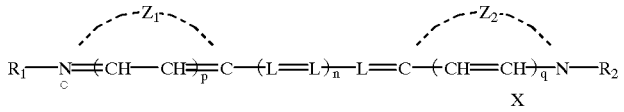

(I)

wherein each of $R_1$ and $R_2$ independently represents a substituted or unsubstituted alkyl group or substituted or unsubstituted aryl group; each of $Z_1$ and $Z_2$ independently represents the atoms necessary to complete a 5 or 6-membered heterocyclic ring system; each L is a substituted or unsubstituted methane group; each of p, q and n is independently 0 or 1; and X is a counterion as necessary to balance the charge.

18. A photographic element according to claim 1 or claim 15, wherein the green sensitive emulsion has been dyed with at least one green sensitizing dye of formula (II):

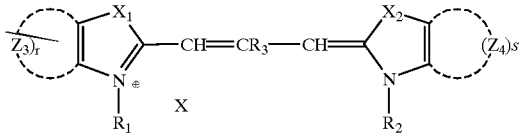

(II)

wherein each of $R_1$ and $R_2$ independently represents a substituted or unsubstituted alkyl group or substituted or unsubstituted aryl group; each of r and s is independently 0 or 1; each of $Z_3$ and $Z_4$ independently represents the atoms necessary to complete a fused benzene, naphthalene, pyridine, or pyrazine ring, which can be further substituted; $R_3$ is a substituted or unsubstituted alkyl group, or a substituted or unsubstituted aryl group; $X_1$ and $X_2$ can each individually be O, S, Se, Te, N—$R_4$, where $R_4$ is a substituted or unsubstituted alkyl group, or substituted or unsubstituted aryl group, with the proviso that $X_1$ and $X_2$ are not both S, Se or Te; and when r or s is 0, the five membered ring containing $X_1$ or $X_2$, respectively, may be further substituted at the 4 and/or 5 position and X is a counterion as necessary to balance the charge.

19. A photographic element according to claim 1 or claim 15, wherein the green sensitive emulsion has been dyed with at least one dye of formula SG-I, SG-II, SG-III, or SG-IV:

SG-I

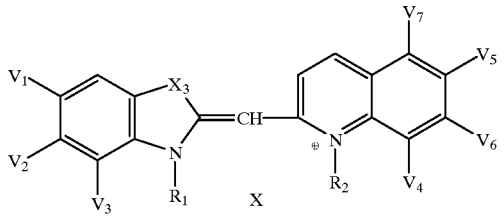

wherein each of $R_1$ and $R_2$ independently represents a substituted or unsubstituted alkyl group or substituted or unsubstituted aryl group; $X_3$ is S or Se, and each of $V_1$ to $V_7$ independently represents hydrogen, a substituted or unsubstituted alkyl group, a substituted or unsubstituted aromatic group, a halogen atom, an acylamino group, a carbamoyl group, a carboxy group, or a substituted or unsubstituted alkoxy group and adjacent pairs of substituents $V_1$ to $V_7$ may be joined to form a fused carbocyclic, heterocyclic, aromatic, or heteroaromatic ring, which may be substituted and and X have the same meaning as in structure I; X is a counterion as necessary to balance the charge;

SG-II

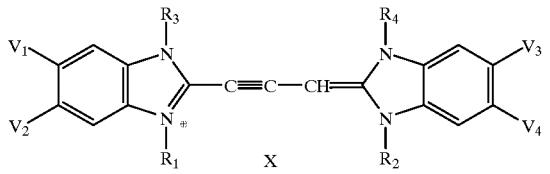

wherein $R_1$, $R_2$, $V_1$ to $V_4$ and X have the same meaning as in structure SG-I; and each of $R_3$ and $R_4$ independently represents a substituted or unsubstituted alkyl group or substituted or unsubstituted aryl group;

SG-III

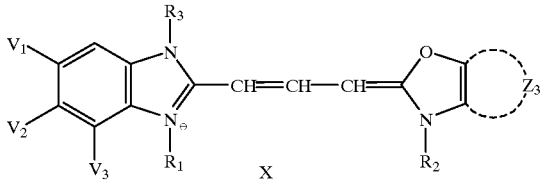

wherein $R_1$, $R_2$, $V_1$–$V_3$ and X, have the same meaning as in formula II and have the same meaning as in formula SG-I; $Z_3$ represents the atoms necessary to complete a fused benzene, naphthalene, pyridine, or pyrazine ring, which can be further substituted; and $R_3$ represents a substituted or unsubstituted alkyl group, or substituted or unsubstituted aryl group.

SG-IV

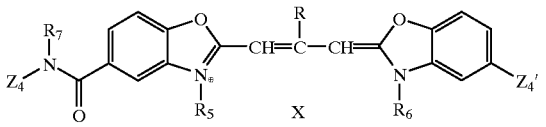

wherein R is hydrogen or a substituted or unsubstituted aryl group or a substituted or unsubstituted alkyl group; $R_5$ and $R_6$ are both independently substituted or unsubstituted alkyl groups; $R_7$ is hydrogen or a substituted or unsubstituted alkyl group; $Z_4$ represents a substituted or unsubstituted aromatic group and X is one or more ions needed to balance the charge on the molecule.

20. A photographic element according to claim 19, wherein the green sensitive emulsion has been dyed with at least one dye of formula SG-IV.

SG-IV

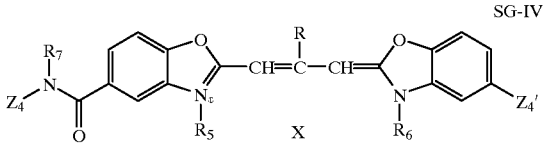

wherein R is hydrogen or a substituted or unsubstituted aryl group or a substituted or unsubstituted alkyl group; $R_5$ and $R_6$ are both independently substituted or unsubstituted alkyl groups; $R_7$ is hydrogen or a substituted or unsubstituted alkyl group; $Z_4$ represents a substituted or unsubstituted aromatic group and X is one or more ions needed to balance the charge on the molecule.

21. A photographic element according to claim 1 wherein the green sensitive emulsion has been dyed with at least one dye of the following:

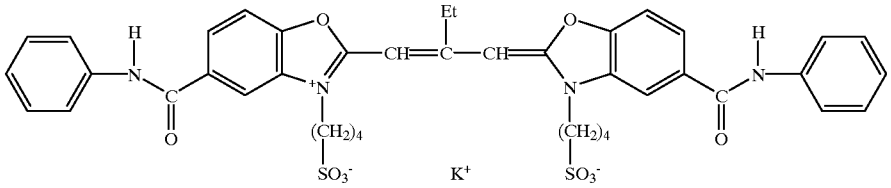

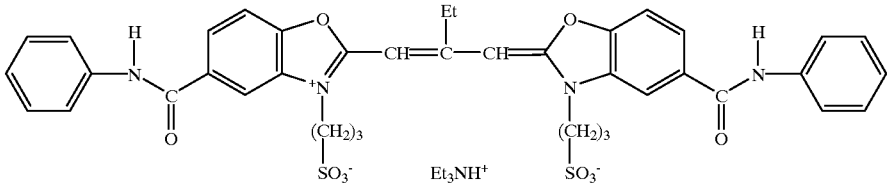

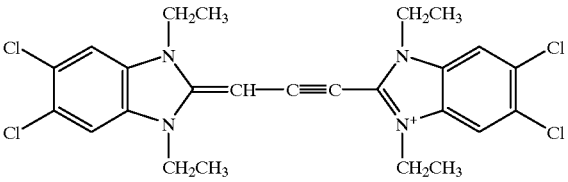

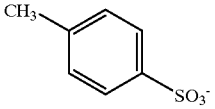

-continued
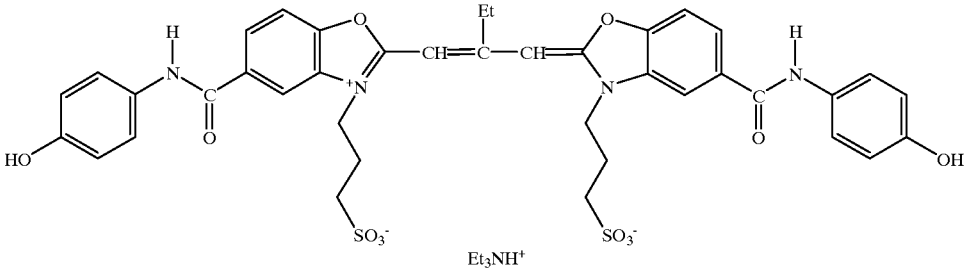
$Et_3NH^+$
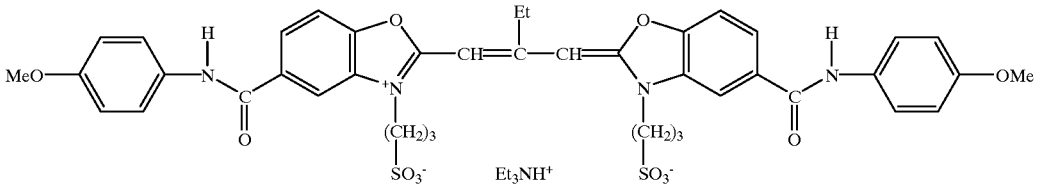
$Et_3NH^+$
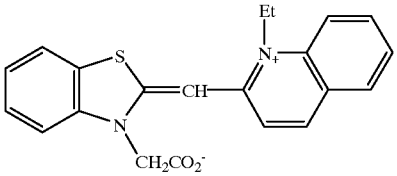
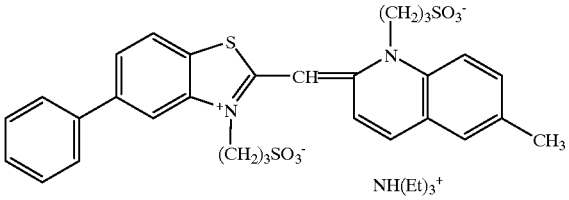
$NH(Et)_3^+$
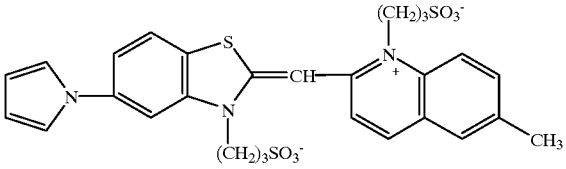
$NH(Et)_3^+$
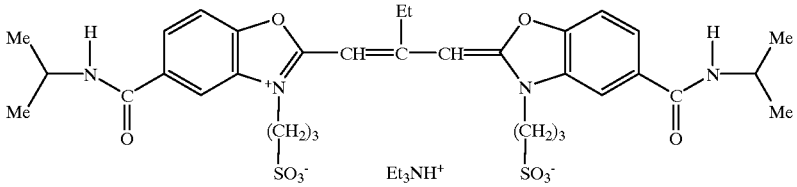
$Et_3NH^+$
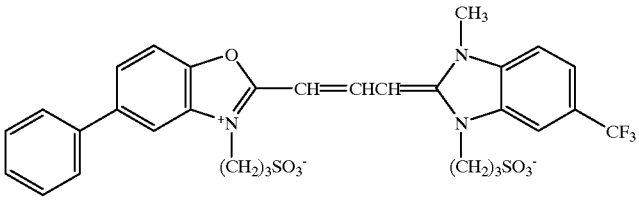
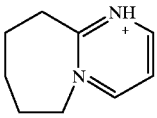

-continued
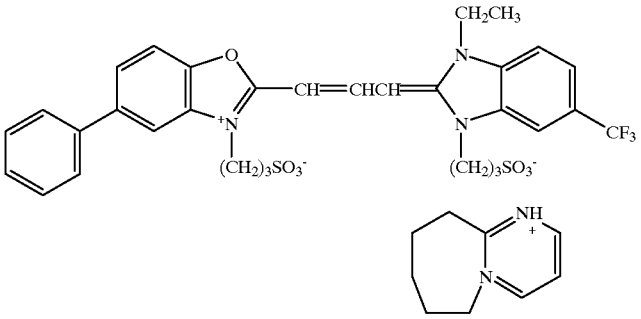
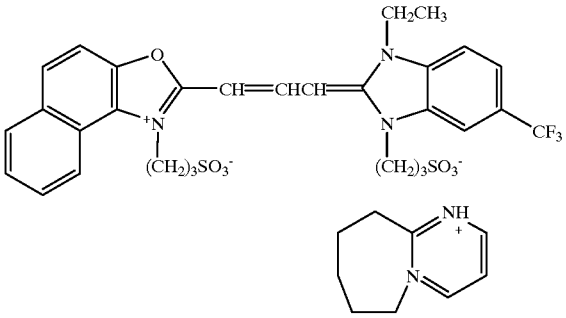
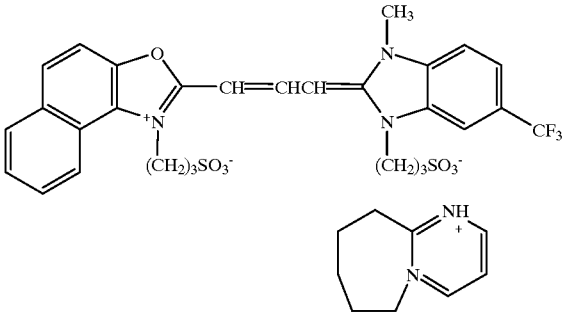
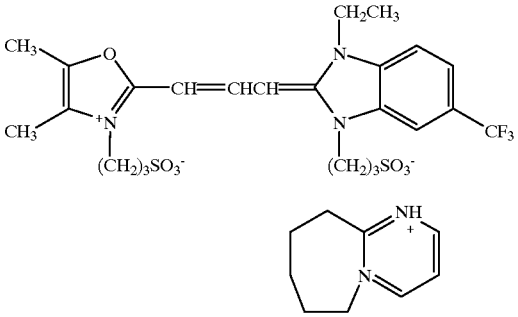
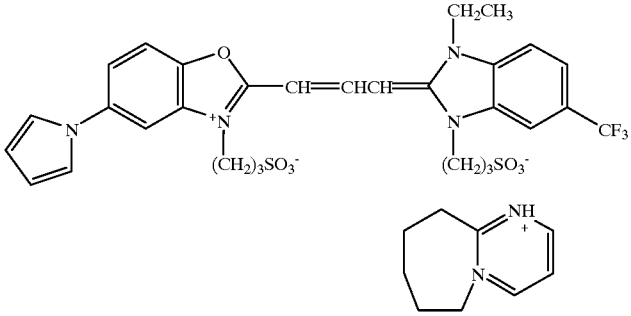

-continued

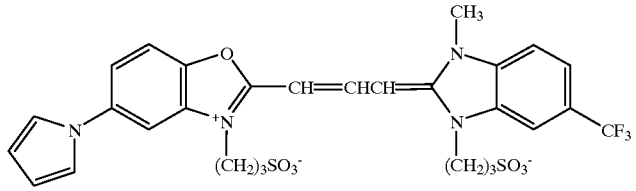

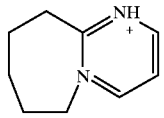

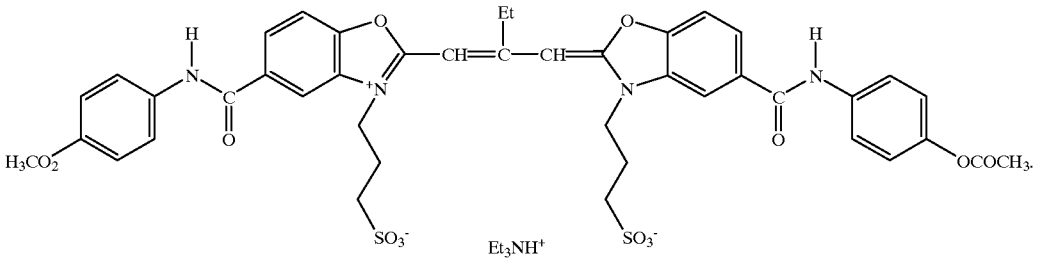

22. A photographic element according to claim 1, wherein the element is a color negative film.

23. A photographic element according to claim 1, wherein the element is a color reversal film.

24. A photographic element according to claim 1, wherein the green silver halide emulsion has a silver iodide content of between zero and 12%, based on silver.

25. A photographic element according to claim 23, wherein each recording layer unit is substantially free of colored masking couplers.

26. A photographic element according to claim 1, capable of producing dye images suitable for digital scanning with subsequent conversion to an electronic form and subsequent reconversion into a viewable form.

27. A silver halide emulsion according to claim 1, wherein the green sensitive emulsion comprises at least two sensitizing dyes.

28. A silver halide emulsion according to claim 27, wherein the green sensitive emulsion comprises at least three sensitizing dyes.

29. A photographic element according to claim 1 capable of producing images suitable for electronic scanning, wherein:

said layer units for separately recording blue, green and red exposures comprise:

a blue recording emulsion layer unit containing at least one dye-forming coupler capable of forming a first image dye;

a green recording emulsion layer unit containing at least one dye-forming coupler capable of forming a second image dye; and, a red recording emulsion layer unit containing at least one dye-forming coupler capable of forming a third image dye;

wherein said first, second, and third dye image-forming couplers are chosen such that the absorption half peak bandwidths of said image dyes are substantially non-coextensive.

30. A photographic element for accurately recording a scene as an image comprising a support and coated on the support a plurality of hydrophilic colloid layers comprising radiation-sensitive silver halide emulsion layers forming recording layer units for separately recording blue, green and red exposures wherein, the green recording layer unit has:

(i) a wavelength of maximum sensitivity of between 520 and 560 nm, (ii) a relative sensitivity at 50% of the maximum sensitivity exhibits an over all breadth of at least about 50 nm, (iii) a relative sensitivity at 80% of the maximum sensitivity exhibits an over all breadth of at least about 27 nm, (iv) a relative sensitivity at 560 nm is at least about 0.40, (v) a relative sensitivity at 550 nm of at least about 0.60, and (vi) a relative sensitivity at 520 nm of at least about 0.55.

* * * * *